US009541887B2

(12) United States Patent
Nakajima et al.

(10) Patent No.: US 9,541,887 B2
(45) Date of Patent: Jan. 10, 2017

(54) CLEANING BLADE, PROCESS CARTRIDGE, AND ELECTROPHOTOGRAPHIC APPARATUS

(71) Applicant: CANON KABUSHIKI KAISHA, Tokyo (JP)

(72) Inventors: Masanobu Nakajima, Toride (JP); Norihiko Kubo, Toride (JP); Hisataka Hisakuni, Toride (JP); Masaya Kawada, Abiko (JP); Kenji Karashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/921,958

(22) Filed: Oct. 23, 2015

(65) Prior Publication Data

US 2016/0124375 A1 May 5, 2016

(30) Foreign Application Priority Data

Oct. 29, 2014 (JP) ..... 2014-220745

(51) Int. Cl.
*G03G 21/00* (2006.01)

(52) U.S. Cl.
CPC ..... *G03G 21/0017* (2013.01)

(58) Field of Classification Search
USPC ..... 399/350
See application file for complete search history.

(56) References Cited

U.S. PATENT DOCUMENTS

| | | | | |
|---|---|---|---|---|
| 6,175,711 | B1 * | 1/2001 | Yoshino | G03G 15/168 399/297 |
| 9,170,556 | B2 * | 10/2015 | Karashima | G03G 21/0017 |
| 2005/0220514 | A1 * | 10/2005 | Hisakuni | G03G 15/161 399/350 |
| 2009/0003905 | A1 * | 1/2009 | Ueno | G03G 21/0017 399/350 |
| 2011/0052288 | A1 * | 3/2011 | Koido | G03G 21/0029 399/351 |

FOREIGN PATENT DOCUMENTS

| | | | |
|---|---|---|---|
| JP | 2001-075451 | A | 3/2001 |
| JP | 2008-268670 | A | 11/2008 |
| JP | 2009-025451 | A | 2/2009 |
| JP | 2012-150203 | A | 8/2012 |

* cited by examiner

*Primary Examiner* — WB Perkey
*Assistant Examiner* — Linda B Smith
(74) *Attorney, Agent, or Firm* — Canon U.S.A. Inc., IP Division

(57) ABSTRACT

A cleaning blade includes an image region and a non-image region in which Young's moduli at positions separated by a distance of L μm from an edge portion in contact with an photosensitive drum are respectively defined as $Y_L$ and $Y'_L$, $Y_0$ and $Y'_0$ are 10 mgf/μm$^2$ or more and 400 mgf/μm$^2$ or less, $Y_{50}/Y_0$ is 0.5 or less, $[\{(Y_0-Y_{20})/Y_0\}/(20-0)]$ is equal to or more than $[\{(Y_{20}-Y_{50})/Y_0\}/(50-20)]$ and, the Young's modulus $Y_{50}$ ≤the Young's modulus $Y'_L$ where L satisfies 0≤L ≤100 μm.

16 Claims, 24 Drawing Sheets

$$\theta_a = \tan^{-1}\left(\frac{h_1 + h_2 + h_3 + \cdots + h_n}{L}\right)$$

CLEANING BLADE, PROCESS CARTRIDGE, AND ELECTROPHOTOGRAPHIC APPARATUS

BACKGROUND OF THE INVENTION

Field of the Invention

The present invention relates to a cleaning blade and a process cartridge and an electrophotographic apparatus that include a cleaning blade.

Description of the Related Art

In general, after a toner image formed on a surface (outer circumferential surface) of an electrophotographic photosensitive member (hereafter also simply referred to as a "photosensitive member") is transferred onto a transfer medium or an intermediate transfer member, or after a toner image is further transferred from an intermediate transfer member onto a transfer medium, a portion of the toner tends to remain on the surface of the photosensitive member and/or the intermediate transfer member. For this reason, the toner remaining on the surface of the photosensitive member or the intermediate transfer member needs to be removed, which is commonly performed with a cleaning blade. This cleaning blade is, for example, a blade-shaped (plate-shaped) article in which the thickness is 1 mm or more and 3 mm or less and a surface facing a cleaning target member (such as a photosensitive member or an intermediate transfer member) has a longitudinal length larger than the thickness.

Such a cleaning blade is used, in an electrophotographic apparatus, in the state of being attached to and fixed by a metal holder, for example. Also, the cleaning blade is disposed such that the edge portion (tip edge-line portion) is in contact with a cleaning target member, for example.

A commonly used material for the cleaning blade is urethane rubber because it is excellent in terms of wear resistance and the degree of permanent set, for example.

In order to meet the recent demand for higher image quality, a toner having a small particle size and a high sphericity (nearly spherical) has been developed. This toner having a small particle size and a high sphericity allows a relatively high transfer efficiency and can meet the demand for higher image quality.

However, the toner having a small particle size and a high sphericity is difficult to sufficiently remove with a cleaning blade from the surface of a cleaning target member, which may result in insufficient cleaning. This is because the toner having a small particle size and a high sphericity tends to slip through small gaps formed between the cleaning blade and the cleaning target member, compared with other toners.

In order to suppress the slipping through of the toner, it is effective to increase the contact pressure between the cleaning blade and the cleaning target member to thereby reduce the gaps.

However, as the contact pressure between the cleaning blade and the cleaning target member increases, the frictional force between the cleaning blade and the cleaning target member tends to increase. As the frictional force between the cleaning blade and the cleaning target member increases, the cleaning blade tends to be pulled in the moving direction of the surface of the cleaning target member, resulting in curling of the edge portion of the cleaning blade is some cases. When the cleaning blade resists the curling force and returns to the original shape, it may make an unusual sound (chatter). When cleaning is performed with such a cleaning blade having a curled edge portion, local wear tends to occur in a region near the edge portion of the cleaning blade (region separated from the edge portion by several to several tens of micrometers). When the cleaning is further performed in this state, the local wear worsens, which results in insufficient removal of the toner during cleaning.

In order to increase the longevity of the cleaning blade and the cleaning target member and to achieve energy conservation, for example, there is a demand for reduction in the rotational torque of the cleaning target member during cleaning (torque reduction). In order to achieve torque reduction, it is effective to decrease the friction between the surface of the contact portion of the cleaning blade and the cleaning target member.

Regarding this torque reduction, Japanese Patent Laid-Open No. 2008-268670 describes a technique of making fine particles having an average particle size of 3 μm or less be present in a surface layer of a cleaning blade formed of urethane rubber (urethane elastomer), the surface layer being in contact with a cleaning target member.

Japanese Patent Laid-Open No. 2012-150203 describes a technique of forming a surface layer in the contact portion (in contact with a cleaning target member) of a cleaning blade, the surface layer having a higher hardness than the base layer of the cleaning blade.

Japanese Patent Laid-Open No. 2009-025451 describes a technique of allowing a continuous increase in the nitrogen concentration of a cleaning blade from the inside of a contact portion (in contact with a cleaning target member) toward the surface of the contact portion.

Japanese Patent Laid-Open No. 2001-075451 describes a technique of making the isocyanurate-group concentration of the surface of an edge portion of a cleaning blade formed of urethane rubber (urethane elastomer) be higher than the isocyanurate-group concentration of the inside of the edge portion.

However, studies by the inventors of the present invention have revealed the presence of the following problems in the above-described existing techniques.

In the bilayer cleaning blade having a surface layer and a base layer such as those described in Japanese Patent Laid-Open Nos. 2008-268670 and 2012-150203, the surface layer and the base layer of the cleaning blade being in contact with a cleaning target member behave differently. For this reason, separation or chipping (hollowing out) of the surface layer is caused in some cases by, for example, irregularities (in general, 1 μm or more and 2 μm or less) of the surface of the cleaning target member or foreign matter (including the toner) present on this surface. When the technique described in Japanese Patent Laid-Open No. 2008-268670 is employed, fine particles tend not to be uniformly distributed in the surface layer, so that considerable variations in characteristics within the contact portion occur, which results in local chipping or insufficient cleaning in some cases.

The technique described in Japanese Patent Laid-Open No. 2009-025451, which is to increase the cross-linking concentration on the surface side of the contact portion (in contact with a cleaning target member) of a cleaning blade formed of urethane rubber (urethane elastomer) to thereby form a hard segment. However, this technique does not allow sufficient torque reduction in some cases.

The technique described in Japanese Patent Laid-Open No. 2001-075451 is to apply a mixed solution of an isocyanate compound and an isocyanurate-forming catalyst to the inner surface of a mold to thereby increase the isocyanurate-group concentration of the surface of a cleaning blade formed of urethane rubber (urethane elastomer). When this technique is employed to increase the isocyanurate-group concentration such that the near-surface portion of the cleaning blade has a substantially uniform hardness and sufficient torque reduction is achieved, the cleaning blade may have a low capability of conforming (conformability) to irregularities in the surface of a cleaning target member or to foreign matter that may be present on this surface. Upon occurrence of degradation of the conformability to irregularities in the surface of a cleaning target member or to foreign matter that may be present on this surface, the above-described slipping through of toner tends to occur.

When toner particles or particles having a size similar to that of toner particles are caught between the cleaning blade and a cleaning target member, the above-described existing techniques tend not to provide sufficiently high conformability to such particles. Specifically, the contact portion (in contact with the cleaning target member) of the cleaning blade deforms with a very large radius of curvature relative to caught particles, so that the toner slips through around the caught particles in some cases.

In addition, within a cleaning blade, different characteristics are required between an image region (developer-coating region) and a non-image region (non-developer-coating region). There is also a problem in which, when a cleaning blade having variations in the hardness distribution is unexpectedly worn in toner-deficient regions such as end portions, a decrease in the hardness and an increase in the coefficient of friction occur.

In particular, end regions in which the supply amount of toner is small tend to wear, resulting in a decrease in the hardness, leading to curling of end portions of the cleaning blade. In conclusion, in order to effectively use a multilayer cleaning blade, curling of end portions in the non-image region needs to be addressed.

The present invention provides a cleaning blade that allows reduction in the friction of the surface of the contact portion in contact with a cleaning target member and that has a high conformability to irregularities in the surface of a cleaning target member and foreign matter that may be present on this surface; a process cartridge including the cleaning blade and an electrophotographic apparatus including the cleaning blade.

SUMMARY OF THE INVENTION

The present invention provides a cleaning blade that is formed of urethane rubber and is in contact with an image-carrying member carrying a toner image to clean the image-carrying member, the cleaning blade including:

a first surface that faces the image-carrying member and is orthogonal to a thickness direction of the cleaning blade; and a second surface that forms, together with the first surface, an edge portion that is in contact with the image-carrying member, wherein at least a portion of the second surface is cured so as to satisfy relationships below:

$$10\ \text{mgf}/\mu\text{m}^2 \leq Y_0 \leq 400\ \text{mgf}/\mu\text{m}^2$$

$$0 < Y_{50}/Y_0 \leq 0.5$$

$$\{(Y_{20}-Y_{50})/Y_0\}/(50-20) \leq \{(Y_0-Y_{20})/Y_0\}/(20-0)$$

$$10\ \text{mgf}/\mu\text{m}^2 \leq Y'_0 \leq 400\ \text{mgf}/\mu\text{m}^2$$

$$Y_{50} \leq Y'_L \text{ where } L \text{ satisfies } 0 \leq L \leq 100\ \mu\text{m}$$

where $Y_0$: Young's modulus of the edge portion in a region of the second surface, the region corresponding to a region in which an image is formed in the image-carrying member $Y_{50}$: Young's modulus at a position 50 μm separated from the edge portion in a region of the second surface, the region corresponding to the region in which an image is formed in the image-carrying member $Y_{20}$: Young's modulus at a position 20 μm separated from the edge portion in a region of the second surface, the region corresponding to the region in which an image is formed in the image-carrying member $Y'_0$: Young's modulus of the edge portion in a region of the second surface, the region corresponding to a non-image-forming region in which no image is formed in the image-carrying member L: distance from the edge portion of the second surface $Y'_L$: Young's modulus at a position L μm separated from the edge portion in a region of the second surface, the region corresponding to the non-image-forming region in which no image is formed in the image-carrying member.

Further features of the present invention will become apparent from the following description of exemplary embodiments with reference to the attached drawings.

BRIEF DESCRIPTION OF THE DRAWINGS

FIG. 11 illustrates the method for calculating an average inclination angle □a.

DESCRIPTION OF THE EMBODIMENTS

Figure 1A:
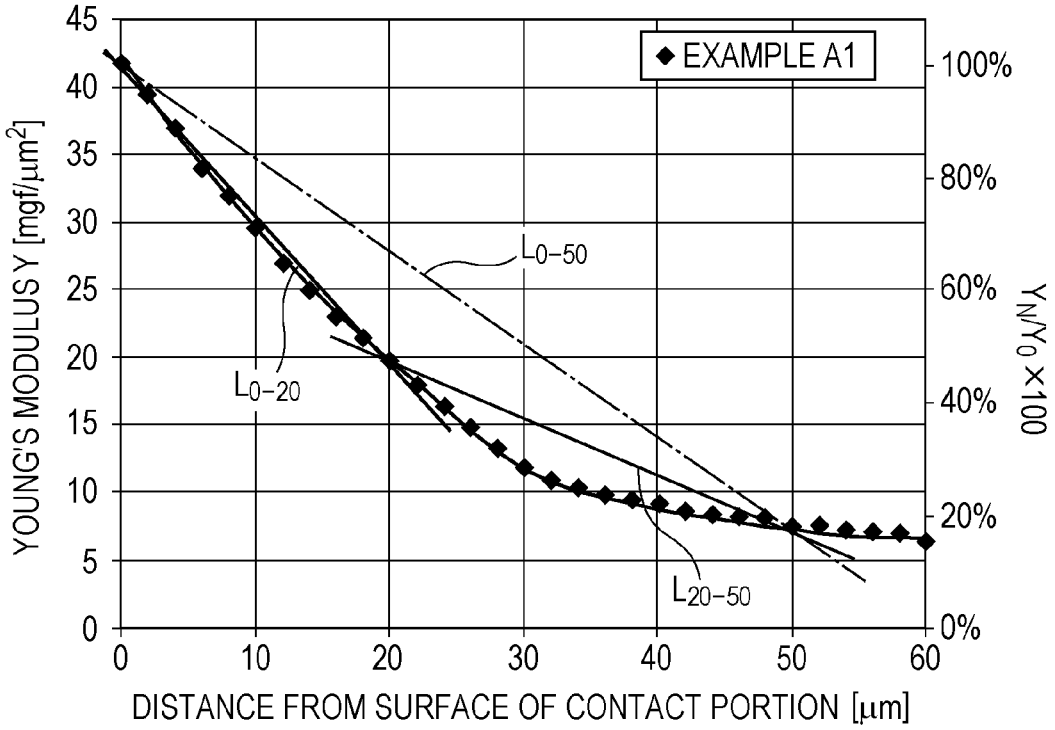
FIGS. 1A and 1B are graphs illustrating the results of Example A1.

The inventors of the present invention performed thorough studies and, as a result, have found the following findings: by appropriately controlling the Young's modulus of the surface and inside of a contact portion (in contact with a cleaning target member, that is, an image-carrying member on which a toner image is formed) of a cleaning blade (hereafter this contact portion may also be referred to as a "contact portion of a cleaning blade" or simply a "contact portion"), a cleaning blade can be obtained in which reduction in the friction of the surface of the contact portion is achieved, a high conformability to irregularities in the surface of the cleaning target member and foreign matter that may be present on this surface (hereafter this conformability may also be simply referred to as "conformability to irregularities and foreign matter) is achieved, and the edge portion tends not be chipped.

Specifically, by adjusting the surface of the contact portion of a cleaning blade so as to have a Young's modulus $Y_0$ of 10 mgf/μm$^2$ or more, reduction in the friction of the surface of the contact portion of the cleaning blade can be achieved. In addition, the contact portion of the cleaning blade tends not to deform.

This reduction in the friction of the surface of the contact portion of the cleaning blade can be achieved probably because the friction-related ultramicroscopic contact point (true contact area) between the cleaning blade and the cleaning target member is reduced. The reduction in the friction of the surface of the contact portion of the cleaning blade is achieved and the contact portion of the cleaning blade tends not to deform, so that curling of (the edge portion of) the cleaning blade is suppressed. Also, the reduction in the friction of the surface of the contact portion of the cleaning blade is achieved and the contact portion of the cleaning blade tends not to deform, so that a cleaning angle β described below can be easily maintained to be large. In addition, the width of the contact portion of the cleaning blade is stabilized. Accordingly, the stick-slip motion and unusual sound (chatter) of the cleaning blade can be suppressed.

As a method of increasing the Young's modulus of the contact portion of a urethane-rubber cleaning blade, it is effective to control the molecular structure of the urethane rubber of the contact portion.

The urethane rubber can be synthesized with, for example, a polyisocyanate, a polyol, a chain extender (such as a multifunctional polyol), and a urethane-rubber synthesis catalyst.

In a case where the urethane rubber is a polyester-based urethane rubber, the polyol used for synthesizing the polyester-based urethane rubber is a polyester-based polyol. In another case where the polyester-based urethane rubber is an aliphatic polyester-based urethane rubber, the polyol used for synthesizing the aliphatic polyester-based urethane rubber is an aliphatic polyester-based polyol.

As the method of increasing the Young's modulus of the contact portion of a urethane-rubber cleaning blade, more specifically, the degree of cross-linking of the urethane rubber may be changed or the molecular weight of the raw material for the urethane rubber may be controlled. Another method that may be suitably used is to make the urethane rubber contain an isocyanurate group to increase the isocyanurate-group concentration. The urethane rubber can be made to contain an isocyanurate group as a group derived from a polyisocyanate serving as a raw material for the urethane rubber.

A cleaning blade according to an embodiment of the present invention may be a cleaning blade formed of a urethane rubber containing an isocyanurate group from the standpoint of ease of control of the Young's modulus of the surface of the contact portion. In this case, in order to increase the Young's modulus of the surface of the contact portion of the cleaning blade, the isocyanurate-group content of the surface (and near-surface region) of the urethane rubber of the contact portion can be increased. Specifically, in a case where the urethane rubber is a polyester-based urethane rubber, the surface of the polyester-based urethane rubber in the contact portion is measured by a μATR method to provide an IR spectrum. At this time, a ratio $I_{SI}/I_{SE}$ may be 0.50 or more where $I_{SI}$ represents the intensity of a C—N peak derived from an isocyanurate group in the polyester-based urethane rubber and $I_{SE}$ represents the intensity of a C═O peak derived from an ester group in the polyester-based urethane rubber. The C—N peak is positioned at 1411 cm$^{-1}$. The C═O peak is positioned at 1726 cm$^{-1}$. This ratio $I_{SI}/I_{SE}$ is a parameter based on the intensity of the C═O peak derived from an ester group, which is not influenced by the amount of the isocyanurate group. And this base is compared with the intensity of the C—N peak derived from the isocyanurate group, so that the parameter allows the qualitative determination of the amount of the isocyanurate group.

Figure 4A:
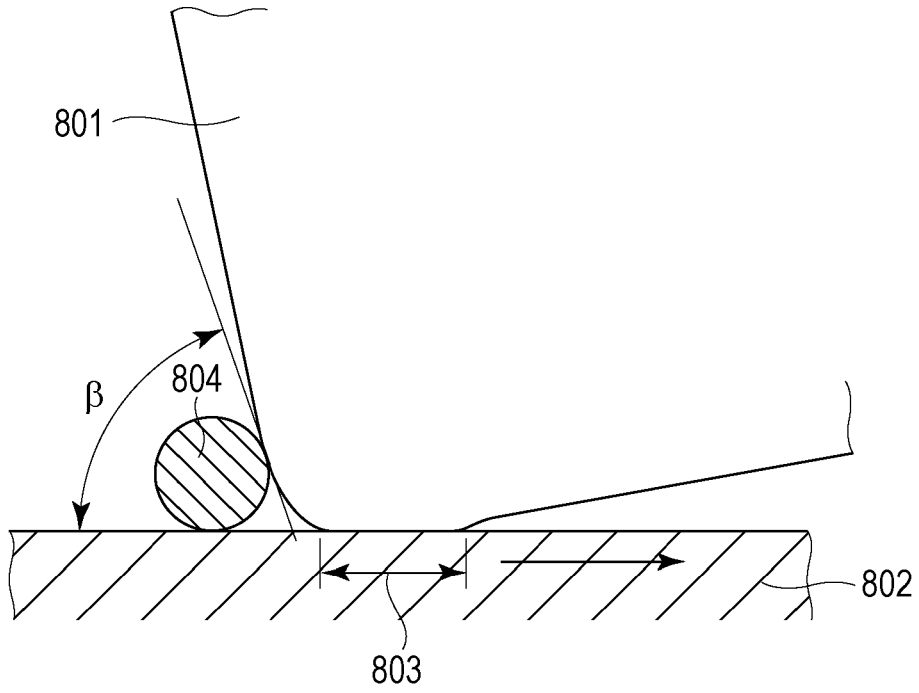
FIGS. 4A and 4B are schematic views illustrating a contact portion (in contact with a cleaning target member) of a cleaning blade and a region near the contact portion.
Figure 4B:
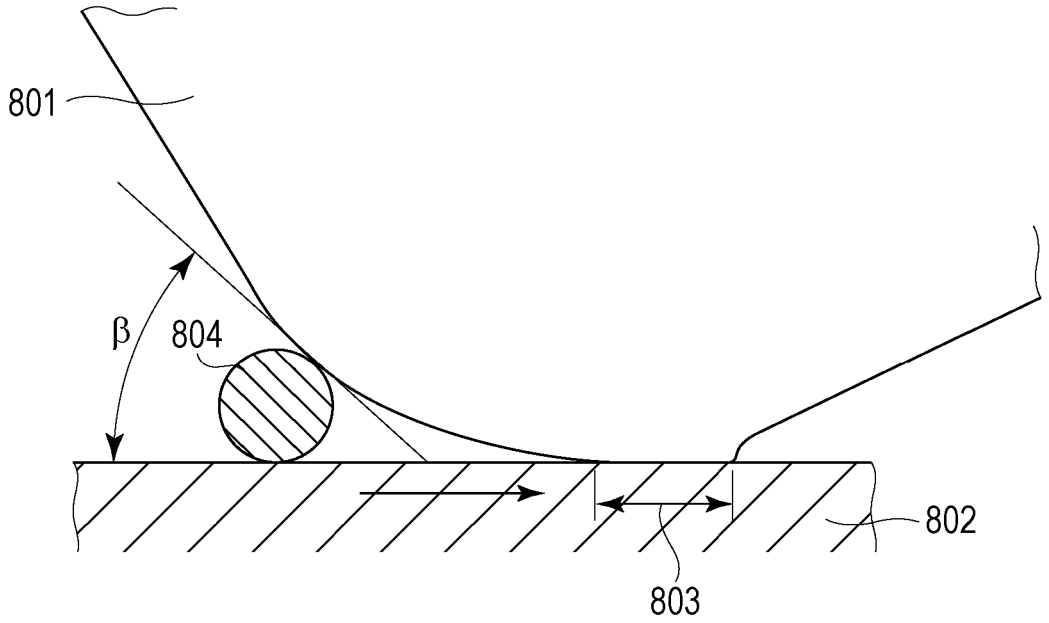

FIGS. 4A and 4B are schematic views illustrating the contact portion (in contact with a cleaning target member) of a cleaning blade and a region near the contact portion.

A cleaning blade 801 is in contact with, in a contact portion 803, a cleaning target member 802, with a predetermined contact pressure and at a cleaning angle β. The capability of blocking the toner entering the wedge portion beyond the contact portion 803 depends on the contact pressure and the cleaning angle β. The larger the cleaning angle β, even in the case of a low contact pressure, the higher the toner blocking capability. In FIG. 4A, the cleaning angle β is large so that the toner blocking capability is high, compared with FIG. 4B.

As illustrated in FIGS. 4A and 4B, the cleaning blade 801 is subjected to a load in the moving direction of the surface of the cleaning target member 802 (the direction being indicated by arrows in FIGS. 4A and 4B). This load functions as a load that deforms the contact portion of the cleaning blade.

Figure 5A:
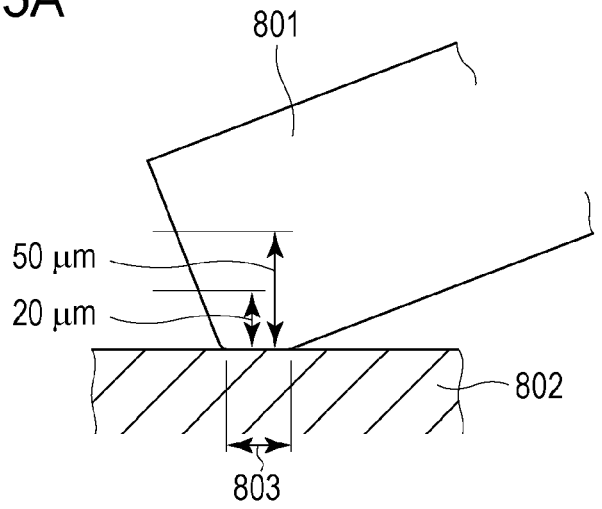
FIGS. 5A, 5B, and 5C are schematic views illustrating a state in which a cleaning blade is in contact with a cleaning target member.
Figure 5B:
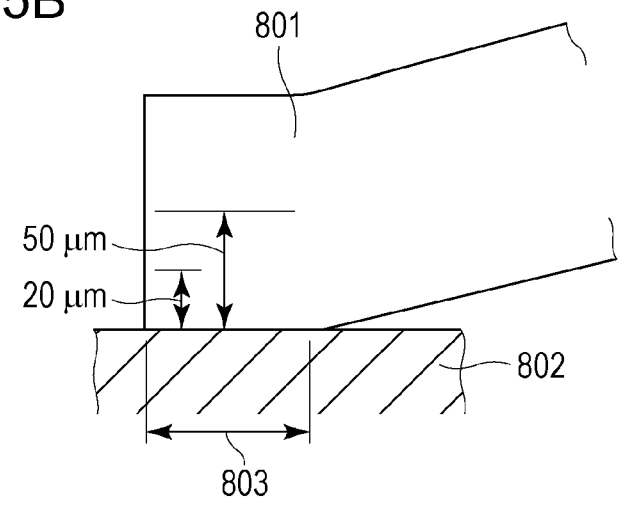
Figure 5C:
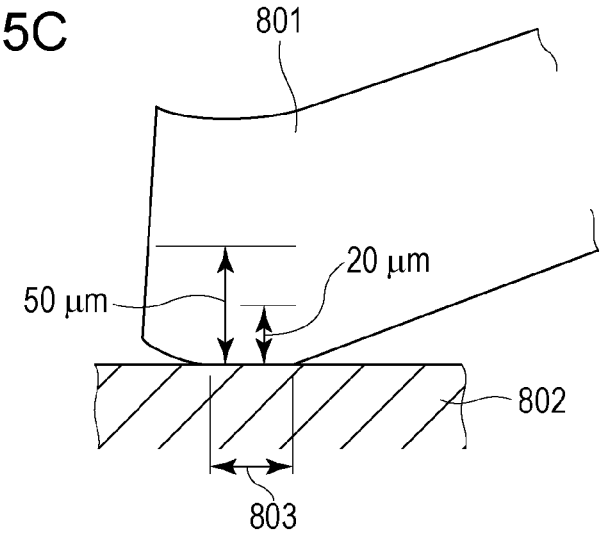

FIGS. 5A to 5C illustrate states in which cleaning blades are in contact with cleaning target members.

As a state in which the cleaning blade 801 is in contact with the cleaning target member 802, as illustrated in FIG. 5A, the edge portion of the cleaning blade 801 is in contact with the cleaning target member 802. As another state, as illustrated in FIG. 5C, the edge portion of the cleaning blade 801 is separated from and is above the cleaning target member 802 and a surface (facing the cleaning target member 802) of the cleaning blade 801 is in contact with the cleaning target member 802 (what is called non-edge contact). As still another state, as illustrated in FIG. 5B, there is an intermediate state between the state in FIG. 5A and the state in FIG. 5C. In the present invention, in any of these states, a portion of the cleaning blade, the portion being in contact with the cleaning target member, is referred to as a contact portion.

The contact portion does not necessarily have a uniform state because the surface of the cleaning target member has irregularities in the longitudinal direction of the cleaning blade and the moving direction of the surface of the cleaning target member and image formation is locally performed. For example, in a case where, for some reasons, a toner 804 is caught by the contact portion 803, the cleaning blade 801 deforms due to its elasticity and holds the toner 804. At this time, the surface of the cleaning blade 801 tends to conform to the shape of the toner 804. When the toner 804 is caught by the contact portion 803 of the cleaning blade 801, the toner 804 applies a force in a direction in which the cleaning blade 801 is pushed up and in the moving direction of the surface of the cleaning target member 802 (direction indicated by arrows in FIGS. 4A and 4B).

Figure 6A:
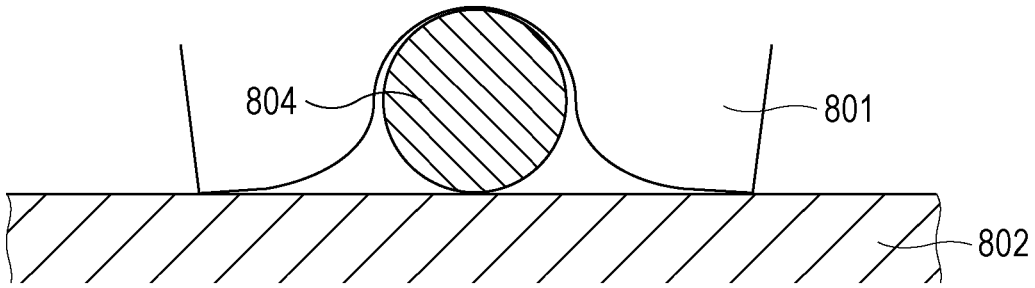
FIGS. 6A and 6B are schematic views illustrating deformation of a cleaning blade where a toner is caught between the cleaning blade and a cleaning target member.
Figure 6B:
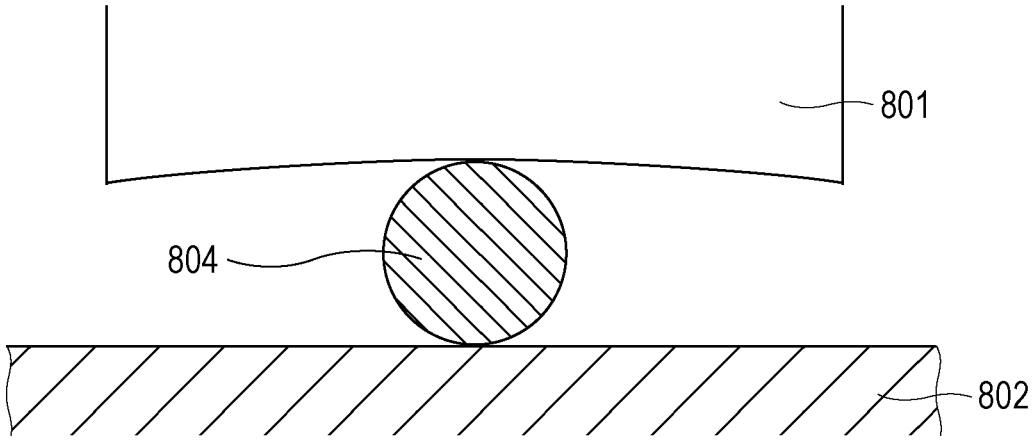

FIGS. 6A and 6B are schematic views illustrating deformation of a cleaning blade when a toner (one type of foreign matter) is caught between the cleaning blade and the cleaning target member. Incidentally, FIGS. 6A and 6B are schematic views viewed from the left side of the schematic views in FIGS. 4A and 4B.

In a case where the surface of the cleaning blade 801 has a low Young's modulus, as illustrated in FIG. 6A, the cleaning blade 801 tends to conform to the shape of the toner 804. By contrast, in a case where the Young's modulus is excessively high, the cleaning blade 801 tends not to conform to the shape of toner 804. In this case where the cleaning blade 801 tends not to conform to the shape of toner 804, in the surface of the cleaning blade 801, not only the portion in contact with the toner 804, but also other portions around the toner 804 are pushed downward, so that, as illustrated in FIG. 6B, a deformation having a large radius of curvature tends to occur. In this case where a deformation having a large radius of curvature occurs as illustrated in FIG. 6B, toner tends to slip through gaps around the toner 804. For this reason, although the surface of the contact portion of a cleaning blade according to an embodiment of the present invention has a Young's modulus $Y_0$ of 400 mgf/μm$^2$ or less, the Young's modulus $Y_0$ is preferably 344 mgf/μm$^2$ or less, more preferably 250 mgf/μm$^2$ or less.

As described above, a cleaning blade according to an embodiment of the present invention is a cleaning blade formed of a urethane rubber containing an isocyanurate group. In order to suppress the Young's modulus $Y_0$ of the surface of the contact portion of this cleaning blade to a certain value (400 mgf/μm$^2$ or less), the isocyanurate-group content of the surface (and near-surface region) of the urethane rubber in the contact portion may be suppressed to a certain value. Specifically, the above-described ratio $I_{SI}/I_{SE}$ may be set to 1.55 or less. In order to suppress the Young's modulus $Y_0$ to 344 mgf/μm$^2$ or less, the ratio $I_{SI}/I_{SE}$ may be set to 1.35 or less. In order to suppress the Young's modulus $Y_0$ to 250 mgf/μm$^2$ or less, the ratio $I_{SI}/I_{SE}$ may be set to 1.20 or less.

As described above, although the surface of the contact portion of a cleaning blade according to an embodiment of the present invention has a Young's modulus $Y_0$ in the range of 10 mgf/μm$^2$ or more and 400 mgf/μm$^2$ or less, the Young's modulus $Y_0$ is preferably in the range of 10 mgf/μm$^2$ or more and 344 mgf/μm$^2$ or less, more preferably in the range of 10 mgf/μm$^2$ or more and 250 mgf/μm$^2$ or less. In order to adjust the Young's modulus $Y_0$ of the surface of the contact portion of the cleaning blade to be in the range of 10 mgf/μm$^2$ or more and 400 mgf/μm or less, the ratio $I_{SI}/I_{SE}$ may be set to 0.50 or more and 1.55 or less. In order to adjust the Young's modulus $Y_0$ to be in the range of 10 mgf/μm$^2$ or more and 344 mgf/μm$^2$ or less, the ratio $I_{SI}/I_{SE}$ may be set to 0.50 or more and 1.35 or less. In order to adjust the Young's modulus $Y_0$ to be in the range of 10 mgf/μm$^2$ or more and 250 mgf/μm$^2$ or less, the ratio $I_{SI}/I_{SE}$ may be set to 0.50 or more and 1.20 or less.

A cleaning blade according to an embodiment of the present invention is produced such that the Young's modulus of the surface of the contact portion is relatively high (10 mgf/μm$^2$ or more and 400 mgf/μm$^2$ or less) and the Young's modulus decreases from the surface to the inside of the contact portion. Specifically, the cleaning blade is produced such that a ratio $Y_{50}/Y_0$ of a Young's modulus $Y_{50}$ at a position 50 μm inside from the surface of the contact portion to the Young's modulus $Y_0$ is more than 0 and 0.5 or less (preferably 0.2 or less). As a result, even when the surface of the contact portion has a relatively high Young's modulus, a high conformability to irregularities and foreign matter can be provided. By setting the ratio $Y_{50}/Y_0$ to more than 0 and 0.5 or less (preferably 0.2 or less), the cleaning angle β is easily maintained to be large so that a high toner blocking capability can be obtained.

Thus, the Young's modulus $Y_0$ is set to be in the range of 10 mgf/μm$^2$ or more and 400 mgf/μm$^2$ or less and the ratio $Y_{50}/Y_0$ is set to be more than 0 and 0.5 or less. This means that the Young's modulus sharply decreases from the surface to the inside of the contact portion of the cleaning blade.

As a result of studies by the inventors of the present invention, it has been found that chipping of a cleaning blade tends to occur in portions where stress applied to the cleaning blade is concentrated. It has also been found that this concentration of stress tends to occur at interfaces between multiple layers having different Young's moduli and forming a cleaning blade and at portions where the Young's modulus sharply changes.

For this reason, in a cleaning blade according to an embodiment of the present invention in which, as described above, the Young's modulus sharply decreases from the surface to the inside of the contact portion, in particular, the Young's modulus very sharply decreases in the near-surface region of the contact portion. Specifically, the average rate of change of the Young's modulus from the surface to a position 20 μm inside of the contact portion is set to be equal to or larger than the average rate of change of the Young's modulus from the position 20 μm inside to a position 50 μm inside. The average rate of change of the Young's modulus from the surface to the position 20 μm inside of the contact portion is represented by $[\{(Y_0-Y_{20})/Y_0\}/(20-0)]$ where $Y_{20}$ represents the Young's modulus at the position 20 μm inside from the surface of the contact portion of the cleaning blade. The average rate of change of the Young's modulus from the position 20 μm inside to the position 50 μm inside is represented by $[\{(Y_{20}-Y_{50})/Y_0\}/(50-20)]$. Thus, even when the Young's modulus sharply decreases from the surface to the inside (50 μm inside from the surface) of the contact portion, the cleaning blade tends not to be chipped. In addition, the cleaning blade has a higher conformability to irregularities in the surface of the cleaning target member and foreign matter that may be present on this surface. This is probably because the cleaning blade is produced such that the Young's modulus sharply decreases in the near-surface region subjected to a high stress due to deformation and, in the inner region, the Young's modulus mildly decreases, so that the stress due to deformation is scattered.

Hereafter, the average rate of change of the Young's modulus $[\{(Y_0-Y_{20})/Y_0\}/(20-0)]$ from the surface to the position 20 μm inside of the contact portion is also referred to as "$\Delta Y_{0-20}$". The average rate of change of the Young's modulus $[\{(Y_{20}-Y_{50})/Y_0\}/(50-20)]$ from the position 20 μm inside to the position 50 μm inside is also referred to as "$\Delta Y_{20-50}$". These symbols can be used to state that a cleaning blade according to an embodiment of the present invention satisfies $\Delta Y_{0-20} \leq \Delta Y_{20-50}$.

As described above, a cleaning blade according to an embodiment of the present invention is produced such that the ratio $Y_{50}/Y_0$ of the Young's modulus $Y_{50}$ to the Young's modulus $Y_0$ is more than 0 and 0.5 or less, and also the ratio $Y_{20}/Y_0$ of the Young's modulus $Y_{20}$ to the Young's modulus $Y_0$ may be more than 0 and 0.5 or less. As a result, the cleaning blade has a higher conformability to irregularities in the surface of a cleaning target member and foreign matter that may be present on this surface.

In an embodiment according to the present invention, in a graph in which the abscissa axis indicates the distance from the surface of the contact portion of a cleaning blade (the distance at the surface of the contact portion is defined as 0 μm) and the ordinate axis indicates the Young's modulus, a Young's modulus $Y_N$ at any position (position separated by a distance of N μm from the surface of the contact portion, $0<N<50$ [μm]) over the range from the surface to a position 50 μm inside of the contact portion can be positioned below a straight line connecting the Young's modulus $Y_0$ and the Young's modulus $Y_{50}$ (smaller than the straight line). This means that the profile of changes in the Young's modulus from the surface to the inside of the contact portion of the cleaning blade is convex downward. As a result, the cleaning blade has a higher conformability to irregularities in the surface of a cleaning target member and foreign matter that may be present on this surface.

Figure 7A:
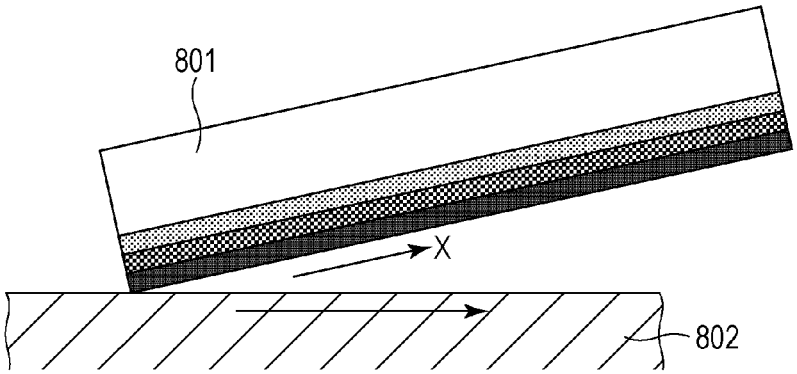
FIG. 7A is a schematic view representing, with shades of color, the magnitude of the Young's modulus of a cleaning blade.
Figure 7B:
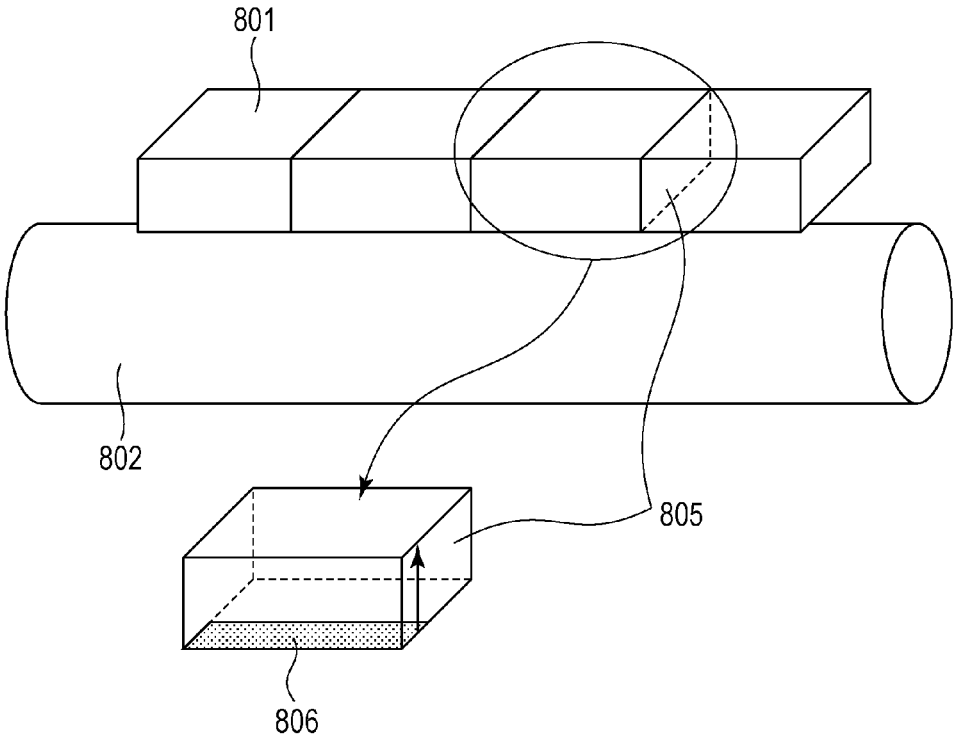
FIG. 7B is a schematic view illustrating portions of a cleaning blade where the Young's modulus is measured.

FIG. 7A is a schematic view representing, with shades of color, the magnitude of the Young's modulus of a cleaning blade. FIG. 7B is a schematic view illustrating portions of the cleaning blade where the Young's modulus is measured. The load that deforms the contact portion of the cleaning blade is turned into a stress in a direction (in FIG. 7A, the direction indicated by arrow X) along a surface (facing the cleaning target member) of the cleaning blade. In FIG. 7A, the darker the color, the higher the Young's modulus. Incidentally, for convenience of explanation, FIG. 7A is illustrated such that the Young's modulus changes stepwise. However, such changes in the Young's modulus of a cleaning blade according to an embodiment of the present invention are not limited to stepwise changes and may be continuous changes.

The Young's modulus of a cleaning blade may change continuously rather than stepwise. Such continuous changes in the Young's modulus mean that the cleaning blade does not have any interface that is formed between portions having different Young's moduli and that tends to cause separation or chipping.

In a cleaning blade according to an embodiment of the present invention, a surface region is responsible for local (micro) deformations in the near-surface region of the contact portion of the cleaning blade, such as the conformability to irregularities in the surface of a cleaning target member and foreign matter present on this surface and suppression of chipping of the edge portion. This surface region is a region in which the Young's modulus decreases from the surface to the inside of the contact portion as described above. On the other hand, an inside region may be responsible for the entire (macro) characteristics of the cleaning blade, such as warping of the whole cleaning blade and temperature-dependent characteristic changes.

This inside region is an inner region relative to the surface region. The surface region of the cleaning blade may have a thickness that is ½ or less of the thickness of the cleaning blade.

In general, a portion (contact portion or nip portion) in which the cleaning blade and a cleaning target member are in contact with each other has a width of several tens to several hundreds of micrometers. Thus, the surface region may extend over a length of 2 mm or more from the edge portion of the cleaning blade.

The way of supporting the cleaning blade is, for example, bonding the cleaning blade to a support member or sandwiching the cleaning blade between a plurality of support members. Another way of supporting the cleaning blade is, for example, forming the cleaning blade at the tip of a support member (a portion of the cleaning blade is used as a support member).

As described above, a cleaning blade according to an embodiment of the present invention is a cleaning blade formed of a urethane rubber. Among urethane rubbers, from the standpoint of mechanical strength such as wear resistance and resistance (creep resistance) to permanent deformation due to contact pressure, preferred are polyester-based urethane rubbers and, of these, more preferred are aliphatic polyester-based urethane rubbers.

In order to control the Young's modulus of the contact portion of a cleaning blade as described above, it is effective to control the molecular structure of the urethane rubber.

The urethane rubber can be synthesized with, for example, a polyisocyanate, a high-molecular-weight polyol, a chain extender (such as a multifunctional low-molecular-weight polyol), and a urethane-rubber synthesis catalyst. In order to synthesize a polyester-based urethane rubber, a polyester-based polyol is used as the polyol. In order to synthesize an aliphatic polyester-based urethane rubber, an aliphatic polyester-based polyol is used as the polyol.

As the method of controlling the Young's modulus of the contact portion of the urethane-rubber cleaning blade as described above, specifically, for example, the degree of cross-linking of the urethane rubber is changed or the molecular weight of a raw material for the urethane rubber is controlled. Among such methods, preferred is a method in which the concentration of an isocyanurate group derived from a polyisocyanate serving as a raw material for the urethane rubber is controlled so as to increase from the inside to the surface of the urethane rubber, from the standpoint of accuracy of control of the Young's modulus.

Regarding a urethane rubber containing an isocyanurate group (isocyanurate bond) and a urethane rubber containing no isocyanurate group, even in a case where these urethane rubbers have a similar hardness (in International Rubber Hardness Degrees, for example), the urethane rubber containing an isocyanurate group allows a large cleaning angle β to be easily maintained.

Examples of the polyisocyanate include 4,4'-diphenylmethane diisocyanate (MDI, 4,4'-MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylene polyphenyl isocyanate (PAPI). Of these, preferred is 4,4'-diphenylmethane diisocyanate.

Examples of the high-molecular-weight polyol (aliphatic polyester-based polyol) include ethylene butylene adipate polyester polyol, butylene adipate polyester polyol, hexylene adipate polyester polyol, and lactone-based polyester polyol. These polyols may be used in combination. Of these aliphatic polyester-based polyols, preferred are butylene adipate polyester polyol and hexylene adipate polyester polyol because of high crystallinity. The higher the crystallinity of the aliphatic polyester-based polyol, the higher the hardness of the resultant polyester-based urethane rubber (cleaning blade formed of the polyester-based urethane rubber), resulting in a higher durability of the cleaning blade.

The high-molecular-weight polyol preferably has a number-average molecular weight of 1500 or more and 4000 or less, more preferably 2000 or more and 3500 or less. The higher the number-average molecular weight of the polyol, the higher the hardness, the elastic modulus, and the tensile strength of the resultant urethane rubber (cleaning blade formed of the urethane rubber). The lower the number-average molecular weight, the lower the viscosity, which facilitates handling.

Examples of the chain extender (multifunctional low-molecular-weight polyol) include glycols. Examples of the glycols include ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. Examples of the chain extender other than glycols include polyhydric alcohols that are tri- or higher hydric alcohols. Examples of the polyhydric alcohols that are tri- or higher hydric alcohols include trimethylolpropane, glycerin, pentaerythritol, and sorbitol. These alcohols may be used in combination.

The types of the urethane-rubber synthesis catalyst are broadly divided into a urethane-forming catalyst (reaction acceleration catalyst) that accelerates rubber formation (resin formation) and foaming, and an isocyanurate-forming catalyst (isocyanate-trimer-forming catalyst). In an embodiment according to the present invention, these catalysts may be used in combination.

Examples of the urethane-forming catalyst include tin-based urethane-forming catalysts such as dibutyltin dilaurate and stannous octoate; and amine-based urethane-forming catalysts such as triethylenediamine, tetramethylguanidine, pentamethyldiethylenetriamine, dimethylimidazole, tetramethylpropanediamine, and N,N,N'-trimethylaminoethylethanolamine. In an embodiment according to the present invention, these catalysts may be used in combination. Among these urethane-forming catalysts, triethylenediamine is preferred because it particularly accelerates the urethane reaction.

Examples of the isocyanurate-forming catalyst include metal oxides such as $Li_2O$ and $(Bu_3Sn)_2O$; hydride compounds such as $NaBH_4$; alkoxide compounds such as $NaOCH_3$, KO-(t-Bu), and borates; amine compounds such as $N(C_2H_5)_3$, $N(CH_3)_2CH_2C_2H_5$, and $N_2C_6H_{12}$; alkaline carboxylate salt compounds such as $HCO_2Na$, $CO_3(Na)_2$, $PhCO_2Na$/DMF, $CH_3CO_2K$, $(CH_3CO_2)_2Ca$, alkaline soap, and naphthenate; alkaline formate compounds; and quaternary ammonium salt compounds such as $((R^1)_3—NR^2OH)—OOCR^3$. Examples of the combination of catalysts (co-catalyst) serving as an isocyanurate-forming catalyst include amine/epoxide, amine/carboxylic acid, and amine/alkylene imide. In an embodiment according to the present invention, these catalysts may be used in combination.

Among the urethane-rubber synthesis catalysts, preferred is N,N,N'-trimethylaminoethylethanolamine, which itself functions as a urethane-forming catalyst and also functions as an isocyanurate-forming catalyst.

If necessary, additionally, additives such as a pigment, a plasticizer, a waterproofing agent, an antioxidant, an ultraviolet absorbing agent, and a light stabilizer may be used.

The inventors of the present invention have found that synthesis of a urethane rubber by the following method allows the isocyanurate-group distribution to be controlled as described above: an aliphatic polyester-based polyol is used as a polyol; an isocyanurate-forming catalyst is applied to the inner surface of a mold; and a raw material containing a polyisocyanate and the aliphatic polyester-based polyol so as to satisfy a specific ratio is introduced into the mold and a urethane rubber is synthesized.

By applying the isocyanurate-forming catalyst to the inner surface of a mold into which the raw material is to be introduced, an isocyanurate-forming reaction is particularly accelerated in a portion of the raw material, the portion being in contact with the inner surface of the mold. For this reason, an excess of the polyisocyanate may be used relative to the aliphatic polyester-based polyol. The excess of the polyisocyanate is influenced by the isocyanurate-forming catalyst applied to the inner surface of the mold and the temperature of the mold, so that a urethane rubber is synthesized in which the isocyanurate-group distribution is controlled as described above.

The amount (the number of moles) of the aliphatic polyester-based polyol used relative to the number of moles of the polyisocyanate may be 30 mol % or more and 40 mol % or less. The smaller the amount of the aliphatic polyester-based polyol, the more effective the use of an excess of the polyisocyanate. As a result, the Young's modulus $Y_0$ of the surface of the contact portion of the cleaning blade can be easily controlled to be 10 mgf/μm$^2$ or more. On the other hand, by relatively suppressing the degree of excess of the polyisocyanate, the Young's modulus $Y_0$ of the surface of the contact portion of the cleaning blade is easily controlled to be 400 mgf/μm$^2$ or less.

The temperature of the mold is preferably set to be in a temperature range of 80° C. or more and 150° C. or less, more preferably in a range of 100° C. or more and 130° C. or less. In order to cause the raw material to react within the mold to synthesize a urethane rubber, from the standpoint of the reaction rate, the temperature of the mold may be set to a relatively high temperature. However, the higher the temperature of the mold, the smaller the difference in Young's modulus between the surface and the inside of the resultant contact portion.

In addition to the above-described method, examples of the method of producing the cleaning blade include a method (centrifugation method) of introducing the solution into a drum-shaped mold and applying a centrifugal force to the solution to form the cleaning blade; and a method (cast-press method) of casting the solution into a belt- or groove-shaped mold to form the cleaning blade.

In order to achieve reduction in friction, a cleaning blade according to an embodiment of the present invention may be formed so as to have irregularities such that the surface (hereafter also referred to as "surface C") of the contact portion of the cleaning blade has an average inclination angle θa of 1° or more. In such a case where the surface C of the cleaning blade has an average inclination angle θa of 1° or more, the true contact area between the cleaning blade and a cleaning target member is decreased, to thereby allow further reduction in the friction.

In the case where irregularities are formed in the surface C of the cleaning blade such that the average inclination angle θa is 1° or more, slipping through of toner, which is the target to be cleaned off, needs to be suppressed. For this reason, the surface C of the cleaning blade may have a ten point height of roughness profile Rz of 10 μm or less.

As a method of forming the cleaning blade such that the surface C has an average inclination angle θa of 1° or more, irregularities may be formed in a surface of the mold corresponding to the surface C such that the resultant surface C has an average inclination angle θa of 1° or more, so that the shape of the irregularities is transferred to the surface C. Examples of a method of forming irregularities in the surface of the mold include an etching method, blasting, a shot peening method, laser processing, electrodischarge machining, microimprinting, and nanoimprinting.

A cleaning blade according to an embodiment of the present invention may be used in, as a mode of contact with a cleaning target member, a "counter mode" in which the cleaning blade is disposed in a "counter direction" with respect to a direction in which a cleaning target member is rotated during image formation (the moving direction of the surface of the cleaning target member). Alternatively, the cleaning blade may be used in a "with mode" in which the cleaning blade is disposed in a "with direction" with respect to a direction in which a cleaning target member is rotated during image formation (the moving direction of the surface of the cleaning target member). By employing the "with mode", the wedge shape and contact pressure formed between the surface of the cleaning target member and the edge portion of the cleaning blade are easily maintained in good conditions. When the wedge shape and contact pressure are in good conditions, the cleaning blade has a high conformability to irregularities and foreign matter to thereby allow a high cleaning performance, and the rotational torque of the cleaning target member can be reduced.

Hereinafter, the "counter mode" and the "with mode" will be described.

Counter-Mode Cleaning

Figure 12A:
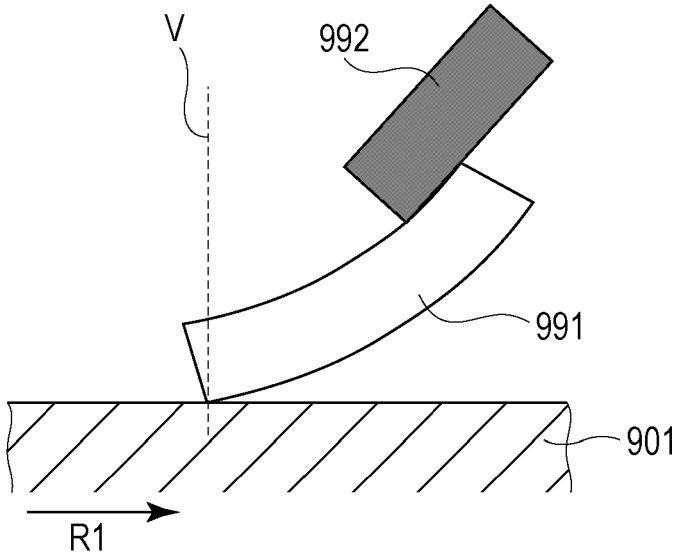
FIGS. 12A and 12B illustrate states in which cleaning blades are in contact with cleaning target members in a "counter mode" and a "with mode".
Figure 12B:
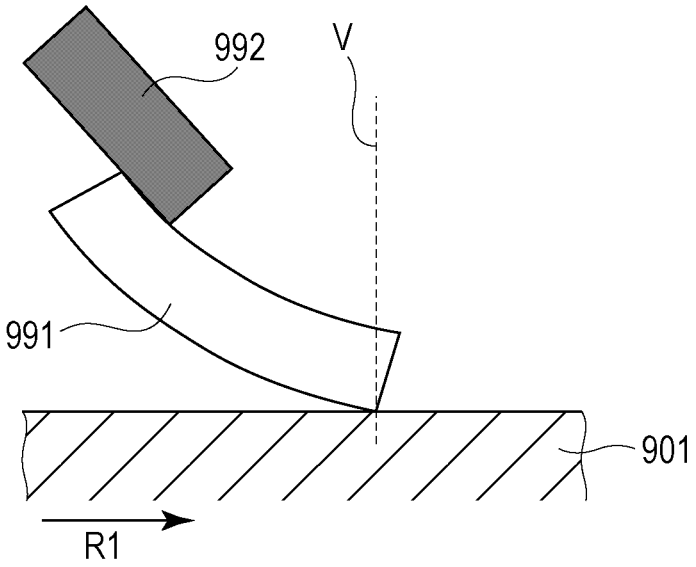

FIGS. 12A and 12B illustrate states in which cleaning blades are in contact with cleaning target members in the "counter mode" and the "with mode".

In the "counter mode", as illustrated in FIG. 12A, a support member 992 for the cleaning blade is positioned at a downstream position, with respect to the contact portion, in the moving direction of the surface of the cleaning target member (hereafter also simply referred to as "downstream"). In FIG. 12A, R1 represents the moving direction of the surface of the cleaning target member; and the dashed line V represents a line orthogonal to the surface of the cleaning target member in the contact portion. The support member 992 is positioned downstream of the dashed line V.

In the "counter mode", generation of a frictional force between the cleaning blade and the cleaning target member causes a force to be applied to compress the whole cleaning blade. Accordingly, a high pressure is applied to the tip of the cleaning blade and, with an increase in this pressure, the frictional force further increases. In this way, with an increase in the frictional force between the cleaning blade and the cleaning target member, the contact force increases accordingly; and this increase in the contact force tends to cause a further increase in the frictional force. This tends to cause a phenomenon in which the contact force and the frictional force abnormally increase. Occurrence of this phenomenon tends to cause the cleaning blade to repeat the following motion: the tip of the cleaning blade is strongly pulled in the downstream direction and the cleaning blade resists this pulling and returns to the original position. These repeated motions may cause an unusual sound (chatter). In particular, the unusual sound (chatter) tends to occur at the time of starting and stopping of driving of the cleaning target member. When the cleaning blade that is making the unusual sound is left for a while, the tip of the cleaning blade may become curled in the downstream direction.

Figure 13A:
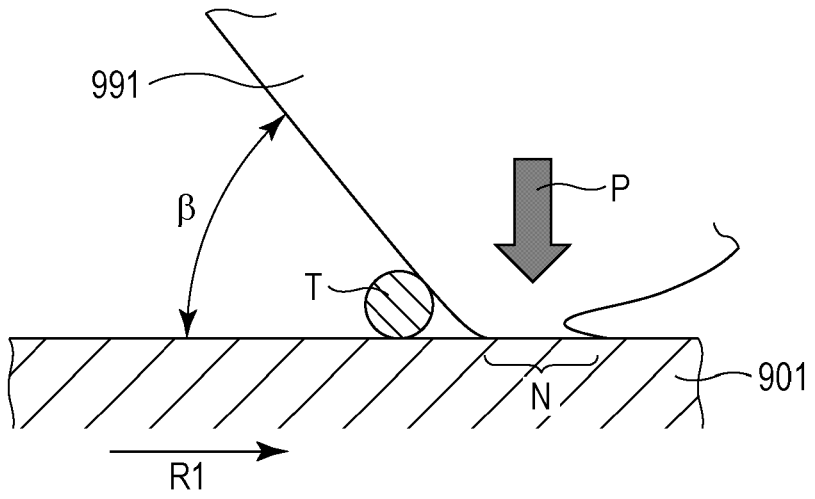
FIGS. 13A and 13B illustrate states of regions near contact portions in a "counter mode" and a "with mode".
Figure 13B:
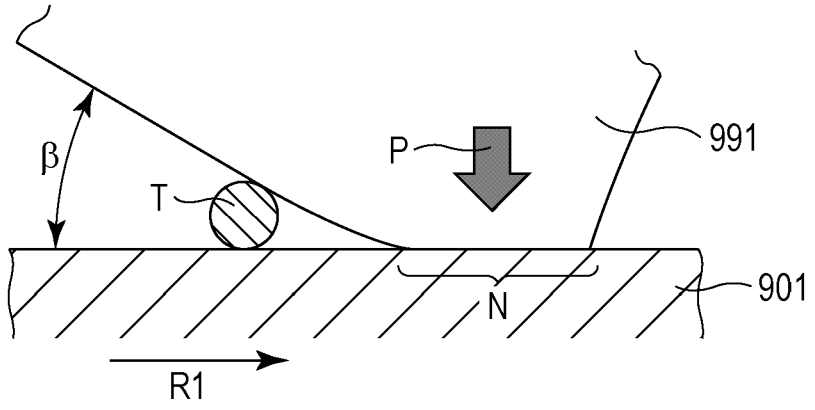

FIGS. 13A and 13B illustrate the states of regions near the contact portion in the "counter mode" and the "with mode".

FIG. 13A illustrates the state of the region near the contact portion in the "counter mode". In FIG. 13A, the angle formed upstream of the tip of a cleaning blade 991 and between the cleaning blade 991 and a cleaning target member 901 is represented by a symbol β. More accurately, within the contact portion between the cleaning blade 991 and the cleaning target member 901, a contact surface A is defined as a surface in contact with the surface of the cleaning target member 901 in the center in the rotational direction of the cleaning target member 901 (moving direction of the surface of the cleaning target member 901). In this case, the angle β is an angle formed between the contact surface A and the surface of a portion of the cleaning blade 991, the portion facing the surface of the cleaning target member 901 at an upstream position with respect to the contact portion in the rotational direction (the moving direction) of the cleaning target member 901. Here, the term "upstream" means being upstream with respect to the contact portion in the moving direction of the surface of the cleaning target member. The same applies to the following description. In FIGS. 13A and 13B, the contact portion between the cleaning blade 991 and the cleaning target member 901 is represented by a symbol N; and a toner is represented by a symbol T. The capability of blocking the toner T depends on the angle β and a pressure P applied to the contact portion N. The higher the pressure P, even in the case of a small angle β, the more easily the toner T is blocked. In the "counter mode", the frictional force generated between the tip of the cleaning blade and the cleaning target member causes the tip of the cleaning blade to be pulled in the downstream direction, so that the pressure P increases and hence the toner T can be effectively blocked. In order to clean a toner having a small particle size and a high sphericity, a high contact pressure is necessary. Accordingly, cleaning in the "counter mode" is also suitably preformed. A high contact pressure also allows the tip of the cleaning blade to easily conform to irregularities in the surface of the cleaning target member, without forming gaps.

However, in the "counter mode" performed with a high contact pressure, the rotational torque of the cleaning target member tends to increase.

With-Mode Cleaning

In the "with mode", as illustrated in FIG. 12B, a support member 992 for the cleaning blade is disposed upstream. In FIG. 12B, R1 represents the moving direction of the surface of the cleaning target member; and the dashed line V represents a line orthogonal to the surface of the cleaning target member in the contact portion. The support member 992 is disposed upstream of the dashed line V.

In the "with mode", generation of a frictional force between the cleaning blade and the cleaning target member causes a force to be applied to stretch the whole cleaning blade. Thus, the pressure applied to the tip of the cleaning blade tends to be relieved, so that, compared with the "counter mode", the abnormal increase in the contact pressure and the frictional force tends not to occur. Accordingly, the unusual sound (chatter) tends not to occur and the mode is advantageous in achieving torque reduction.

FIG. 13B illustrates the state of a region near the contact portion in the "with mode". In FIG. 13B, the angle formed upstream of the tip of the cleaning blade 991 and between the cleaning blade 991 and the cleaning target member 901 is represented by a symbol β. The contact portion between the cleaning blade 991 and the cleaning target member 901 is represented by a symbol N, and a toner is represented by a symbol T. In the "with mode", a frictional force generated between the cleaning blade 991 and the cleaning target member 901 tends to cause the tip of the cleaning blade to be pulled in the R1 direction (downstream direction). When the tip of the cleaning blade is thus pulled in the R1 direction, the angle β decreases, which facilitates entry of the toner T into the contact portion N. The width of the contact portion N tends to increase as the tip of the cleaning blade is pulled. The longer the width of the contact portion N, the lower the pressure P. Thus, the toner T having entered the contact portion N tends to slip through in the downstream direction. Even when the cleaning blade 991 is more strongly pressed to the cleaning target member 901 (with a higher contact pressure), the tip of the cleaning blade is pulled in the downstream direction more strongly. Thus, the angle β further decreases and the width of the contact portion N further increases. Accordingly, it is difficult to effectively increase the contact pressure. In some cases, depending on conditions such as the type of the cleaning blade, a very large width of the contact portion N tends to result in strong adhesion of the cleaning blade to the surface of the cleaning target member. Thus, the rotational torque of the cleaning target member may considerably increase so that it is similar to that in the "counter mode".

Figure 16A:
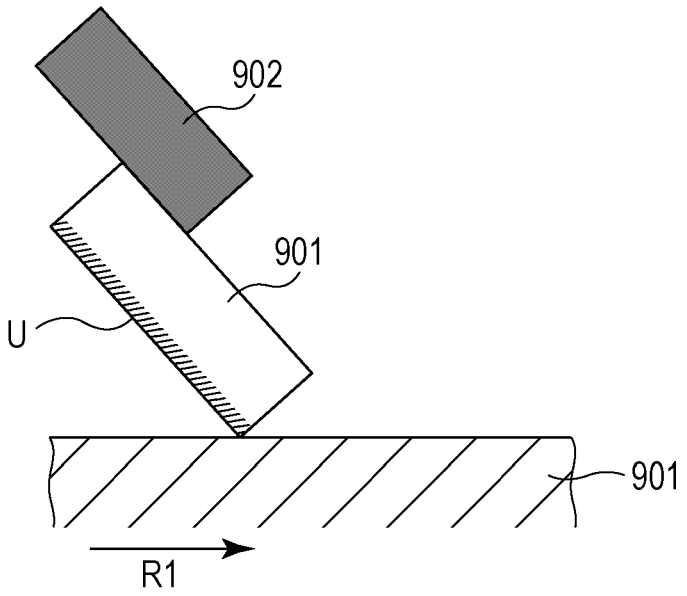
FIGS. 16A and 16B illustrate states in which the tip of a cleaning blade is in contact with a cleaning target member.
Figure 16B:
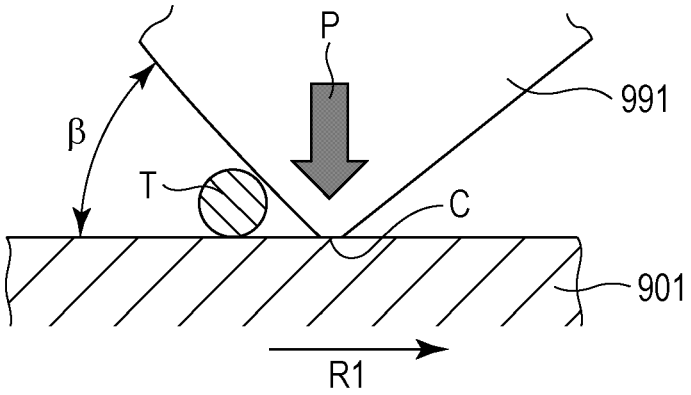

FIGS. 16A and 16B illustrate the states in which the tip of the cleaning blade is in contact with the cleaning target member.

In a case where a cleaning blade is used in the "with mode", as illustrated in FIG. 16A, a surface U (facing the cleaning target member upstream of the contact portion (hereafter also simply referred to as "surface U")) of the cleaning blade may be formed so as to have a Young's modulus $Y_{U0}$ of 10 mgf/μm$^2$ or more. By setting the Young's modulus $Y_{U0}$ to be 10 mgf/μm$^2$ or more, the surface U of the cleaning blade strongly resists the force that pulls the tip of the cleaning blade in the R1 direction (downstream direction). Thus, the attitude of the cleaning blade tends to be appropriately maintained. As a result, the angle β is maintained to be an appropriate value. In addition, deformation of the tip of the cleaning blade is reduced and the width of the contact portion N is reduced, so that the contact pressure P is easily set to be high. Thus, even a toner having a small particle size and a high sphericity can be sufficiently cleaned off. By setting the contact pressure P to be high, a good conformability to irregularities in the cleaning target member is provided. A small width of the contact portion N results in a low adhesion between the cleaning blade and the cleaning target member, which facilitates reduction in the rotational torque of the cleaning target member. As the Young's modulus $Y_{U0}$ is increased, the angle β and the contact pressure P can be easily increased and the width of the contact portion N can be easily decreased, so that the cleaning performance can be further enhanced. For this reason, in the case of using the cleaning blade in the "with mode", the Young's modulus $Y_{U0}$ may be 40 mgf/μm$^2$ or more. In the surface U, a portion having a Young's modulus $Y_{U0}$ of 10 mgf/μm$^2$ or more is not necessary the entirety of the surface U. However, in order to strongly resist the force that pulls the tip of the cleaning blade in the R1 direction (downstream direction) and to strongly maintain the attitude of the whole cleaning blade, the portion having a Young's modulus $Y_{U0}$ of 10 mgf/μm$^2$ or more may be the entirety of the surface U. In addition, in order to suppress deformation of the tip of the cleaning blade, a region near the contact portion may have a high Young's modulus $Y_{U0}$. In order to clean a toner having a small particle size and a high sphericity, the larger the angle β, the more suitable it is. However, as long as the "with mode" is employed, the upper limit of the angle β is less than 90°.

As described above, a cleaning blade according to an embodiment of the present invention is produced such that the surface C has a relatively high Young's modulus (10 mgf/μm$^2$ or more and 400 mgf/μm$^2$ or less) and the Young's modulus decreases from the surface to the inside of the contact portion. Specifically, the cleaning blade is produced such that a ratio $Y_{50}/Y_0$ of the Young's modulus $Y_{50}$ at a position 50 μm inside from the surface of the contact portion of the cleaning blade to the Young's modulus $Y_0$ is more than 0 and 0.5 or less (preferably 0.2 or less). By increasing the Young's modulus $Y_0$, the tip of the cleaning blade tends not to be pulled in the downstream direction and the angle β is easily maintained to be large. By decreasing the ratio $Y_{50}/Y_0$ to the range of more than 0 and 0.5 or less, even in the case where the surface C has a relatively high Young's modulus, a good conformability to irregularities and foreign matter can be provided.

However, in a case where the Young's modulus $Y_0$ and the Young's modulus $Y_{U0}$ are excessively high, the surface of the cleaning blade tends not to deform. As a result, the conformability to irregularities in the surface of the cleaning target member tends to be degraded or a very high pressure tends to be locally applied to the surface of the cleaning target member, so that the surface of the cleaning target member is damaged. For this reason, the Young's modulus $Y_0$ and the Young's modulus $Y_{U0}$ may be 400 mgf/μm$^2$ or less.

Method of Measuring Young's Modulus

In an embodiment according to the present invention, the Young's modulus of a cleaning blade was measured with a nano-indentation tester ENT-1100 (product name) manufactured by ELIONIX INC. Specifically, a loading-unloading test is carried out under the following conditions at appropriate points from the surface to the inside of the contact portion of the cleaning blade; and the tester provides the Young's modulus as the calculation result.

Test Mode: loading-unloading test

Loading Range: A

Test Load: 100 [mgf]

Number of Divisions: 1000 [times]

Step Interval: 10 [ms]

Load Holding Time: 2 [s]

FIG. 7B is a schematic view illustrating portions of the cleaning blade where the Young's modulus is measured. In an embodiment according to the present invention, the cleaning blade was divided into four equal parts in the longitudinal direction. The above-described measurement and calculation were carried out, regarding each of three cross sections 805 (except for both end surfaces), at appropriately selected positions in a contact portion 806 (the gray region illustrated in the lower part of FIG. 7B), in a direction from the surface to the inside of the contact portion (direction indicated by arrow illustrated in the lower part of FIG. 7B). Specifically, the above-described measurement and calculation were carried out, in the direction from the surface to the inside of the contact portion, in steps of 2 μm within a region from the surface to 60 μm, in steps of 10 μm within a region from 60 μm to 100 μm, and in steps of 20 μm within a region from 100 μm to 300 μm. Regarding each of the measurement points, measurement values in the three cross sections were averaged and the resultant value was defined as the Young's modulus at the position. Incidentally, the value of the Young's modulus is theoretically more than 0.

Method of Measuring IR Spectrum by μATR Method

In an embodiment according to the present invention, an IR spectrum was measured by a μAIR method with a Fourier transform infrared spectrometer (product name: Perkin Elmer Spectrum One/Spotlight300) (universal ATR using a diamond crystal) manufactured by PerkinElmer, Inc.

In an embodiment according to the present invention, a urethane-rubber cleaning blade (urethane rubber) can have a hardness of 65° or more and 90° or less. The higher the hardness of the urethane-rubber cleaning blade (urethane rubber), the more sufficiently high the contact pressure applied by the cleaning blade to a cleaning target member. On the other hand, the lower the hardness of the urethane-rubber cleaning blade (urethane rubber), the less the cleaning blade damages the cleaning target member. In an embodiment according to the present invention, the hardness (IRHD) of a urethane-rubber cleaning blade (urethane rubber) is a value measured by an IRHD test M method with a WALLACE micro hardness tester manufactured by H. W. WALLACE. The IRHD test M method is defined in JIS K6253-1997.

In an embodiment according to the present invention, a urethane-rubber cleaning blade (urethane rubber) can have a tensile stress at 100% elongation (100% modulus) in a range of 2.5 MPa or more and 6.0 MPa or less. The higher the tensile stress at 100% elongation of a urethane-rubber cleaning blade (urethane rubber), the more sufficiently high the contact pressure applied by the cleaning blade to a cleaning target member. On the other hand, the lower the tensile stress at 100% elongation (100% modulus) of a urethane-rubber cleaning blade (urethane rubber), the higher the conformability to the surface of a cleaning target member. Incidentally, in an embodiment according to the present invention, the tensile stress at 100% elongation (100% modulus) of a urethane-rubber cleaning blade (urethane rubber) was measured in the following manner: the cleaning blade was blanked to prepare a JIS No. 3 dumbbell specimen; and this JIS No. 3 dumbbell specimen was measured in terms of tensile stress at 100% elongation (100% modulus) at an elongation rate of 500 mm/min.

In an embodiment according to the present invention, regarding the urethane rubber forming a cleaning blade, the peak temperature of tanδ (a value measured at a frequency of 10 Hz in a temperature range of −50° C. or more and +130° C. or less. The same applies to the following description) can be as low as possible, specifically, 5° C. or less. The value of tanδ of the urethane rubber forming the cleaning blade can form a gentle curve from a low temperature to a high temperature. Specifically, the value of tanδ at 5° C. can be 0.7 or less and the value of tanδ at 40° C. can be 0.04 or more. The lower the peak temperature of tanδ of the urethane rubber forming the cleaning blade, the more suppressed a decrease in the elasticity of the cleaning blade in a low-temperature environment. The gentler the curve of the value of tanδ from a low temperature to a high temperature, the more suppressed a decrease in the elasticity of the cleaning blade in a low-temperature environment. Thus, a decrease in the elasticity of the cleaning blade in a low-temperature environment is suppressed, so that degradation of the cleaning performance in the low-temperature environment can be suppressed. The lower the peak temperature of tanδ of the urethane rubber forming the cleaning blade, the less decreased the viscosity. The gentler the curve of the value of tanδ from a low temperature to a high temperature, the less decreased the viscosity. Thus, the viscosity is less decreased, so that the stick-slip motion and curling of the cleaning blade in a high-temperature environment can be suppressed. Incidentally, in an embodiment according to the present invention, the tan δ of a urethane rubber is a value measured with a dynamic viscoelastometer (product name: Exstar 6100DMS) manufactured by Seiko Instruments Inc.

In an embodiment according to the present invention, the larger the compressive permanent set of the urethane rubber forming a cleaning blade, the more decreased the contact force of the edge portion of the cleaning blade applied to the surface of a cleaning target member. In addition, the larger the compressive permanent set, the less uniformly the edge portion of the cleaning blade is in contact with the surface of a cleaning target member. For this reason, the urethane rubber can have a small compressive permanent set. Also, from the standpoint of the wear resistance of the urethane rubber, the urethane rubber can have a small compressive permanent set. Specifically, the urethane rubber forming a cleaning blade can have a compressive permanent set of 5% or less. Incidentally, in an embodiment according to the present invention, the compressive permanent set of a urethane rubber is a value measured on the basis of JIS K6262-1997.

Method of Measuring Number-Average Molecular Weight

The number-average molecular weight of a sample was determined by gel permeation chromatography (GPC) in the following manner: monodisperse polystyrenes for GPC were used; a calibration curve was formed on the basis of the peak counts and number-average molecular weights of monodisperse polystyrenes; and the number-average molecular weight of the sample was determined with the calibration curve in a standard manner. Specifically, in an embodiment according to the present invention, the number-average molecular weight is a value determined by dissolving a measurement sample in tetrahydrofuran (solvent) and measuring the dissolved component with an apparatus under conditions described below.

GPC apparatus: HLC-8120GPC (product name) manufactured by Tosoh Corporation

Figure 11:
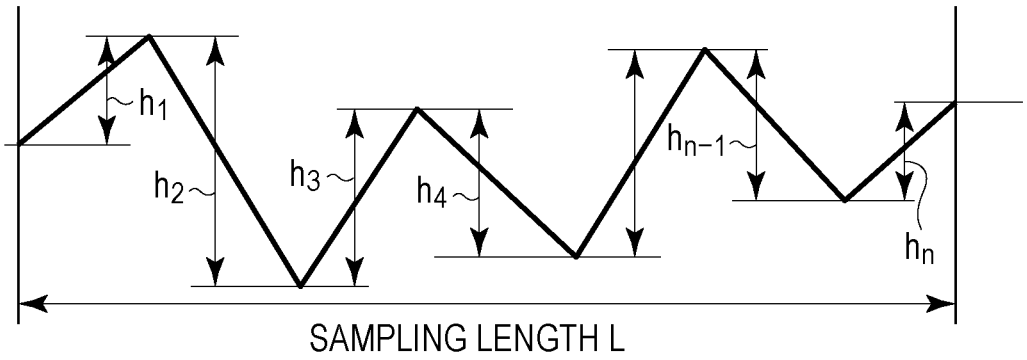

Columns: TSK-GEL (product name), G-5000HXL (product name), G-4000HXL (product name), G-3000HXL (product name), and G-2000HXL (product name) manufactured by Tosoh Corporation Detector: differential refractometer Solvent: tetrahydrofuran Concentration of solvent: 0.5% by mass Flow rate: 1.0 ml/min Method of Measuring Ten Point Height of Roughness Profile Rz and Average Inclination Angle θa The ten point height of roughness profile Rz and the average inclination angle θa of a sample were measured with a SURFCORDER (product name: SE-3500) manufactured by Kosaka Laboratory Ltd. The ten point height of roughness profile Rz is a value measured on the basis of JIS B0601-94. The method for calculating the average inclination angle θa is illustrated in FIG. 11. The measurement conditions are described below.

Cutoff value: 0.8 mm

Measurement length: 2.5 mm

Feed rate: 0.1 mm/s

Method of Measuring Coefficient of Kinetic Friction

The coefficient of kinetic friction of a sample was measured with a Surface Property Tester (product name: HEIDON TYPE: 14FW) manufactured by Shinto Scientific Co., Ltd. The measurement indenter used was a SiC ball (nominal size: ⅜ inches) manufactured by Sato Tekkou Co., Ltd. The measurement portion was a surface of a cleaning blade, the surface facing a cleaning target member and including the contact portion 806 in FIG. 7B. The measurement conditions are as follows.

Load: 100 mgf

Measurement length: 1 mm

Measurement speed: 1 mm/min

Data acquisition frequency: 1000 Hz

The measurement under the measurement conditions provided 60000 pieces of data. Of the whole data, 10000 pieces of data obtained during the last stage of the measurement were averaged and the resultant average value was defined as the coefficient of kinetic friction.

A cleaning blade according to an embodiment of the present invention can be used, in a usage mode of the "counter mode" or the "with mode", for a process cartridge.

A process cartridge according to an embodiment of the present invention supports, as an integrated unit, a cleaning blade according to an embodiment of the present invention, and an electrophotographic photosensitive member that is a cleaning target member whose surface is cleaned with the cleaning blade, wherein the process cartridge is detachably mountable on the body of an electrophotographic apparatus.

A cleaning blade according to an embodiment of the present invention can be used, in a usage mode of the "counter mode" or the "with mode", for an electrophotographic apparatus.

An electrophotographic apparatus according to an embodiment of the present invention includes a cleaning blade according to an embodiment of the present invention, and an electrophotographic photosensitive member and/or an intermediate transfer member that are cleaning target members whose surfaces are cleaned with the cleaning blade.

EXAMPLES

Hereinafter, the present invention will be described with reference to examples. In the EXAMPLES, the term "parts" means "parts by mass".

Example A1

Step of Preparing First Composition

A reaction was caused between 299 parts of 4,4'-diphenylmethane diisocyanate (hereafter also referred to as "4,4'-MDI") and 767.5 parts of butylene adipate polyester polyol having a number-average molecular weight of 2600 (hereafter also referred to as "BA2600") at 80° C. for 3 hours to provide a first composition (prepolymer) containing 7.2 mass % of a NCO group.

Step of Preparing Second Composition

To 300 parts of hexylene adipate polyester polyol having a number-average molecular weight of 2000 (hereafter also referred to as "HA2000"), 0.25 parts of N,N,N'-trimethylaminoethylethanolamine (hereafter also referred to as "ETA") as a urethane-rubber synthesis catalyst was added. The resultant mixture was stirred at 60° C. for 1 hour to provide a second composition.

Step of Preparing Mixture

The first composition was heated to 80° C. To this first composition, the second composition heated to 60° C. was added and stirred to provide a mixture of the first composition and the second composition. The amount of polyol (number of moles) in this mixture relative to the number of moles of polyisocyanate in this mixture was 17 mol %. Hereafter, this ratio is also referred to as "M(OH/NCO)". In this example, M(OH/NCO)=17 mol %.

Step of Obtaining Urethane-Rubber Cleaning Blade

A catalyst solution prepared by mixing 100 parts of ethanol and 100 parts of ETA was sprayed onto a spot of an inner surface of a mold for producing a cleaning blade. After that, the catalyst solution was spread by being wiped with a urethane-rubber blade over a portion (a surface corresponding to the contact portion of the cleaning blade) of the inner surface of the mold.

After that, the mold was heated to 110° C. A release agent was subsequently applied to a surface of the inner surfaces of the mold, the surface not coated with the catalyst solution. The mold was heated again to 110° C. and held at the temperature.

After that, the mixture was injected into the mold (within the cavity). The injected mixture was heated at 110° C. (molding temperature) for 30 minutes to undergo a curing reaction, and subsequently released from the mold to provide a urethane-rubber plate. The obtained urethane-rubber plate was cut with a cutter to form an edge portion. Thus, a urethane-rubber cleaning blade was obtained. The obtained cleaning blade had a thickness of 2 mm, a length of 20 mm, and a width of 345 mm.

The production conditions and M(OH/NCO) are described in Tables 1 and 2.

The obtained cleaning blade was subjected to the above-described analytical measurement and property evaluation. The results are described in FIGS. 1A and 1B and Table 3.

Figure 1B:
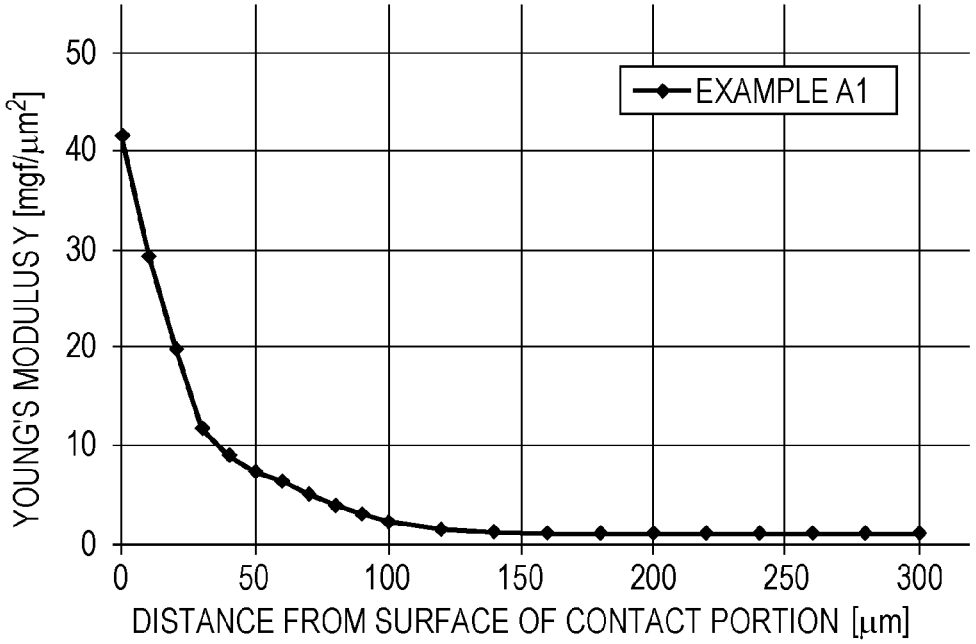

In FIG. 1A, a straight line connecting the Young's modulus $Y_0$ and the Young's modulus $Y_{50}$ is represented by a symbol $L_{0-50}$; a straight line connecting the Young's modulus $Y_0$ and the Young's modulus $Y_{20}$ is represented by a symbol $L_{0-20}$; and a straight line connecting the Young's modulus $Y_{20}$ and the Young's modulus $Y_{50}$ is represented by a symbol $L_{20-50}$.

Evaluation Method

As an evaluation machine, a copying machine (product name: iR-ADVC5255) manufactured by CANON KABUSHIKI KAISHA was used. Three drum-shaped photosensitive members (hereafter also referred to as "photosensitive drums") that had the same dimensions as a photosensitive drum for the copying machine were prepared: a photosensitive drum (hereafter also referred to as a "recessed photosensitive drum") that had recesses having a diameter of 40 μm and a depth of 2.5 μm and having an area ratio of 50% in the surface; a photosensitive drum (hereafter also referred to as a "circumferentially streaked photosensitive drum") that had streaks having an Sm of 30 μm and a total height of profile of 2 μm and extending in the circumferential direction in the surface; and a photosensitive drum (hereafter also referred to as a "smooth photosensitive drum") that had a smooth surface. These drums were mounted to the copying machine. The cleaning blade obtained above was disposed such that its contact surface (a surface facing the catalyst-solution-coated inner surface of the mold) was in contact with each of the photosensitive drums. The contact mode of the cleaning blade to the photosensitive drum that was a cleaning target member was a "counter mode". The cleaning blade was disposed under the following conditions: a set angle of 22°, a contact pressure of 28 gf/cm, and a free length of 8 mm. An endurance test was carried out for 10000 paper sheets in a high-temperature high-humidity environment at 30° C./80% RH, without development, and at a discharge current of 100 μA. And the cleaning blade was evaluated in terms of unusual sound (chatter), stick-slip motion, and curling.

Subsequently, in a low-temperature low-humidity environment at 15° C./10% RH, melamine resin particles (OPTBEADS, diameter: 3.5 μm) were applied to the surface of each photosensitive drum. Regarding the cleaning performance of the cleaning blade, occurrence of slipping through of the melamine resin particles (substitute for toner) was evaluated. The higher the conformability of the cleaning blade to irregularities in the surface of the photosensitive drum and the melamine resin particles on this surface, the less slipping through of the melamine resin particles occurs. The evaluation results are described in Table 4.

Incidentally, the evaluation systems are as follows.

Evaluation in terms of unusual sound, stick-slip motion, and curling

A: No occurrence of unusual sound, stick-slip motion, or curling of cleaning blade B: Occurrence of unusual sound sometimes at the time of stopping or starting of driving C: Occurrence of unusual sound at the time of stopping and starting of driving, or occurrence of unusual sound during driving D: Occurrence of unusual sound anytime or occurrence of curling Slipping Through A: No slipping through of melamine resin particles B: Occurrence of slipping through of some melamine resin particles, observed on the downstream surface (surface facing the photosensitive member) of the cleaning blade (by observation of the cleaning blade)

C: Partial occurrence of streak-shaped slipping through of melamine resin particles to a degree visually observed (by observation of the surface of the photosensitive drum)

D: Overall occurrence of slipping through of melamine resin particles to a degree visually observed (by observation of the surface of the photosensitive drum)

The cleaning blade of Example A1 was found to have a Young's modulus $Y_0$ of 41.8 mgf/μm$^2$, $Y_{50}/Y_0$ of 0.18, and $Y_{20}/Y_0$ of 0.48. The gradients of $L_{0-20}$ and $L_{20-50}$ indicate $\Delta Y_{0-20} \geq \Delta Y_{20-50}$. In addition, the Young's modulus $Y_N$ is positioned below $L_{0-50}$, that is, the profile of changes in the Young's modulus in the direction from the surface to the inside of the contact portion is convex downward. Incidentally, $I_{SI}/I_{SE}$ was found to be 0.50.

Example A2

A cleaning blade was produced and subjected to the analytical measurement and the property evaluation as in Example A1 except that 100 parts of ETA used to prepare the catalyst solution applied to the inner surface of the mold in Example A1 was changed to 100 parts of a compound represented by the following formula (D)

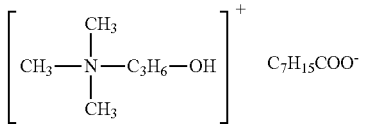

(D)

Figure 2A:
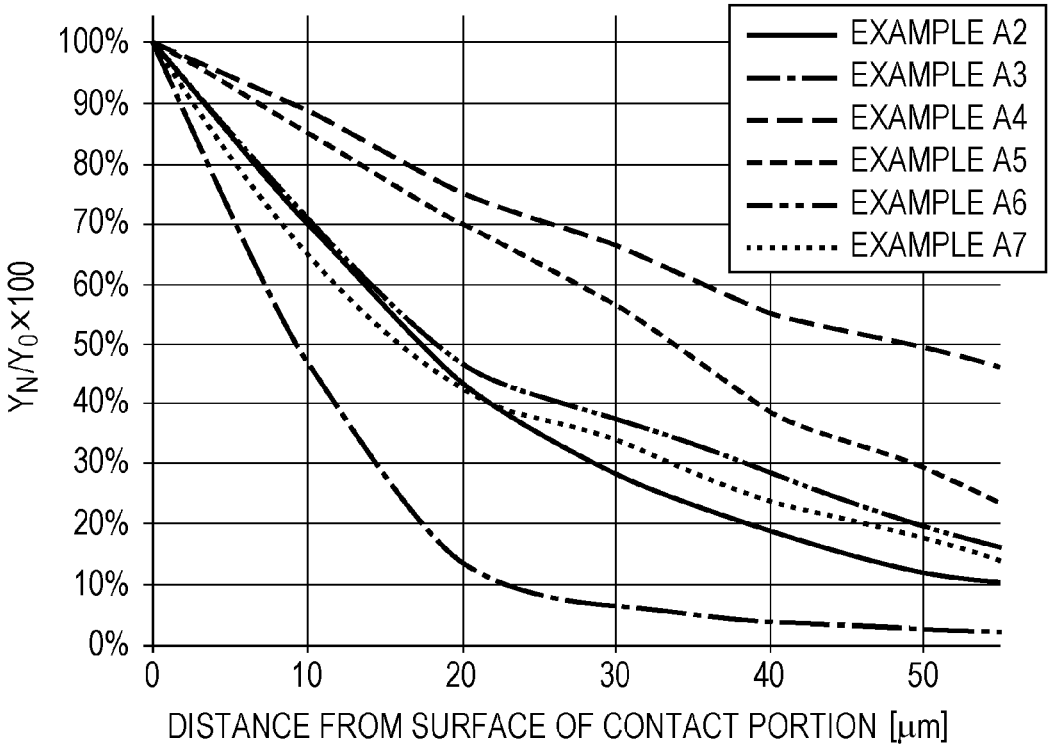
FIG. 2A is a graph illustrating the results of Examples A2 to A7.

(product name: DABCO-TMR, manufactured by Sankyo Air Products Co., Ltd.), and the molding temperature was changed from 110° C. to 80° C. The production conditions and M(OH/NCO) are described in Tables 1 and 2, and the results of the analytical measurement and the property evaluation are described in FIG. 2A and Tables 3 and 4.

Example A3

A cleaning blade was produced and subjected to the analytical measurement and the property evaluation as in Example A1 except that 100 parts of ETA used for preparation of the catalyst solution applied to the inner surface of the mold in Example A1 was changed to 100 parts of a specialty amine (product name: UCAT-18X, manufactured by San-Apro Ltd.), and the molding temperature was changed from 110° C. to 150° C. The production conditions and M(OH/NCO) are described in Tables 1 and 2, and the results of the analytical measurement and the property evaluation are described in FIG. 2A and Tables 3 and 4.

Example A4

A cleaning blade was produced and subjected to the analytical measurement and the property evaluation as in Example A1 except that the amount of HA2000 in the Step of preparing second composition was changed from 300 parts in Example A1 to 360 parts, and 100 parts of ETA used for preparation of the catalyst solution applied to the inner surface of the mold was changed to 100 parts of $CH_3COOK$ (product name: POLYCAT46, manufactured by Air Products and Chemicals, Inc.). The production conditions and M(OH/NCO) are described in Tables 1 and 2, and the results of the analytical measurement and the property evaluation are described in FIG. 2A and Tables 3 and 4.

Example A5

A cleaning blade was produced and subjected to the analytical measurement and the property evaluation as in Example A1 except that the amount of 4,4'-MDI in the Step of preparing first composition was changed from 299 parts in Example A1 to 350 parts; the amount of BA2600 was changed from 767.5 parts to 860 parts; the amount of HA2000 in the Step of preparing second composition was changed from 300 parts to 170 parts; 100 parts of ETA used for preparation of the catalyst solution applied to the inner surface of the mold was changed to 100 parts of a mixture of 1:1 (mass ratio) UCAT-18X (product name) and DABCO-TMR (product name); and the molding temperature was changed from 110° C. to 90° C. The production conditions and M(OH/NCO) are described in Tables 1 and 2, and the results of the analytical measurement and the property evaluation are described in FIG. 2A and Tables 3 and 4.

Example A6

A cleaning blade was produced and subjected to the analytical measurement and the property evaluation as in Example A1 except that the amount of HA2000 in the Step of preparing second composition was changed from 300 parts in Example A1 to 218.5 parts; 100 parts of ETA used for preparation of the catalyst solution applied to the inner surface of the mold was changed to 100 parts of UCAT-18X (product name); and the molding temperature was changed from 110° C. to 100° C. The production conditions and M(OH/NCO) are described in Tables 1 and 2, and the results of the analytical measurement and the property evaluation are described in FIG. 2A and Tables 3 and 4.

Example A7

A cleaning blade was produced and subjected to the analytical measurement and the property evaluation as in Example A1 except that the amount of HA2000 in the Step of preparing second composition was changed from 300 parts in Example A1 to 218.5 parts; and 100 parts of ETA used for preparation of the catalyst solution applied to the inner surface of the mold was changed to 100 parts of UCAT-18X (product name). The production conditions and M(OH/NCO) are described in Tables 1 and 2, and the results of the analytical measurement and the property evaluation are described in FIG. 2A and Tables 3 and 4.

Comparative Example A1

Figure 2B:
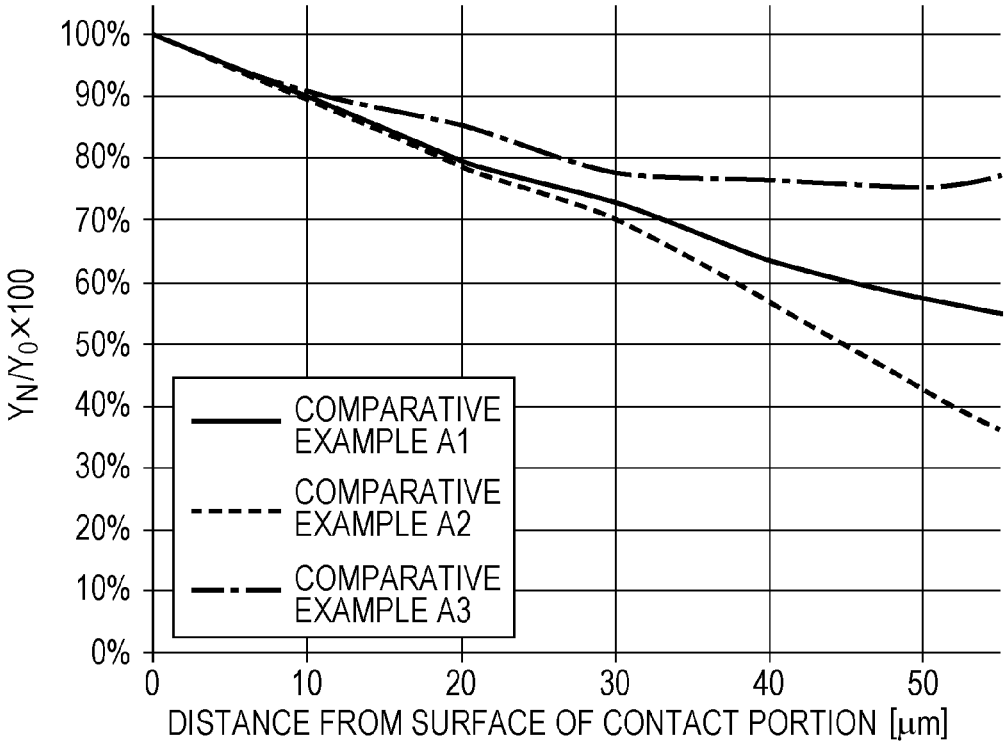
FIG. 2B is a graph illustrating the results of Comparative examples A1 to A3.

A cleaning blade was produced and subjected to the analytical measurement and the property evaluation as in Example A1 except that the amount of HA2000 in the Step of preparing second composition was changed from 300 parts in Example A1 to 500 parts; and the molding temperature was changed from 110° C. to 140° C. The production conditions and M(OH/NCO) are described in Tables 1 and 2, and the results of the analytical measurement and the property evaluation are described in FIG. 2B and Tables 3 and 4.

Comparative example A2

A cleaning blade was produced and subjected to the analytical measurement and the property evaluation as in Example A1 except that the amount of 4,4'-MDI in the Step of preparing first composition was changed from 299 parts in Example A1 to 350 parts; the amount of BA2600 was changed from 767.5 parts to 860 parts; the amount of HA2000 in the Step of preparing second composition was changed from 300 parts to 150 parts; and 100 parts of ETA used for preparation of the catalyst solution applied to the inner surface of the mold was changed to 100 parts of UCAT-18X (product name). The production conditions and M(OH/NCO) are described in Tables 1 and 2, and the results of the analytical measurement and the property evaluation are described in FIG. 2B and Tables 3 and 4.

Comparative example A3

A cleaning blade was produced as in Example A1 except that the catalyst solution was not applied to the inner surface of the mold. Subsequently, the produced cleaning blade was immersed into 4,4'-MDI heated to 80° C. for 30 minutes and withdrawn. After that, 4,4'-MDI adhering to the surface of the cleaning blade was wiped off with ethanol. After that, the cleaning blade was left in a high-humidity environment at 25° C./90% RH for 2 days, to hydrolyze 4,4'-MDI not being wiped off and having impregnated into the surface of the cleaning blade. Thus, the cleaning blade of Comparative example A3 was obtained. The production conditions and M(OH/NCO) are described in Tables 1 and 2, and the results of the analytical measurement and the property evaluation are described in FIG. 2B and Tables 3 and 4.

Comparative example A4

Figure 3A:
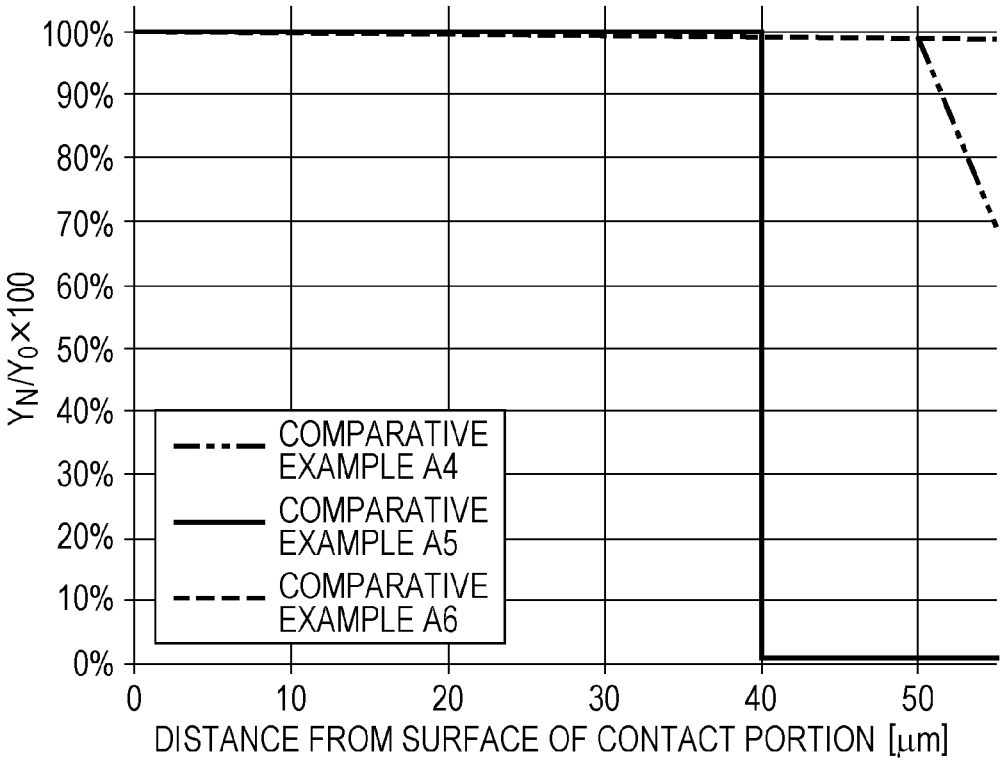
FIG. 3A is a graph illustrating the results of Comparative examples A4 to A6.

A catalyst solution was prepared by adding, to 100 parts of methyl isobutyl ketone (MIBK), 0.1 parts (corresponding to 1000 ppm) of DABCO-TMR (product name), and further adding thereto 200 parts of 4,4'-MDI. The prepared catalyst solution was sprayed onto the inner surface of the mold heated to 130° C., to form a polyisocyanate film containing isocyanurate and unreacted MDI and having a thickness of 50 μm on the inner surface of the mold. Subsequently, the mixture of the first composition and the second composition prepared as in Example A1 was injected into the mold (within the cavity). The injected mixture was heated at 130° C. (molding temperature) for 30 minutes to undergo a curing reaction, and subsequently released from the mold to provide a urethane-rubber plate. The obtained urethane-rubber plate was cut with a cutter to form an edge portion. Thus, a urethane-rubber cleaning blade was obtained. The obtained cleaning blade had a thickness of 2 mm, a length of 20 mm, and a width of 345 mm. The obtained cleaning blade was subjected to the analytical measurement and the property evaluation as in Example A1. The production conditions are described in Table 2, and the results of the analytical measurement and the property evaluation are described in FIG. 3A and Tables 3 and 4.

Comparative example A5

A cleaning blade was produced as in Example A1 except that the catalyst solution was not applied to the inner surface of the mold. Subsequently, a nylon coating having a thickness of 40 μm was formed on the (portion corresponding to) contact portion of the produced cleaning blade. Thus, the cleaning blade of Comparative example A5 was obtained. The results of the analytical measurement and the property evaluation are described in FIG. 3A and Tables 3 and 4.

Comparative example A6

A cleaning blade was produced and subjected to the analytical measurement and the property evaluation as in Example A1 except that the amount of BA2600 in the Step of preparing first composition was changed from 767.5 parts in Example A1 to 800 parts; the amount of HA2000 in the Step of preparing second composition was changed from 300 parts to 450 parts; the amount of ETA was changed from 0.25 parts to 0.28 parts; 100 parts of ETA used for preparation of the catalyst solution applied to the inner surface of the mold was changed to 100 parts of a mixture of 3:2 (mass ratio) POLYCAT46 (product name) and a quaternary ammonium salt (product name: TOYOCAT-TRV, manufactured by Tosoh Corporation); and the molding temperature was changed from 110° C. to 100° C. The production conditions and M(OH/NCO) are described in Tables 1 and 2 and the results of the analytical measurement and the property evaluation are described in FIG. 3A and Tables 3 and 4.

Comparative example A7

Figure 3B:
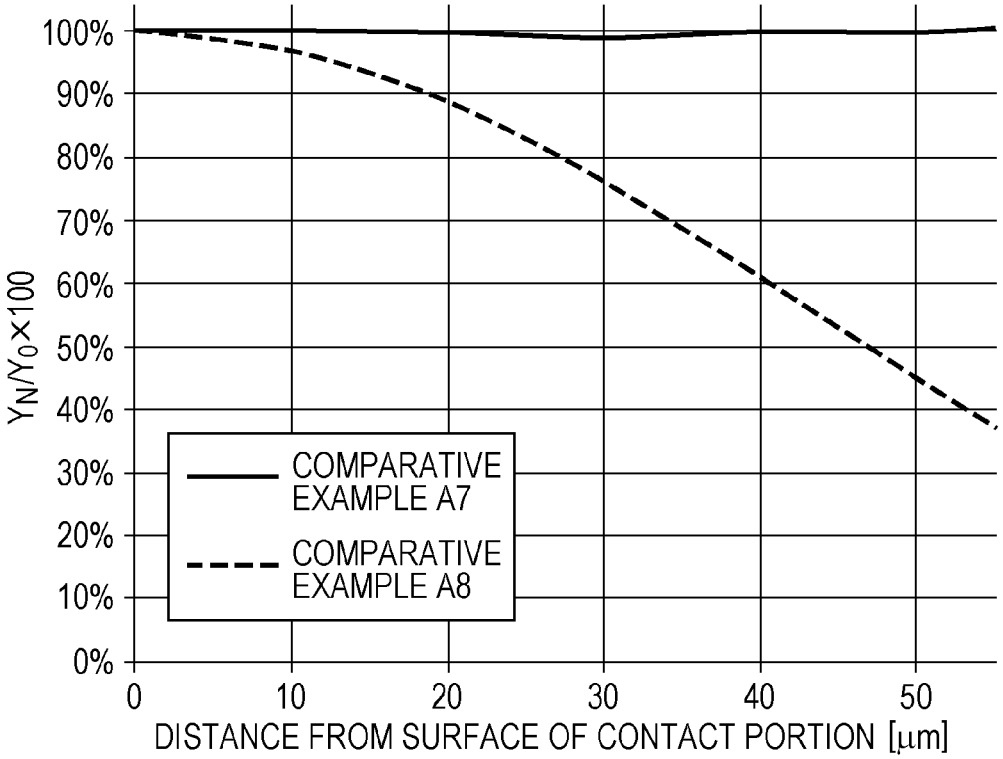
FIG. 3B is a graph illustrating the results of Comparative examples A7 and A8.

A cleaning blade was produced and subjected to the analytical measurement and the property evaluation as in Example A1 except that ETA used for preparation of the catalyst solution in Example A1 was changed to a mixture of 1:1 (mass ratio) UCAT-18X (product name) and DABCO-TMR (product name), and 0.25 parts of this mixture was mixed with the second composition without being applied to the inner surface of the mold; and the molding temperature was changed from 110° C. to 90° C. The production conditions and M(OH/NCO) are described in Tables 1 and 2, and the results of the analytical measurement and the property evaluation are described in FIG. 3B and Tables 3 and 4.

Comparative example A8

A cleaning blade was produced and subjected to the analytical measurement and the property evaluation as in Example A1 except that the amount of HA2000 in the Step of preparing second composition was changed from 300 parts in Example A1 to 380 parts; 100 parts of ETA used for preparation of the catalyst solution applied to the inner surface of the mold was changed to 100 parts of a mixture of 1:1 (mass ratio) POLYCAT46 (product name) and TOYOCAT-TRV (product name); and the molding temperature was changed from 110° C. to 100° C. The production conditions and M(OH/NCO) are described in Tables 1 and 2, and the results of the analytical measurement and the property evaluation are described in FIG. 3B and Table 3.

TABLE 1

| | (i) First composition | | | | (ii) Second composition | | | | M(OH/NCO) |
|---|---|---|---|---|---|---|---|---|---|
| Cleaning blade | Poly isocyanate | | Polyol | | Polyol | | Urethane-rubber synthesis catalyst | | [mol %] in mixture of (i) and (ii) |
| Example A1 | 4,4'-MDI | 299 parts | BA2600 | 767.5 parts | HA2000 | 300 parts | ETA | 0.25 parts | 17 |
| Example A2 | 4,4'-MDI | 299 parts | BA2600 | 767.5 parts | HA2000 | 300 parts | ETA | 0.25 parts | 17 |
| Example A3 | 4,4'-MDI | 299 parts | BA2600 | 767.5 parts | HA2000 | 300 parts | ETA | 0.25 parts | 17 |
| Example A4 | 4,4'-MDI | 299 parts | BA2600 | 767.5 parts | HA2000 | 360 parts | ETA | 0.25 parts | 20 |
| Example A5 | 4,4'-MDI | 350 parts | BA2600 | 860 parts | HA2000 | 170 parts | ETA | 0.25 parts | 8 |
| Example A6 | 4,4'-MDI | 299 parts | BA2600 | 767.5 parts | HA2000 | 218.5 parts | ETA | 0.25 parts | 12 |
| Example A7 | 4,4'-MDI | 299 parts | BA2600 | 767.5 parts | HA2000 | 218.5 parts | ETA | 0.25 parts | 12 |
| Comparative example A1 | 4,4'-MDI | 299 parts | BA2600 | 767.5 parts | HA2000 | 500 parts | ETA | 0.25 parts | 28 |
| Comparative example A2 | 4,4'-MDI | 350 parts | BA2600 | 860 parts | HA2000 | 150 parts | ETA | 0.25 parts | 7 |
| Comparative example A3 | 4,4'-MDI | 299 parts | BA2600 | 767.5 parts | HA2000 | 300 parts | ETA | 0.25 parts | 17 |
| Comparative example A4 | — | — | — | — | — | — | — | — | — |
| Comparative example A5 | 4,4'-MDI | 299 parts | BA2600 | 767.5 parts | HA2000 | 300 parts | ETA | 0.25 parts | 17 |
| Comparative example A6 | 4,4'-MDI | 299 parts | BA2600 | 800 parts | HA2000 | 450 parts | ETA | 0.28 parts | 25 |
| Comparative example A7 | 4,4'-MDI | 299 parts | BA2600 | 767.5 parts | HA2000 | 300 parts | ETA | 0.25 parts | 17 |
| Comparative example A8 | 4,4'-MDI | 299 parts | BA2600 | 767.5 parts | HA2000 | 380 parts | ETA | 0.25 parts | 21 |

TABLE 2

| Cleaning blade | Catalyst solution | | | Molding temperature [° C.] |
|---|---|---|---|---|
| Example A1 | Ethanol<br>ETA | 100 parts<br>100 parts | Applied to inner surface of mold | 110 |
| Example A2 | Ethanol<br>DABCO-TMR | 100 parts<br>100 parts | Applied to inner surface of mold | 80 |

TABLE 2-continued

| Cleaning blade | Catalyst solution | | | Molding temperature [° C.] |
|---|---|---|---|---|
| Example A3 | Ethanol | 100 parts | Applied to inner surface of mold | 150 |
| | UCAT-18X | 100 parts | | |
| Example A4 | Ethanol | 100 parts | Applied to inner surface of mold | 110 |
| | POLYCAT46 | 100 parts | | |
| Example A5 | Ethanol | 100 parts | Applied to inner surface of mold | 90 |
| | UCAT-18X | 50 parts | | |
| | DABCO-TMR | 50 parts | | |
| Example A6 | Ethanol | 100 parts | Applied to inner surface of mold | 100 |
| | UCAT-18X | 100 parts | | |
| Example A7 | Ethanol | 100 parts | Applied to inner surface of mold | 110 |
| | UCAT-18X | 100 parts | | |
| Comparative example A1 | Ethanol | 100 parts | Applied to inner surface of mold | 140 |
| | ETA | 100 parts | | |
| Comparative example A2 | Ethanol | 100 parts | Applied to inner surface of mold | 110 |
| | UCAT-18X | 100 parts | | |
| Comparative example A3 | — | — | — | 110 |
| Comparative example A4 | MIBK | 100 parts | Applied to inner surface of mold | 130 |
| | DABCO-TMR | 0.1 parts | | |
| | 4,4'-MDI | 200 parts | | |
| Comparative example A5 | — | — | — | 110 |
| Comparative example A6 | Ethanol | 100 parts | Applied to inner surface of mold | 100 |
| | POLYCAT46 | 60 parts | | |
| | TOYOCAT-TRV | 40 parts | | |
| Comparative example A7 | Ethanol | 100 parts | 0.25 parts added to second composition | 90 |
| | UCAT-18X | 50 parts | | |
| | DABCO-TMR | 50 parts | | |
| Comparative example A8 | Ethanol | 100 parts | Applied to inner surface of mold | 100 |
| | POLYCAT46 | 50 parts | | |
| | TOYOCAT-TRV | 50 parts | | |

TABLE 3

| | Young's modulus | | | | | | | | |
|---|---|---|---|---|---|---|---|---|---|
| | $Y_0$ [mgf/μm$^2$] | $Y_{20}$ [mgf/μm$^2$] | $Y_{50}$ [mgf/μm$^2$] | $Y_{50}/Y_0$ | $Y_{20}/Y_0$ | $\Delta Y_0$-$Y_{20}$ | $\Delta Y_{20\text{-}50}$ | $Y_N$ is below $L_{0\text{-}50}$ ? | $I_{SI}/I_{SE}$ |
| Example A1 | 42 | 20 | 8 | 0.2 | 0.5 | 0.03 | 0.01 | Below | 0.50 |
| Example A2 | 250 | 110 | 31 | 0.1 | 0.4 | 0.03 | 0.01 | Below | 1.20 |
| Example A3 | 158 | 22 | 5 | 0.0 | 0.1 | 0.04 | 0.00 | Below | 0.91 |
| Example A4 | 10 | 8 | 5 | 0.5 | 0.8 | 0.01 | 0.01 | Above | 0.61 |
| Example A5 | 161 | 113 | 48 | 0.3 | 0.7 | 0.01 | 0.01 | Above | 0.85 |
| Example A6 | 400 | 189 | 78 | 0.2 | 0.5 | 0.03 | 0.01 | Below | 1.55 |
| Example A7 | 344 | 148 | 61 | 0.2 | 0.4 | 0.03 | 0.01 | Below | 1.35 |
| Comparative example A1 | 6 | 5 | 3 | 0.5 | 0.8 | 0.01 | 0.01 | Above | 0.49 |
| Comparative example A2 | 457 | 360 | 194 | 0.4 | 0.8 | 0.01 | 0.01 | Above | 1.90 |
| Comparative example A3 | 11 | 8.9 | 8 | 0.7 | 0.8 | 0.01 | 0.00 | Above | 0.12 |
| Comparative example A4 | 886 | 886 | 880 | 1.0 | 1.0 | 0.00 | 0.00 | Above | 4.80 |
| Comparative example A5 | 230 | 230 | 3 | 0.0 | 1.0 | 0.00 | 0.03 | Above | 0.05 |
| Comparative example A6 | 14 | 14 | 14 | 1.0 | 1.0 | 0.00 | 0.00 | Above | 0.14 |
| Comparative example A7 | 115 | 115 | 115 | 1.0 | 1.0 | 0.00 | 0.00 | — | 0.21 |
| Comparative example A8 | 79 | 70 | 36 | 0.5 | 0.9 | 0.01 | 0.01 | Above | 0.84 |

TABLE 4

| | Recessed photosensitive drum | | Circumferentially streaked photosensitive drum | | Smooth photosensitive drum | |
|---|---|---|---|---|---|---|
| | Slipping through | Stick-slip motion and curling | Slipping through | Stick-slipmotion and curling | Slipping through | Stick-slip motion and curling |
| Example A1 | A | A | A | A | A | A |
| Example A2 | A | A | A | A | A | A |
| Example A3 | A | A | A | A | A | A |
| Example A4 | B | B | A | B | A | A |
| Example A5 | B | B | B | A | A | A |
| Example A6 | B | A | B | A | A | A |
| Example A7 | A | A | B | A | A | A |
| Comparative example A1 | C | D | B | B | D | D |
| Comparative example A2 | D | B | D | B | B | B |
| Comparative example A3 | D | B | C | A | B | C |
| Comparative example A4 | D | A | D | A | C | C |
| Comparative example A5 | D | D | C | B | A | D |
| Comparative example A6 | A | C | A | C | C | D |
| Comparative example A7 | A | D | A | C | C | D |
| Comparative example A8 | D | A | C | A | B | A |

In Examples A1 to A7 in which $Y_0$ is 10 mgf/μm$^2$ or more and 400 mgf/μm$^2$ or less, $Y_{50}/Y_0$ is more than 0 and 0.5 or less, and $\Delta Y_{0-20}$ is equal to or more than $\Delta Y_{20-50}$, during use of the photosensitive drums, occurrence of slipping through is suppressed and occurrence of the unusual sound, the stick-slip motion, and curling of the cleaning blades are suppressed.

Example B1

Step of Preparing First Composition

A reaction was caused between 299 parts of 4,4'-MDI and 767.5 parts of BA2600 at 80° C. for 3 hours to provide a first composition (prepolymer) containing a 7.2 mass % of a NCO group.

Step of Preparing Second Composition

To 300 parts of HA2000, 0.25 parts of ETA as a urethane-rubber synthesis catalyst was added. The resultant mixture was stirred at 60° C. for 1 hour to provide a second composition.

Step of Preparing Mixture

The first composition was heated to 80° C. To this first composition, the second composition heated to 60° C. was added and stirred to provide a mixture of the first composition and the second composition. The amount of polyol (number of moles) in this mixture relative to the number of moles of polyisocyanate in this mixture was 17 mol % (M(OH/NCO)). In this example, M(OH/NCO)=17 mol %.

Step of Obtaining Urethane-Rubber Cleaning Blade

A catalyst solution prepared by mixing 100 parts of ETA and 100 parts of ethanol was sprayed onto a spot of an inner surface of the mold for producing a cleaning blade. After that, the catalyst solution was spread by being wiped with a urethane-rubber blade over a portion (a surface corresponding to the contact portion of the cleaning blade) of the inner surface of the mold. In the mold used in this example, the surface coated with the catalyst (hereafter also referred to as a "catalyst coating surface") was subjected to blasting with glass beads. As a result, the surface had an average inclination angle θa of 1.01° and a ten point height of roughness profile Rz of 0.63 μm.

After the catalyst solution was spread by being wiped, the mold was heated to 110° C. A release agent was subsequently applied to a surface of the inner surfaces of the mold, the surface not coated with the catalyst solution. The mold was heated again to 110° C. and held at the temperature.

After that, the mixture was injected into the mold (within the cavity). The injected mixture was heated at 110° C. (molding temperature) for 30 minutes to undergo a curing reaction, and subsequently released from the mold to provide a urethane-rubber plate. The obtained urethane-rubber plate had, in the surface, irregularities formed by transfer of the surface profile of the mold. The obtained urethane-rubber plate was cut with a cutter to form an edge portion. Thus, a urethane-rubber cleaning blade was obtained. The obtained cleaning blade had a thickness of 2 mm, a length of 20 mm, and a width of 345 mm.

The production conditions and M(OH/NCO) are described in Tables 5 and 6.

The obtained cleaning blade was subjected to the analytical measurement and the property evaluation. The results are described in FIGS. 8A and 8B and Table 7.

Figure 8A:
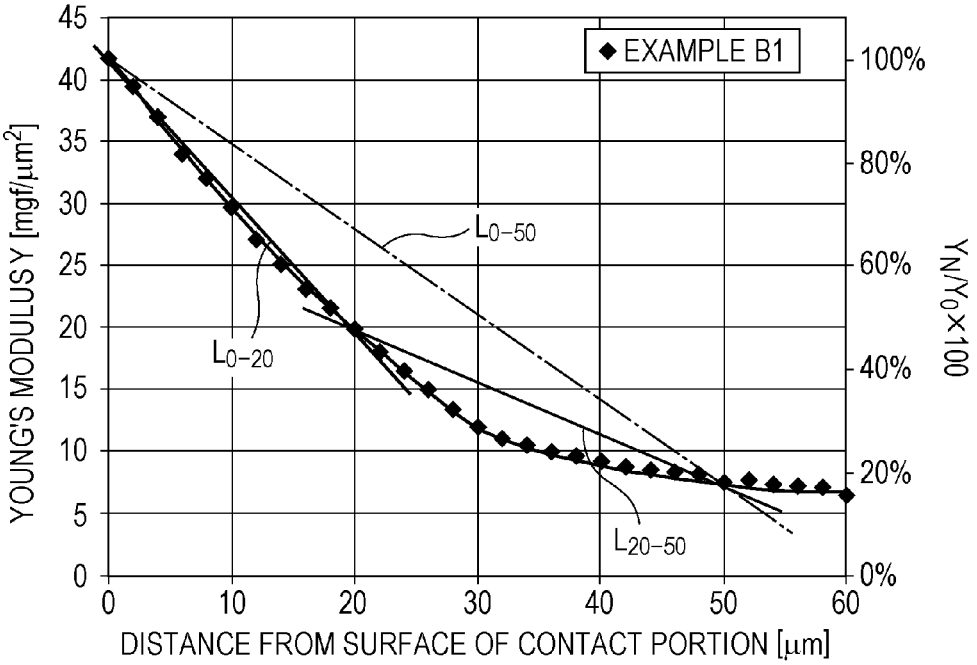
FIGS. 8A and 8B are graphs illustrating the results of Example B1.
Figure 8B:
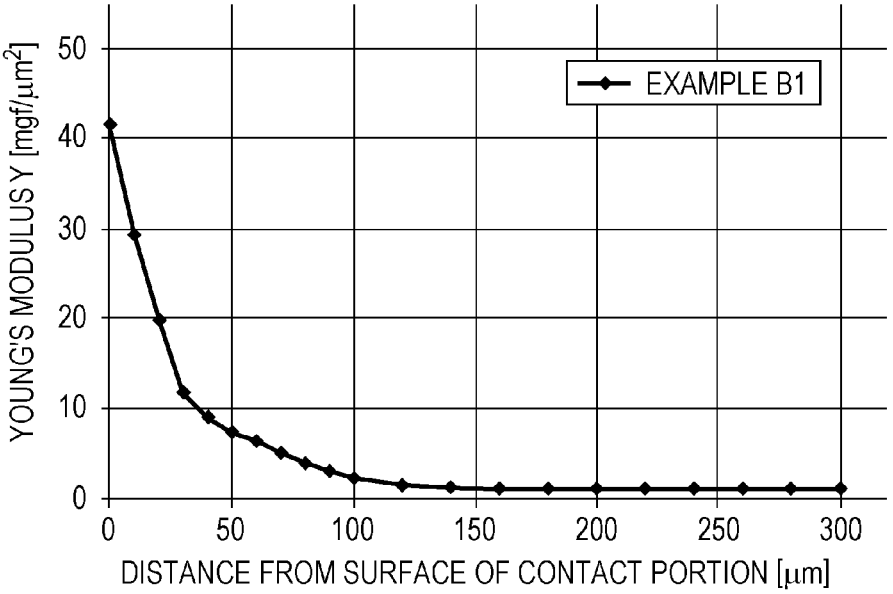

In FIG. 8A, a straight line connecting the Young's modulus $Y_0$ and the Young's modulus $Y_{50}$ is represented by a symbol $L_{0-50}$; a straight line connecting the Young's modulus $Y_0$ and the Young's modulus $Y_{20}$ is represented by a symbol $L_{0-20}$; and a straight line connecting the Young's modulus $Y_{20}$ and the Young's modulus $Y_{50}$ is represented by a symbol $L_{20-50}$.

Evaluation Method

As an evaluation machine, a copying machine (product name: iR-ADVC5255) manufactured by CANON KABUSHIKI KAISHA was used. Two photosensitive drums that had the same dimensions as the photosensitive drum for the copying machine were prepared: a photosensitive drum (recessed photosensitive drum) that had recesses having a diameter of 40 μm and a depth of 2.5 μm and having an area ratio of 50% in the surface; and a photosensitive drum (smooth photosensitive drum) that had a smooth surface. These drums were mounted to the copying machine. The cleaning blade obtained above was disposed such that its contact surface (a surface facing the catalyst-solution-coated inner surface of the mold) was in contact with each of the photosensitive drums. The contact mode of the cleaning blade to the photosensitive drum that was a cleaning target member was a "counter mode". The cleaning blade was disposed under the following conditions: a set angle of 22°, a contact pressure of 28 gf/cm, and a free length of 8 mm. An endurance test was carried out for 10000 paper sheets in a high-temperature high-humidity environment at 30° C./80% RH, without development, and at a discharge current of 100 μA. And the cleaning blade was evaluated in terms of unusual sound (chatter), stick-slip motion, and curling.

Subsequently, in a low-temperature low-humidity environment at 15° C./10% RH, a spherical toner (diameter: 5.5 μm) was applied to the surface of each photosensitive drum. Regarding the cleaning performance of the cleaning blade, occurrence of slipping through of the toner was evaluated. The higher the conformability of the cleaning blade to irregularities in the surface of the photosensitive drum and the toner on this surface, the less slipping through of the toner occurs. The evaluation results are described in Table 8.

Incidentally, the evaluation systems are as follows.

Evaluation in Terms of Unusual Sound, Stick-Slip Motion, and Curling

A: No occurrence of unusual sound, stick-slip motion, or curling of cleaning blade B: Occurrence of unusual sound sometimes at the time of stopping or starting of driving C: Occurrence of unusual sound at the time of stopping and starting of driving, or occurrence of unusual sound during driving D: Occurrence of unusual sound anytime or occurrence of curling Slipping Through A: No slipping through of toner B: Occurrence of slipping through of some toner, observed on the downstream surface (surface facing the surface of the photosensitive drum) of the cleaning blade (by observation of the cleaning blade)

C: Partial occurrence of streak-shaped slipping through of toner to a degree visually observed (by observation of the surface of the photosensitive drum)

D: Overall occurrence of slipping through of toner to a degree visually observed (by observation of the surface of the photosensitive drum)

The cleaning blade of Example B1 was found to have a Young's modulus $Y_0$ of 42 mgf/μm$^2$, $Y_{50}/Y_0$ of 0.19, and $Y_{20}/Y_0$ of 0.48. The gradients of $L_{0-20}$ and $L_{20-50}$ indicate $\Delta Y_{0-20} \geq \Delta Y_{20-50}$. In addition, the Young's modulus $Y_N$ is positioned below $L_{0-50}$, that is, the profile of changes in the Young's modulus in the direction from the surface to the inside of the contact portion is convex downward. Incidentally, $I_{SI}/I_{SE}$ was found to be 0.50. The average inclination angle θa was 1.26° and the ten point height of roughness profile Rz was 0.71 μm.

Example B2

Figure 9A:
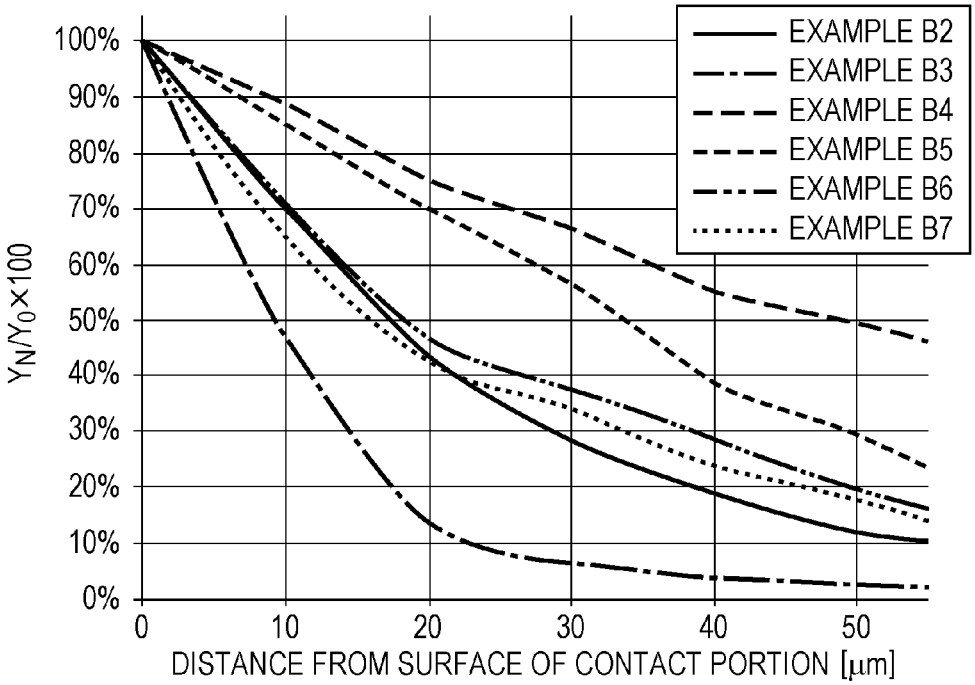
FIG. 9A is a graph illustrating the results of Examples B2 to B7.

A cleaning blade was produced and subjected to the analytical measurement and the property evaluation as in Example B1 except that 100 parts of ETA used for preparation of the catalyst solution applied to the inner surface of the mold in Example B1 was changed to 100 parts of the compound represented by the above-described formula (D) (product name: DABCO-TMR, manufactured by Sankyo Air Products Co., Ltd.), and the molding temperature was changed from 110° C. to 80° C. The production conditions and M(OH/NCO) are described in Tables 5 and 6 and the results of the analytical measurement and the property evaluation are described in FIG. 9A and Tables 7 and 8.

Example B3

A cleaning blade was produced and subjected to the analytical measurement and the property evaluation as in Example B1 except that 100 parts of ETA used for preparation of the catalyst solution applied to the inner surface of the mold in Example B1 was changed to 100 parts of a specialty amine (product name: UCAT-18X, manufactured by San-Apro Ltd.), and the molding temperature was changed from 110° C. to 150° C. The production conditions and M(OH/NCO) are described in Tables 5 and 6 and the results of the analytical measurement and the property evaluation are described in FIG. 9A and Tables 7 and 8.

Example B4

A cleaning blade was produced and subjected to the analytical measurement and the property evaluation as in Example B1 except that the amount of HA2000 in the Step of preparing second composition was changed from 300 parts in Example B1 to 360 parts, and 100 parts of ETA used for preparation of the catalyst solution applied to the inner surface of the mold was changed to 100 parts of $CH_3COOK$ (product name: POLYCAT46, manufactured by Air Products and Chemicals, Inc.). The production conditions and M(OH/NCO) are described in Tables 5 and 6 and the results of the analytical measurement and the property evaluation are described in FIG. 9A and Tables 7 and 8.

Example B5

A cleaning blade was produced and subjected to the analytical measurement and the property evaluation as in Example B1 except that the amount of 4,4'-MDI in the Step of preparing first composition was changed from 299 parts in Example B1 to 350 parts; the amount of BA2600 was changed from 767.5 parts to 860 parts; the amount of HA2000 in the Step of preparing second composition was changed from 300 parts to 170 parts; 100 parts of ETA used for preparation of the catalyst solution applied to the inner surface of the mold was changed to 100 parts of a mixture of 1:1 (mass ratio) UCAT-18X (product name) and DABCO-TMR (product name); and the molding temperature was changed from 110° C. to 90° C. The production conditions and M(OH/NCO) are described in Tables 5 and 6 and the results of the analytical measurement and the property evaluation are described in FIG. 9A and Tables 7 and 8.

Example B6

A cleaning blade was produced and subjected to the analytical measurement and the property evaluation as in Example B1 except that the amount of HA2000 in the Step of preparing second composition was changed from 300 parts in Example B1 to 218.5 parts; 100 parts of ETA used for preparation of the catalyst solution applied to the inner surface of the mold was changed to 100 parts of UCAT-18X (product name); and the molding temperature was changed from 110° C. to 100° C. The production conditions and M(OH/NCO) are described in Tables 5 and 6 and the results of the analytical measurement and the property evaluation are described in FIG. 9A and Tables 7 and 8.

Example B7

A cleaning blade was produced and subjected to the analytical measurement and the property evaluation as in Example B1 except that the amount of HA2000 in the Step of preparing second composition was changed from 300 parts in Example B1 to 218.5 parts, and 100 parts of ETA used for preparation of the catalyst solution applied to the inner surface of the mold was changed to 100 parts of UCAT-18X (product name). The production conditions and M(OH/NCO) are described in Tables 5 and 6 and the results of the analytical measurement and the property evaluation are described in FIG. 9A and Tables 7 and 8.

Example B8

A cleaning blade was produced and subjected to the analytical measurement and the property evaluation as in Example B1 except that the mold in Example B1 was changed to a mold in which the catalyst coating surface had an average inclination angle θa of 15.1° and a ten point height of roughness profile Rz of 9.2 μm. The production conditions and M(OH/NCO) are described in Tables 5 and 6. In this Example, production conditions other than the surface profile of the mold were the same as in Example B1 and changes in Young's modulus in the depth direction were substantially the same as in Example B1. The results of the analytical measurement and the property evaluation are described in Tables 7 and 8.

Example B9

A cleaning blade was produced and subjected to the analytical measurement and the property evaluation as in Example B6 except that the mold in Example B6 was changed to a mold in which the catalyst coating surface had an average inclination angle θa of 15.1° and a ten point height of roughness profile Rz of 9.2 μm. The production conditions and M(OH/NCO) are described in Tables 5 and 6. In this Example, production conditions other than the surface profile of the mold were the same as in Example B6 and changes in Young's modulus in the depth direction were substantially the same as in Example B6. The results of the analytical measurement and the property evaluation are described in Tables 7 and 8.

Example B10

In this Example, a cleaning blade produced as in Example B9 was used for a belt-shaped intermediate transfer member (hereafter also referred to as an "intermediate transfer belt"). As an evaluation machine, as in Example B1, the copying machine manufactured by CANON KABUSHIKI KAISHA (product name: iR-ADVC5255) was used. The intermediate transfer belt (unused) for the copying machine was used (smooth intermediate transfer belt). The set angle was set to 25° and the contact pressure was set to 35 gf/cm. An endurance test was carried out for 10000 paper sheets in a high-temperature high-humidity environment at 30° C./80% RH, without formation of images, at a primary transfer current of 40 μA and at a secondary transfer current of 80 μA. During the endurance test, the cleaning blade was evaluated in terms of unusual sound (chatter), stick-slip motion, and curling. Subsequently, in a low-temperature low-humidity environment at 15° C./10% RH, a solid image having a width of 50 mm was transferred so as to longitudinally extend across the surface of the intermediate transfer belt. And the cleaning performance of the cleaning blade for the solid image was evaluated. At this time, no transfer bias was applied to the secondary transfer section, to thereby maximize the amount of the toner on the surface of the intermediate transfer belt reaching the cleaning section. The type of the toner, the amount of the toner deposited, and the amount of charging were the same as in Example B1. The evaluation results are described in Tables 7 and 8.

Comparative example B1

Figure 9B:
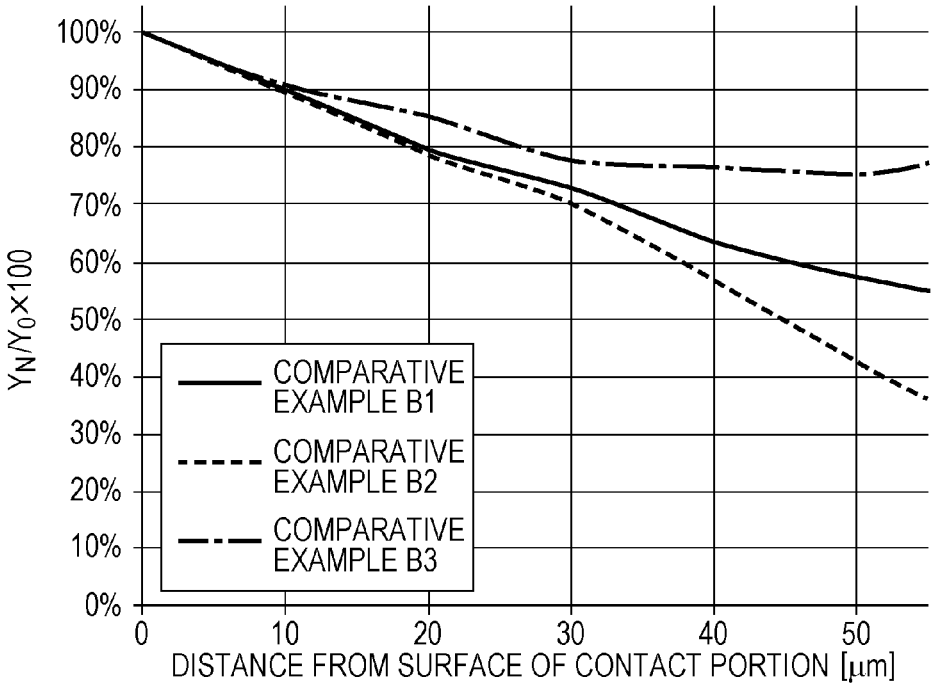
FIG. 9B is a graph illustrating the results of Comparative examples B1 to B3.

A cleaning blade was produced and subjected to the analytical measurement and the property evaluation as in Example B1 except that the amount of HA2000 in the Step of preparing second composition was changed from 300 parts in Example B1 to 500 parts, and the molding temperature was changed from 110° C. to 140° C. The production conditions and M(OH/NCO) are described in Tables 5 and 6 and the results of the analytical measurement and the property evaluation are described in FIG. 9B and Tables 7 and 8.

Comparative example B2

A cleaning blade was produced and subjected to the analytical measurement and the property evaluation as in Example B1 except that the amount of 4,4'-MDI in the Step of preparing first composition was changed from 299 parts in Example B1 to 350 parts; the amount of BA2600 was changed from 767.5 parts to 860 parts; the amount of HA2000 in the Step of preparing second composition was changed from 300 parts to 150 parts; and 100 parts of ETA used for preparation of the catalyst solution applied to the inner surface of the mold was changed to 100 parts of UCAT-18X (product name). The production conditions and M(OH/NCO) are described in Tables 5 and 6 and the results of the analytical measurement and the property evaluation are described in FIG. 9B and Tables 7 and 8.

Comparative example B3

A cleaning blade was produced as in Example B1 except that the catalyst solution was not applied to the inner surface of the mold. Subsequently, the produced cleaning blade was immersed into 4,4'-MDI heated to 80° C. for 30 minutes and withdrawn. After that, 4,4'-MDI adhering to the surface of the cleaning blade was wiped off with ethanol. After that, the cleaning blade was left in a high-humidity environment at 25° C./90% RH for 2 days, to hydrolyze 4,4'-MDI not being wiped off and having impregnated into the surface of the cleaning blade. Thus, the cleaning blade of Comparative example B3 was provided. The production conditions and M(OH/NCO) are described in Tables 5 and 6 and the results of the analytical measurement and the property evaluation are described in FIG. 9B and Tables 7 and 8. Comparative example B4

Figure 10A:
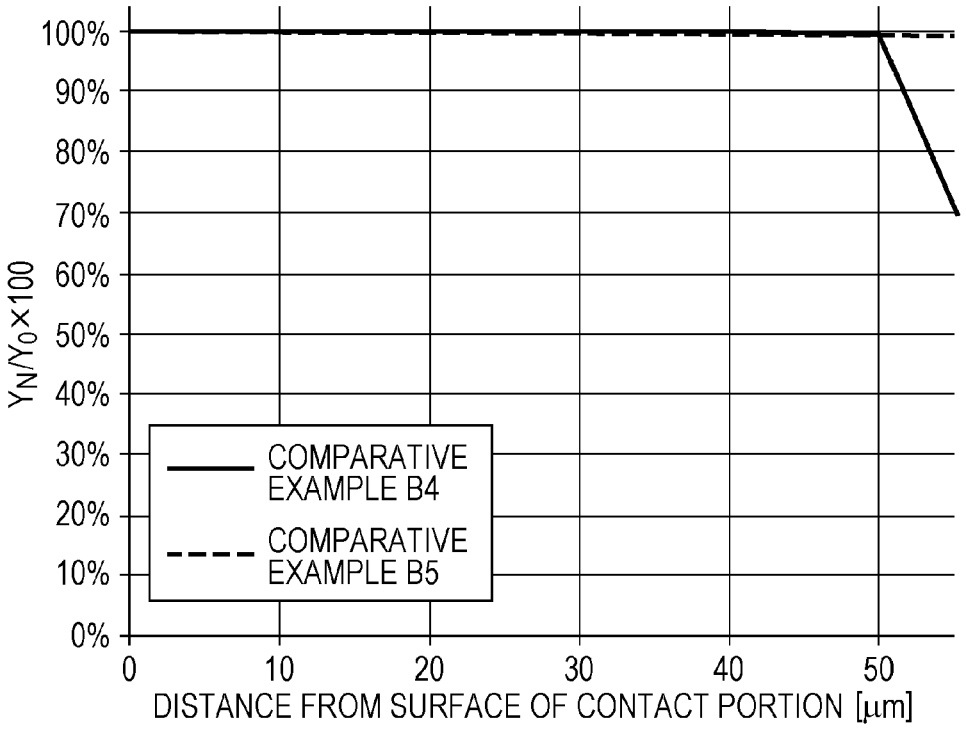
FIG. 10A is a graph illustrating the results of Comparative examples B4 and B5.

A catalyst solution was prepared by adding, to 100 parts of methyl isobutyl ketone (MIBK), 0.1 parts (corresponding to 1000 ppm) of DABCO-TMR (product name), and further adding thereto 200 parts of 4,4'-MDI. The prepared catalyst solution was sprayed onto the inner surface of the mold heated to 130° C., to form a polyisocyanate film containing isocyanurate and unreacted MDI and having a thickness of 50 μm on the inner surface of the mold. Subsequently, the mixture of the first composition and the second composition prepared as in Example B1 was injected into the mold (within the cavity). The injected mixture was heated at 130° C. (molding temperature) for 30 minutes to undergo a curing reaction, and subsequently released from the mold to provide a urethane-rubber plate. The obtained urethane-rubber plate was cut with a cutter to form an edge portion. Thus, a urethane-rubber cleaning blade was obtained. The obtained cleaning blade had a thickness of 2 mm, a length of 20 mm, and a width of 345 mm. The obtained cleaning blade was subjected to the analytical measurement and the property evaluation as in Example B1. The production conditions are described in Table 6, and the results of the analytical measurement and the property evaluation are described in FIG. 10A and Tables 7 and 8.

Comparative Example B5

A cleaning blade was produced and subjected to the analytical measurement and the property evaluation as in Example B1 except that the amount of BA2600 in the Step of preparing first composition was changed from 767.5 parts in Example B1 to 800 parts; the amount of HA2000 in the Step of preparing second composition was changed from 300 parts to 450 parts; the amount of ETA was changed from 0.25 parts to 0.28 parts; 100 parts of ETA used for preparation of the catalyst solution applied to the inner surface of the mold was changed to 100 parts of a mixture of 3:2 (mass ratio) POLYCAT46 (product name) and a quaternary ammonium salt (product name: TOYOCAT-TRV, manufactured by Tosoh Corporation); and the molding temperature was changed from 110° C. to 100° C. The production conditions and M(OH/NCO) are described in Tables 5 and 6 and the results of the analytical measurement and the property evaluation are described in FIG. 10A and Tables 7 and 8.

Comparative Example B6

Figure 10B:
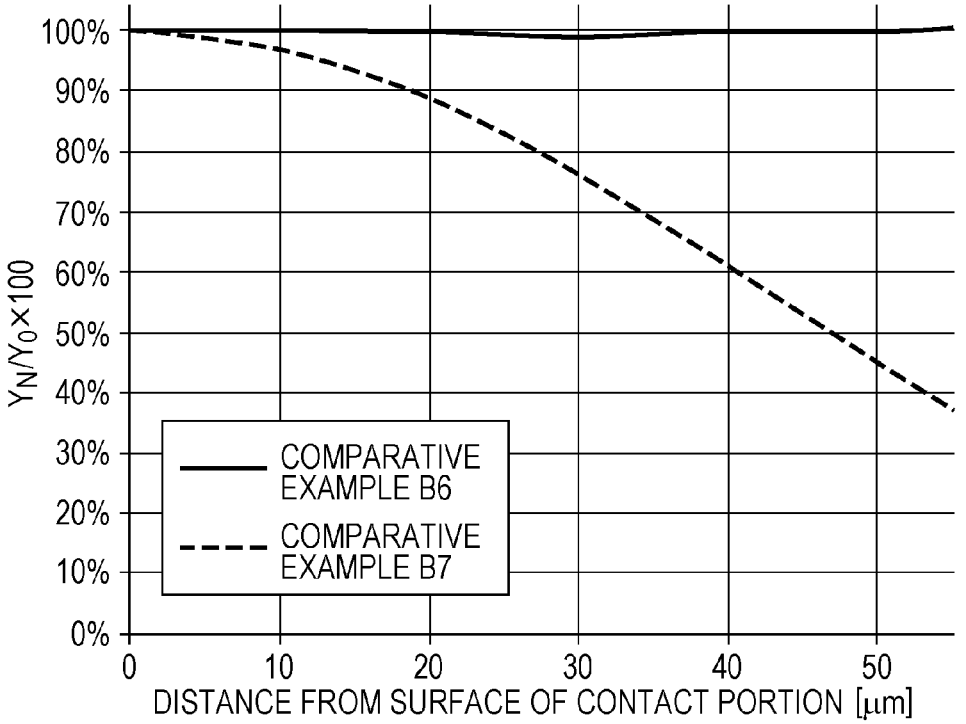
FIG. 10B is a graph illustrating the results of Comparative examples B6 and B7.

A cleaning blade was produced and subjected to the analytical measurement and the property evaluation as in Example B1 except that ETA used for preparation of the catalyst solution in Example B1 was changed to a mixture of 1:1 (mass ratio) UCAT-18X (product name) and DABCO-TMR (product name) and 0.25 parts of this mixture was mixed with the second composition without being applied to the inner surface of the mold; and the molding temperature was changed from 110° C. to 90° C. The production conditions and M(OH/NCO) are described in Tables 5 and 6, and the results of the analytical measurement and the property evaluation are described in FIG. 10B and Tables 7 and 8.

Comparative Example B7

A cleaning blade was produced and subjected to the analytical measurement and the property evaluation as in Example B1 except that the amount of HA2000 in the Step of preparing second composition was changed from 300 parts in Example B1 to 380 parts; 100 parts of ETA used for preparation of the catalyst solution applied to the inner surface of the mold was changed to 100 parts of a mixture of 1:1 (mass ratio) POLYCAT46 (product name) and TOYOCAT-TRV (product name); and the molding temperature was changed from 110° C. to 100° C. The production conditions and M(OH/NCO) are described in Tables 5 and 6, and the results of the analytical measurement and the property evaluation are described in FIG. 10B and Tables 7 and 8.

Comparative Example B8

A cleaning blade was produced and subjected to the analytical measurement and the property evaluation as in Example B1 except that the mold in Example B1 was changed to a mold in which the catalyst coating surface had an average inclination angle θa of 0.36° and a ten point height of roughness profile Rz of 0.17 μm. The production conditions and M(OH/NCO) are described in Tables 5 and 6. In this Example, production conditions other than the surface profile of the mold were the same as in Example B1 and changes in Young's modulus in the depth direction were substantially the same as in Example B1. The results of the analytical measurement and the property evaluation are described in Tables 7 and 8.

Comparative Example B9

A cleaning blade was produced and subjected to the analytical measurement and the property evaluation as in Example B1 except that the mold in Example B1 was changed to a mold in which the catalyst coating surface had an average inclination angle θa of 19.8° and a ten point height of roughness profile Rz of 10.3 μm. The production conditions and M(OH/NCO) are described in Tables 5 and 6. In this Example, production conditions other than the surface profile of the mold were the same as in Example B1 and changes in Young's modulus in the depth direction were substantially the same as in Example B1. The results of the analytical measurement and the property evaluation are described in Tables 7 and 8.

Comparative Example B10

A cleaning blade was produced and subjected to the analytical measurement and the property evaluation as in Example B6 except that the mold in Example B6 was changed to a mold in which the catalyst coating surface had an average inclination angle θa of 0.36° and a ten point height of roughness profile Rz of 0.17 μm. The production conditions and M(OH/NCO) are described in Tables 5 and 6. In this Example, production conditions other than the surface profile of the mold were the same as in Example B6 and changes in Young's modulus in the depth direction were substantially the same as in Example B6. The results of the analytical measurement and the property evaluation are described in Tables 7 and 8.

Comparative Example B11

A cleaning blade was produced and subjected to the analytical measurement and the property evaluation as in Example B6 except that the mold in Example B6 was changed to a mold in which the catalyst coating surface had an average inclination angle θa of 19.8° and a ten point height of roughness profile Rz of 10.3 μm. The production conditions and M(OH/NCO) are described in Tables 5 and 6. The results of the analytical measurement and the property evaluation are described in Tables 7 and 8.

TABLE 5

| Cleaning blade | (i) First composition: Poly isocyanate | | Polyol | | (ii) Second composition: Polyol | | Urethane-rubber synthesis catalyst | | M(OH/NCO) [mol %] in mixture of (i) and (ii) |
|---|---|---|---|---|---|---|---|---|---|
| Example B1 | 4,4'-MDI | 299 parts | BA2600 | 767.5 parts | HA2000 | 300 parts | ETA | 0.25 parts | 17 |
| Example B2 | 4,4'-MDI | 299 parts | BA2600 | 767.5 parts | HA2000 | 300 parts | ETA | 0.25 parts | 17 |
| Example B3 | 4,4'-MDI | 299 parts | BA2600 | 767.5 parts | HA2000 | 300 parts | ETA | 0.25 parts | 17 |
| Example B4 | 4,4'-MDI | 299 parts | BA2600 | 767.5 parts | HA2000 | 360 parts | ETA | 0.25 parts | 20 |
| Example B5 | 4,4'-MDI | 350 parts | BA2600 | 860 parts | HA2000 | 170 parts | ETA | 0.25 parts | 8 |
| Example B6 | 4,4'-MDI | 299 parts | BA2600 | 767.5 parts | HA2000 | 218.5 parts | ETA | 0.25 parts | 12 |
| Example B7 | 4,4'-MDI | 299 parts | BA2600 | 767.5 parts | HA2000 | 218.5 parts | ETA | 0.25 parts | 12 |
| Example B8 | 4,4'-MDI | 299 parts | BA2600 | 767.5 parts | HA2000 | 300 parts | ETA | 0.25 parts | 17 |
| Example B9 | 4,4'-MDI | 299 parts | BA2600 | 767.5 parts | HA2000 | 218.5 parts | ETA | 0.25 parts | 12 |
| Example B10 | 4,4'-MDI | 299 parts | BA2600 | 767.5 parts | HA2000 | 218.5 parts | ETA | 0.25 parts | 12 |
| Comparative example B1 | 4,4'-MDI | 299 parts | BA2600 | 767.5 parts | HA2000 | 500 parts | ETA | 0.25 parts | 28 |
| Comparative example B2 | 4,4'-MDI | 350 parts | BA2600 | 860 parts | HA2000 | 150 parts | ETA | 0.25 parts | 7 |
| Comparative example B3 | 4,4'-MDI | 299 parts | BA2600 | 767.5 parts | HA2000 | 300 parts | ETA | 0.25 parts | 17 |
| Comparative example B4 | — | — | — | — | — | — | — | — | — |
| Comparative example B5 | 4,4'-MDI | 299 parts | BA2600 | 800 parts | HA2000 | 450 parts | ETA | 0.25 parts | 25 |
| Comparative example B6 | 4,4'-MDI | 299 parts | BA2600 | 767.5 parts | HA2000 | 300 parts | ETA | 0.28 parts | 17 |
| Comparative example B7 | 4,4'-MDI | 299 parts | BA2600 | 767.5 parts | HA2000 | 380 parts | ETA | 0.25 parts | 21 |
| Comparative example B8 | 4,4'-MDI | 299 parts | BA2600 | 767.5 parts | HA2000 | 300 parts | ETA | 0.25 parts | 17 |
| Comparative example B9 | 4,4'-MDI | 299 parts | BA2600 | 767.5 parts | HA2000 | 300 parts | ETA | 0.25 parts | 17 |
| Comparative example B10 | 4,4'-MDI | 299 parts | BA2600 | 767.5 parts | HA2000 | 218.5 parts | ETA | 0.25 parts | 12 |
| Comparative example B11 | 4,4'-MDI | 299 parts | BA2600 | 767.5 parts | HA2000 | 218.5 parts | ETA | 0.25 parts | 12 |

TABLE 6

| Cleaning blade | Catalyst solution | | | Molding temperature [° C.] |
|---|---|---|---|---|
| Example B1 | Ethanol<br>ETA | 100 parts<br>100 parts | Applied to inner surface of mold | 110 |
| Example B2 | Ethanol<br>DABCO-TMR | 100 parts<br>100 parts | Applied to inner surface of mold | 80 |
| Example B3 | Ethanol<br>UCAT-18X | 100 parts<br>100 parts | Applied to inner surface of mold | 150 |
| Example B4 | Ethanol<br>POLYCAT46 | 100 parts<br>100 parts | Applied to inner surface of mold | 110 |
| Example B5 | Ethanol<br>UCAT-18X<br>DABCO-TMR | 100 parts<br>50 parts<br>50 parts | Applied to inner surface of mold | 90 |
| Example B6 | Ethanol<br>UCAT-18X | 100 parts<br>100 parts | Applied to inner surface of mold | 100 |
| Example B7 | Ethanol<br>UCAT-18X | 100 parts<br>100 parts | Applied to inner surface of mold | 110 |
| Example B8 | Ethanol<br>ETA | 100 parts<br>100 parts | Applied to inner surface of mold | 110 |
| Example B9 | Ethanol<br>UCAT-18X | 100 parts<br>100 parts | Applied to inner surface of mold | 100 |
| Example B10 | Ethanol<br>UCAT-18X | 100 parts<br>100 parts | Applied to inner surface of mold | 100 |

TABLE 6-continued

| Cleaning blade | Catalyst solution | | | Molding temperature [° C.] |
|---|---|---|---|---|
| Comparative example B1 | Ethanol<br>ETA | 100 parts<br>100 parts | Applied to inner surface of mold | 140 |
| Comparative example B2 | Ethanol<br>UCAT-18X | 100 parts<br>100 parts | Applied to inner surface of mold | 110 |
| Comparative example B3 | — | — | — | 110 |
| Comparative example B4 | MIBK<br>DABCO-TMR<br>4,4'-MDI | 100 parts<br>0.1 parts<br>200 parts | Applied to inner surface of mold | 130 |
| Comparative example B5 | Ethanol<br>POLYCAT46<br>TOYOCAT-TRV | 100 parts<br>60 parts<br>40 parts | Applied to inner surface of mold | 100 |
| Comparative example B6 | Ethanol<br>UCAT-18X<br>DABCO-TMR | 100 parts<br>50 parts<br>50 parts | 0.25 parts added to second composition | 90 |
| Comparative example B7 | Ethanol<br>POLYCAT46<br>TOYOCAT-TRV | 100 parts<br>50 parts<br>50 parts | Applied to inner surface of mold | 100 |
| Comparative example B8 | Ethanol<br>ETA | 100 parts<br>100 parts | Applied to inner surface of mold | 110 |
| Comparative example B9 | Ethanol<br>ETA | 100 parts<br>100 parts | Applied to inner surface of mold | 110 |
| Comparative example B10 | Ethanol<br>UCAT-18X | 100 parts<br>100 parts | Applied to inner surface of mold | 100 |
| Comparative example B11 | Ethanol<br>UCAT-18X | 100 parts<br>100 parts | Applied to inner surface of mold | 100 |

TABLE 7

| | Young's modulus | | | | | | | | | Average | Ten point height of | Coefficient of kinetic |
|---|---|---|---|---|---|---|---|---|---|---|---|---|
| | $Y_0$ [mgf/μm$^2$] | $Y_{20}$ [mgf/μm$^2$] | $Y_{50}$ [mgf/μm$^2$] | $Y_{50}/Y_0$ | $Y_{20}/Y_0$ | $\Delta Y_{0\text{-}20}$ | $\Delta Y_{20\text{-}50}$ | $Y_N$ is below $L_{0\text{-}50}$ ? | $I_{SI}/I_{SE}$ | inclination angle □a [°] | roughness profile Rz [μm] | friction of contact portion |
| Example B1 | 42 | 20 | 8 | 0.19 | 0.48 | 0.03 | 0.01 | Below | 0.50 | 1.26 | 0.71 | 0.5 |
| Example B2 | 250 | 110 | 31 | 0.12 | 0.44 | 0.03 | 0.01 | Below | 1.20 | 1.18 | 0.67 | 0.4 |
| Example B3 | 158 | 22 | 5 | 0.03 | 0.14 | 0.04 | 0.00 | Below | 0.91 | 1.20 | 0.67 | 0.4 |
| Example B4 | 10 | 8 | 5 | 0.50 | 0.80 | 0.01 | 0.01 | Above | 0.61 | 1.35 | 0.76 | 0.6 |
| Example B5 | 161 | 113 | 48 | 0.30 | 0.70 | 0.01 | 0.01 | Above | 0.85 | 1.19 | 0.69 | 0.4 |
| Example B6 | 400 | 189 | 78 | 0.20 | 0.47 | 0.03 | 0.01 | Below | 1.55 | 1.02 | 0.63 | 0.3 |
| Example B7 | 344 | 148 | 61 | 0.18 | 0.43 | 0.03 | 0.01 | Below | 1.35 | 1.12 | 0.68 | 0.3 |
| Example B8 | 42 | 19 | 7 | 0.17 | 0.45 | 0.03 | 0.01 | Below | 0.49 | 17.20 | 9.80 | 0.2 |
| Example B9 | 389 | 187 | 73 | 0.17 | 0.45 | 0.03 | 0.01 | Below | 1.51 | 12.00 | 8.10 | 0.2 |
| Example B10 | 398 | 188 | 73 | 0.18 | 0.47 | 0.03 | 0.01 | Below | 1.56 | 12.50 | 8.90 | 0.2 |
| Comparative example B1 | 6 | 5 | 3 | 0.50 | 0.83 | 0.01 | 0.01 | Above | 0.49 | 1.44 | 0.81 | 1.2 |
| Comparative example B2 | 457 | 360 | 194 | 0.42 | 0.79 | 0.01 | 0.01 | Above | 1.90 | 1.01 | 0.64 | 0.3 |
| Comparative example B3 | 11 | 8.9 | 8 | 0.73 | 0.81 | 0.01 | 0.00 | Above | 0.12 | 1.78 | 1.50 | 0.6 |
| Comparative example B4 | 886 | 886 | 880 | 0.99 | 1.00 | 0.00 | 0.00 | Above | 4.80 | 1.00 | 0.61 | 0.2 |
| Comparative example B5 | 14 | 14 | 14 | 1.00 | 1.00 | 0.00 | 0.00 | Above | 0.14 | 1.37 | 0.89 | 0.6 |
| Comparative example B6 | 115 | 115 | 115 | 1.00 | 1.00 | 0.00 | 0.00 | — | 0.21 | 1.17 | 0.66 | 0.5 |
| Comparative example B7 | 79 | 70 | 36 | 0.46 | 0.89 | 0.01 | 0.01 | Above | 0.84 | 1.11 | 0.69 | 0.5 |
| Comparative example B8 | 50 | 23 | 9 | 0.18 | 0.46 | 0.03 | 0.01 | Below | 0.52 | 0.48 | 0.36 | 1.6 |
| Comparative example B9 | 44 | 25 | 10 | 0.23 | 0.57 | 0.02 | 0.01 | Below | 0.51 | 20.60 | 12.50 | 0.2 |
| Comparative example B10 | 410 | 191 | 85 | 0.21 | 0.47 | 0.03 | 0.01 | Below | 1.58 | 0.38 | 0.18 | 1.1 |
| Comparative example B11 | 422 | 198 | 87 | 0.21 | 0.47 | 0.03 | 0.01 | Below | 1.60 | 19.90 | 10.40 | 0.2 |

TABLE 8

| | Recessed photosensitive drum | | Circumferentially streaked photosensitive drum | | Smooth photosensitive drum | |
|---|---|---|---|---|---|---|
| | Slipping through | Stick-slip motion and curling | Slipping through | Stick-slip motion and curling | Slipping through | Stick-slip motion and curling |
| Example B1 | A | A | A | A | A | A |
| Example B2 | A | A | A | A | A | A |
| Example B3 | A | A | A | A | A | A |
| Example B4 | B | B | A | B | A | A |
| Example B5 | B | B | B | A | A | A |
| Example B6 | B | A | B | A | A | A |
| Example B7 | A | A | B | A | A | A |
| Example B8 | A | A | — | — | A | A |
| Example B9 | B | A | — | — | A | A |
| Example B10 | — | — | — | — | A | A |
| Comparative example B1 | C | D | B | B | C | D |
| Comparative example B2 | D | B | D | B | B | B |
| Comparative example B3 | C | B | C | A | A | C |
| Comparative example B4 | D | A | D | A | B | C |
| Comparative example B5 | A | C | A | C | A | D |
| Comparative example B6 | A | D | A | C | B | D |
| Comparative example B7 | C | A | C | A | A | A |
| Comparative example B8 | B | B | — | — | B | B |
| Comparative example B9 | C | A | — | — | C | A |
| Comparative example B10 | B | B | — | — | B | B |
| Comparative example B11 | D | A | — | — | D | A |

In Examples B1 to B10 in which $Y_0$ is 10 mgf/μm$^2$ or more and 400 mgf/μm$^2$ or less, $Y_{50}/Y_0$ is more than 0 and 0.5 or less, $\Delta Y_{0-20}$ is equal to or more than $Y_{20-50}$, θa is 1° or more, and Rz is 10 μm or less. In these Examples B1 to B10, further reduction of the friction of the contact portion is achieved and, during use of the photosensitive drums and the intermediate transfer belt, occurrence of slipping through and occurrence of the unusual sound, the stick-slip motion, and curling of the cleaning blade are suppressed.

Example C1

Step of Preparing First Composition

A reaction was caused between 299 parts of 4,4'-MDI and 767.5 parts of BA2600 at 80° C. for 3 hours to provide a first composition (prepolymer) containing a 7.2 mass % of a NCO group.

Step of Preparing Second Composition

To 300 parts of HA2000, 0.25 parts of ETA as a urethane-rubber synthesis catalyst was added. The resultant mixture was stirred at 60° C. for 1 hour to provide a second composition.

Step of Preparing Mixture

The first composition was heated to 80° C. To this first composition, the second composition heated to 60° C. was added and stirred to provide a mixture of the first composition and the second composition. The amount of polyol (number of moles) in this mixture relative to the number of moles of polyisocyanate in this mixture was 17 mol % (M(OH/NCO)). In this example, M(OH/NCO)=17 mol %.

Step of Obtaining Urethane-Rubber Cleaning Blade

A catalyst solution prepared by mixing 100 parts of ETA and 100 parts of ethanol was sprayed onto a spot of an inner surface of the mold for producing a cleaning blade. After that, the catalyst solution was spread by being wiped with a urethane-rubber blade over a portion (a surface corresponding to the contact portion of the cleaning blade) of the inner surface of the mold.

After that, the mold was heated to 110° C. A release agent was subsequently applied to a surface of the inner surfaces of the mold, the surface not coated with the catalyst solution. The mold was heated again to 110° C. and held at the temperature.

After that, the mixture was injected into the mold (within the cavity). The injected mixture was heated at 110° C. (molding temperature) for 30 minutes to undergo a curing reaction, and subsequently released from the mold to provide a urethane-rubber plate. The obtained urethane-rubber plate was cut with a cutter to form an edge portion. Thus, a urethane-rubber cleaning blade was obtained. The obtained cleaning blade had a thickness of 2 mm, a length of 20 mm, and a width of 345 mm.

The production conditions and M(OH/NCO) are described in Tables 9 and 10.

The obtained cleaning blade was subjected to the analytical measurement and the property evaluation. The results are described in FIGS. 14A and 14B and Table 11.

Figure 14A:
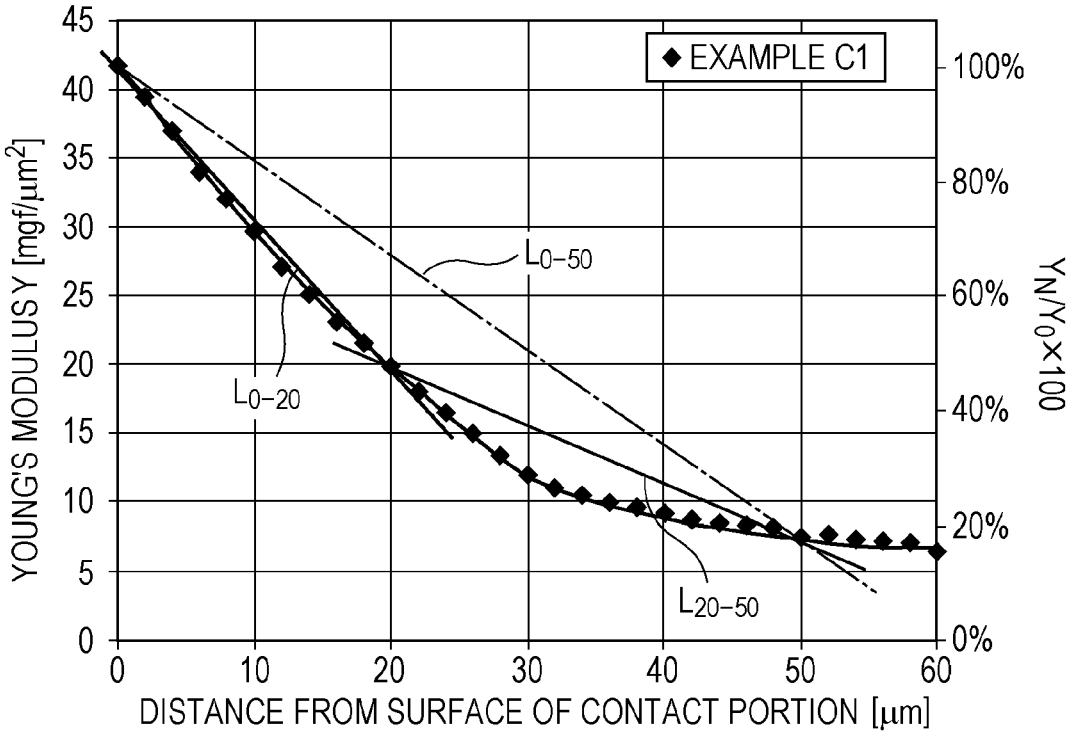
FIGS. 14A and 14B are graphs illustrating the relationship between Young's modulus and a distance from the surface of the contact portion of a cleaning blade in Example C1.
Figure 14B:
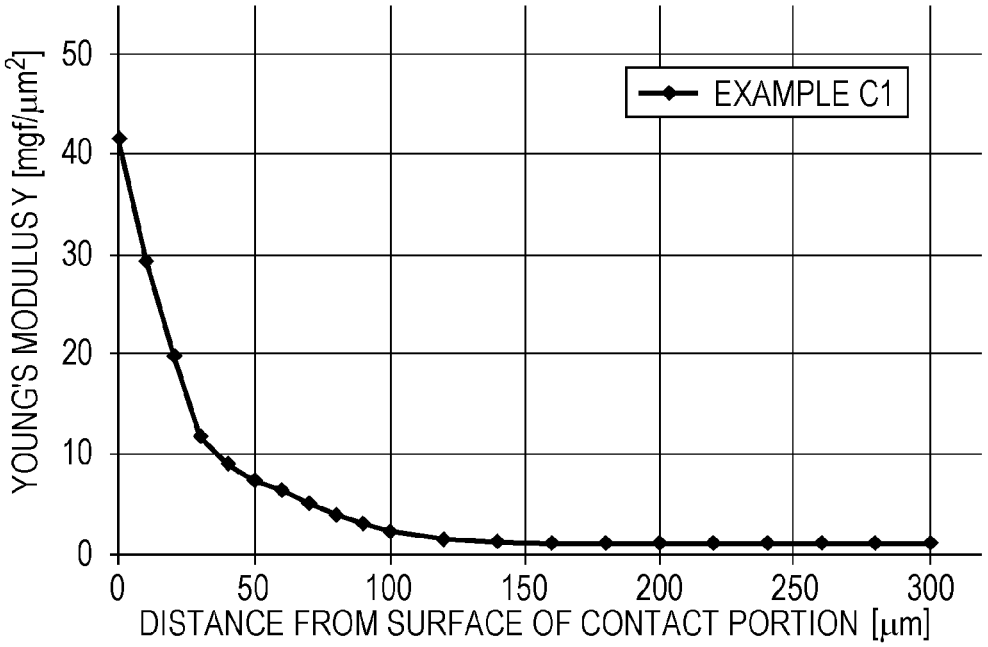

In FIG. 14A, a straight line connecting the Young's modulus $Y_0$ and the Young's modulus $Y_{50}$ is represented by a symbol $L_{0-50}$; a straight line connecting the Young's modulus $Y_0$ and the Young's modulus $Y_{20}$ is represented by a symbol $L_{0-20}$; and a straight line connecting the Young's modulus $Y_{20}$ and the Young's modulus $Y_{50}$ is represented by a symbol $L_{20-50}$.

Electrophotographic Apparatus

The cleaning blade obtained in the above-described manner was installed in the following electrophotographic apparatus and the cleaning performance of the cleaning blade and the rotational torque of the photosensitive drum were evaluated.

Figure 17:
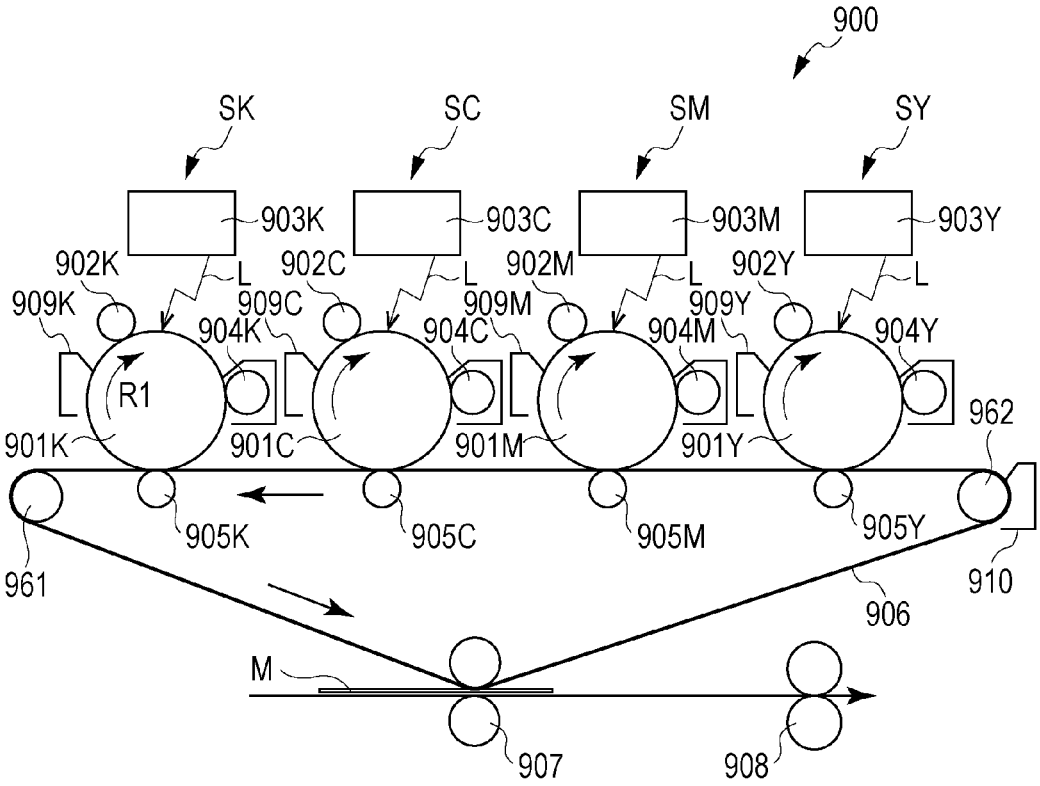
FIG. 17 illustrates the configuration of an electrophotographic apparatus.

The configuration of an electrophotographic apparatus used as an evaluation machine is illustrated in FIG. 17. An electrophotographic apparatus 900 is a tandem-type electrophotographic-process laser beam printer.

The electrophotographic apparatus 900 includes, as a plurality of image-forming units, first, second, third, and fourth image-forming sections (stations) SY, SM, SC, and SK. The first, second, third, and fourth image-forming sections SY, SM, SC, and SK respectively form individual color images that are yellow (Y), magenta (M), cyan (C), and black (K).

The image-forming sections SY, SM, SC, and SK are substantially the same in terms of configuration and operation except that toners of different colors are used. Accordingly, hereafter, unless these image-forming sections need to be separately specified, they will be collectively described with omitting the suffixes (Y, M, C, and K), which are attached to character or numerical references in FIG. 17 so as to indicate that the components are prepared for the specific colors.

The image-forming section S includes a photosensitive drum 901. The photosensitive drum 901 is driven to rotate in a direction (clockwise) indicated by arrow R1 in FIG. 17. The photosensitive drum 901 is surrounded by a contact charging member (charging roller) 902 serving as a charging unit, a laser beam scanner 903 serving as an image exposure unit, a development device 904 serving as a development unit, and a cleaning device 909 serving as a cleaning unit. An intermediate transfer belt 906 is disposed so as to be in contact with the photosensitive drum 901 of each image-forming section S. A primary transfer roller 905 is disposed so as to sandwich the intermediate transfer belt 906 between the primary transfer roller 905 and the photosensitive drum 901.

Hereinafter, an image-forming operation (image-forming method) will be described with reference to formation of a full-color image as an example.

First, the surface of the photosensitive drum 901 is uniformly charged with the charging roller 902 to a predetermined potential of a predetermined polarity (negative polarity in this Example). The photosensitive drum 901 rotates at a circumferential rate (surface movement speed) of 300 mm/s in the direction indicated by arrow R1 in FIG. 17. The circumferential rate of the photosensitive drum 901 corresponds to the process speed of the electrophotographic apparatus 900.

The charged surface of the photosensitive drum 901 is subjected to scanning exposure with laser beam L modulated in accordance with image signals and emitted from the laser beam scanner (image exposure device) 903. In the region irradiated with the laser beam, charges on the charged surface of the photosensitive drum 901 are dissipated. As a result, an electrostatic latent image is formed on the surface of the photosensitive drum 901.

The electrostatic latent image formed on the surface of the photosensitive drum 901 is developed with a toner contained in the development device 904 to form a toner image. In this Example, the development device 904 develops the electrostatic latent image on the surface of the photosensitive drum 901 by a reversal development process.

The toner images of the colors individually formed on the surfaces of the photosensitive drums 901 are, in a primary transfer section in which the primary transfer roller 905 and the photosensitive drum 901 face each other with the intermediate transfer belt 906 therebetween, transferred (primary transfer) by being stacked sequentially on the intermediate transfer belt 906. At this time, a primary transfer voltage of a polarity opposite to the normal charging polarity of the toners is applied to the primary transfer rollers 905.

The intermediate transfer belt 906 is driven to rotate by a driving roller 961. The stacked toner images of four colors on the surface of the intermediate transfer belt 906 are collectively electrostatically transferred, in a secondary transfer section 907, onto a transfer medium M such as a paper sheet.

The transfer medium M to which the toner images have been transferred is separated from the intermediate transfer belt 906 and transported to a fixing device (thermal roller fixing device) 908 serving as a fixing unit. The unfixed toner images on the transfer medium M are heated and pressed by the fixing device 908 to thereby be fixed on the transfer medium M.

After the primary transfer step, the toner (post-primary-transfer residual toner) that remains on the surface of the photosensitive drum 901 without being transferred to the intermediate transfer belt 906, is removed from the surface of the photosensitive drum 901 by the cleaning device 909 and collected. The specific configuration of the cleaning device will be described in Examples and Comparative examples. The photosensitive drum 901 from which the post-primary-transfer residual toner has been removed, is used again for image formation.

Finally, after the secondary transfer step, the toner (post-secondary-transfer residual toner) that remains on the surface of the intermediate transfer belt 906 without being transferred to the transfer medium M, is removed from the surface of the intermediate transfer belt 906 by an intermediate transfer belt cleaner 910 and collected.

Configuration of Cleaning Device

Figure 15A:
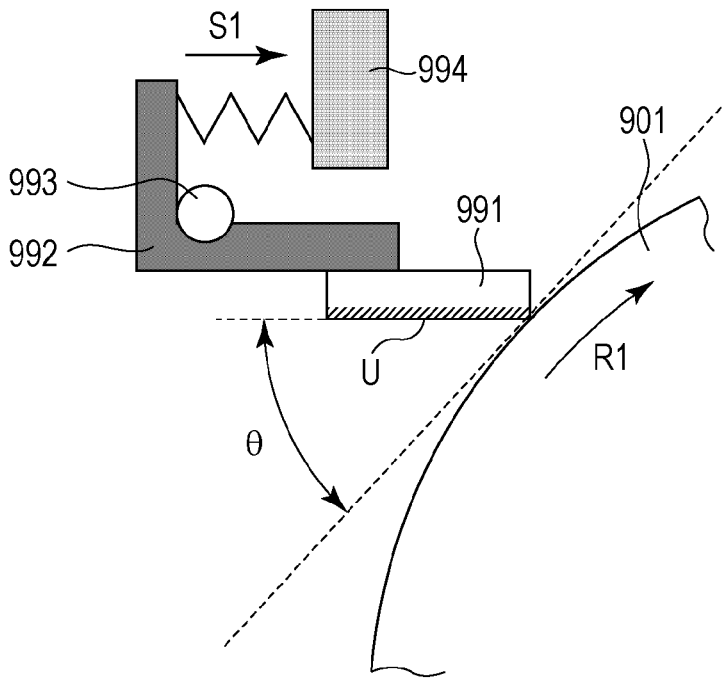
FIGS. 15A and 15B illustrate the configurations of cleaning devices in a "counter mode" and a "with mode".

FIG. 15A illustrates the configuration of a cleaning device in the "with mode". A cleaning blade 991 is in contact with the photosensitive drum 901 in the "with direction" such that the catalyst-coated surface U is in contact with the photosensitive drum 901. The angle formed in the contact portion between the surface U of the cleaning blade 991 and the tangential surface of the photosensitive drum 901 is defined as θ. In this Example, members of the cleaning device 909 were disposed such that θ=35°. A support member 992 is equipped with a rotation center 993 such that the support member 992 is freely rotatable around the rotation center 993. A fixed member 994 is fixed to a frame member (not shown) of the electrophotographic apparatus 900 and connected to the support member 992 via a spring S1. Thus, the spring S1 pulls the support member 992 toward the fixed member 994. Thus, the cleaning blade 991 is pressed to the surface of the photosensitive drum 901 with a constant load (linear pressure of 28 gf/cm). The cleaning blade was disposed so as to have a free length (length of a portion of the cleaning blade, the portion protruding forward beyond the support member 992) of 8 mm.

The angle β in FIG. 16B was estimated with a jig with which a cleaning blade is brought into contact with an unprocessed pipe having the same diameter as the photosensitive drum 901 in the same contact manner as in the cleaning device 909 and the contact state of the tip of the cleaning blade is observed in a section direction of the cleaning blade. The unprocessed pipe was formed of aluminum. This measurement was carried out by taking a section of the cleaning blade on a CCD camera while the unprocessed pipe was rotated. The angle β was measured at a position where a spherical particle having a diameter of 6 μm was in contact with both of the surface U of the cleaning blade and the surface of the photosensitive drum. Although the set angle θ=35°, the whole cleaning blade slightly bent toward the photosensitive drum 901 and, as a result, the angle β was 28°.

Evaluation Method

Three photosensitive drums having the same size as the photosensitive drum 901 for the electrophotographic apparatus 900 were prepared: a photosensitive drum (recessed photosensitive drum) that had recesses having a diameter of 40 μm and a depth of 2.5 μm and having an area ratio of 50% in the surface, a photosensitive drum (circumferentially streaked photosensitive drum) that had streaks having an Sm of 30 μm and a total height of profile of 2 μm and extending in the circumferential direction in the surface, and a photosensitive drum (smooth photosensitive drum) that had a smooth surface. These drums were individually mounted to the black station of the electrophotographic apparatus 900 and evaluations were carried out. For each photosensitive drum, a cleaning device in the "with mode" illustrated in FIG. 15A was disposed. An endurance test was carried out for 10000 paper sheets in a high-temperature high-humidity environment at 30° C./80% RH, without development, and at a charge-discharge current of −100 μA. During the endurance test, the cleaning blade was evaluated in terms of unusual sound (chatter), stick-slip motion, and curling. In a case where no unusual sound (chatter) occurred, the driving motor current for rotating the photosensitive drum was monitored and, on the basis of the value of the current, the magnitude of the rotational torque of the photosensitive drum was estimated.

Subsequently, in a low-temperature low-humidity environment at 15° C./10% RH, a solid image having a width of 50 mm and longitudinally extending across the surface of each photosensitive drum was developed with a toner in the black station. And the cleaning performance of the cleaning blade for the toner was evaluated. At this time, no transfer bias was applied for the black station and substantially the entire toner used for the development was made to reach the contact portion between the photosensitive drum and the cleaning blade. The developer used was a developer for a two-component color developer. The toner used was a spherical toner produced by a suspension polymerization method and having a median particle size of about 6 μm. To the toner particles, silica particles having a primary particle size of 20 nm were externally added such that 1 part of the silica particles were added relative to 100 parts of the toner particles. The toner deposition amount and the charging amount on the surface of the photosensitive drum during development of an entire solid image were measured by a blow off method and were respectively found to be 0.55 mg/cm$^2$ and −40 μC/g. After the entire solid image was developed, the toner on the surface of the photosensitive drum reached the contact portion and then the photosensitive drum was rotated one turn. After that, the rotation of the photosensitive drum was stopped and the state of the surface of the photosensitive drum and the cleaning blade were observed to evaluate the cleaning performance. The larger the angle β and the contact pressure the cleaning blade maintains and the higher the conformability of the cleaning blade to irregularities in the surface of the photosensitive drum, the better the evaluation result of the cleaning performance. The evaluation results are described in Table 12.

Incidentally, the evaluation systems are as follows.

Evaluation of Unusual Sound, Stick-Slip Motion, and Curling

AA: No occurrence of unusual sound, stick-slip motion, or curling of the cleaning blade; very low driving motor current (torque) for rotating the photosensitive drum A: No occurrence of unusual sound, stick-slip motion, or curling of the cleaning blade B: Occurrence of unusual sound sometimes at the time of stopping or starting of driving C: Occurrence of unusual sound at the time of stopping and starting of driving, or occurrence of unusual sound during driving D: Occurrence of unusual sound anytime or occurrence of curling Evaluation of Slipping Through A: No slipping through of toner B: Occurrence of slipping through of some toner, observed on the downstream surface (surface facing the surface of the photosensitive drum) of the cleaning blade (by observation of the cleaning blade)

C: Partial occurrence of streak-shaped slipping through of toner to a degree visually observed (by observation of the surface of the photosensitive drum)

D: Overall occurrence of slipping through of toner to a degree visually observed (by observation of the surface of the photosensitive drum)

The cleaning blade of Example C1 was found to have a Young's modulus $Y_0$ of 41.8 mgf/μm$^2$, $Y_{50}/Y_0$ of 0.18, and $Y_{20}/Y_0$ of 0.48. The gradients of $L_{0\text{-}20}$ and $L_{20\text{-}50}$ indicate $\Delta Y_{0\text{-}20} \leq \Delta Y_{20\text{-}50}$. In addition, the Young's modulus $Y_N$ is positioned below $L_{0\text{-}50}$, that is, the profile of changes in the Young's modulus in the direction from the surface to the inside of the contact portion is convex downward. Incidentally, $I_{SI}/I_{SE}$ was found to be 0.50.

Example C2

Figure 18A:
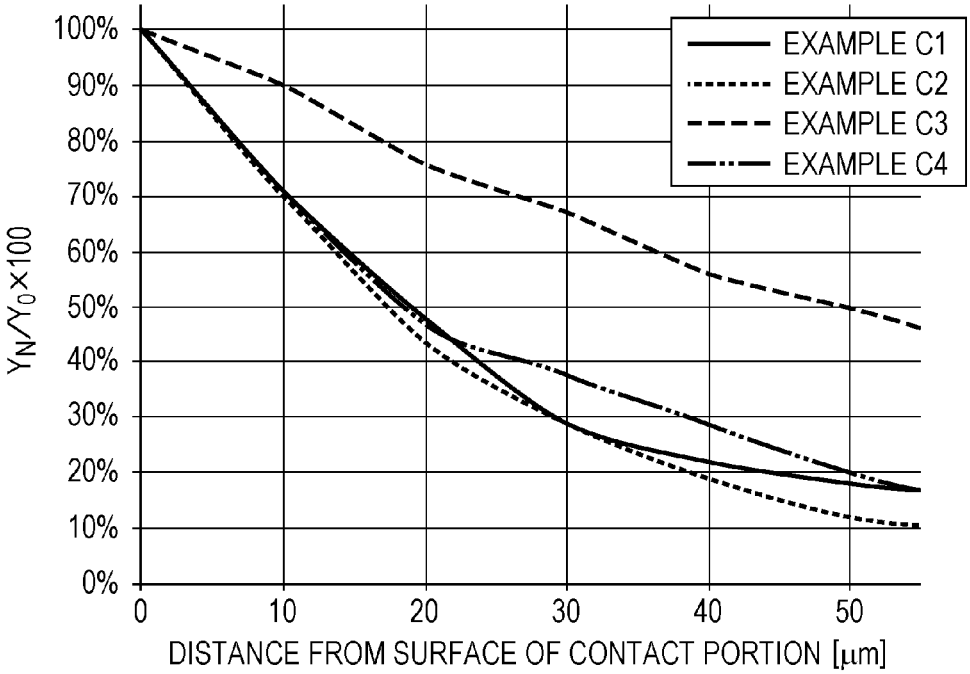
FIG. 18A is a graph illustrating changes in Young's moduli starting from the surfaces of cleaning blades in Examples C1 to C4.

A cleaning blade was produced and subjected to the analytical measurement and the property evaluation as in Example C1 except that 100 parts of ETA used for preparation of the catalyst solution applied to the inner surface of the mold in Example C1 was changed to 100 parts of the compound represented by the above-described formula (D) (product name: DABCO-TMR, manufactured by Sankyo Air Products Co., Ltd.), and the molding temperature was changed from 110° C. to 80° C. The production conditions and M(OH/NCO) are described in Tables 9 and 10, and the results of the analytical measurement and the property evaluation are described in FIG. 18A and Tables 11 and 12.

Example C3

A cleaning blade was produced and subjected to the analytical measurement and the property evaluation as in Example C1 except that the amount of HA2000 in the Step of preparing second composition was changed from 300 parts in Example C1 to 360 parts; and 100 parts of ETA used for preparation of the catalyst solution applied to the inner surface of the mold was changed to 100 parts of $CH_3COOK$ (product name: POLYCAT46, manufactured by Air Products and Chemicals, Inc.). The production conditions and M(OH/NCO) are described in Tables 9 and 10, and the results of the analytical measurement and the property evaluation are described in FIG. 18A and Tables 11 and 12.

Example C4

A cleaning blade was produced and subjected to the analytical measurement and the property evaluation as in Example C1 except that the amount of HA2000 in the Step of preparing second composition was changed from 300 parts in Example C1 to 218.5 parts; 100 parts of ETA used for preparation of the catalyst solution applied to the inner surface of the mold was changed to 100 parts of UCAT-18X (product name); and the molding temperature was changed from 110° C. to 100° C. The production conditions and M(OH/NCO) are described in Tables 9 and 10, and the results of the analytical measurement and the property evaluation are described in FIG. 18A and Tables 11 and 12.

Example C5

The evaluations were carried out as in Example C1 except that the positions of members of the cleaning device were adjusted such that the set angle θ of the cleaning blade was 50°.

Examples C6 to C9

The cleaning blade of each of Examples C1 to C4 was evaluated as in Example C1 except that the positions of members of the cleaning device were adjusted such that the set angle □□ of the cleaning blade was 75°.

Examples C10 to C13

Figure 15B:
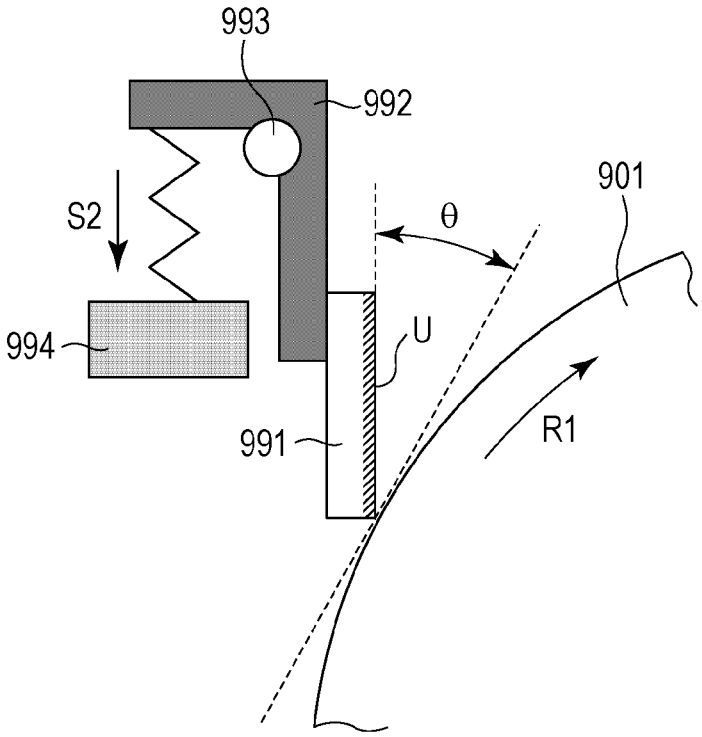

The cleaning blade of each of Examples C1 to C4 was evaluated as in Example C1 except that the cleaning blade was in contact with a photosensitive drum in a "counter direction". FIG. 15B illustrates the configuration of a cleaning device in the "counter mode". A cleaning blade 991 is in contact with a photosensitive drum 901 in the "counter direction" such that a surface U is in contact with the photosensitive drum 901. The angle formed between the surface U and the tangential line passing the contact point between the cleaning blade and the photosensitive drum 901 is defined as θ. In these Examples, θ was set to 22°. A support member 992 is equipped with a rotation center 993 such that the support member 992 is freely rotatable around the rotation center 993. A fixed member 994 is fixed to a frame member (not shown) of the electrophotographic apparatus 900 and connected to the support member 992 via a spring S2. Thus, the spring S2 pulls the support member 992 toward the fixed member 994. Thus, the cleaning blade 991 is pressed to the surface of the photosensitive drum 901 with a constant load (linear pressure of 28 gf/cm). The cleaning blade was disposed so as to have a free length of 8 mm.

Comparative Example C1

Figure 18B:
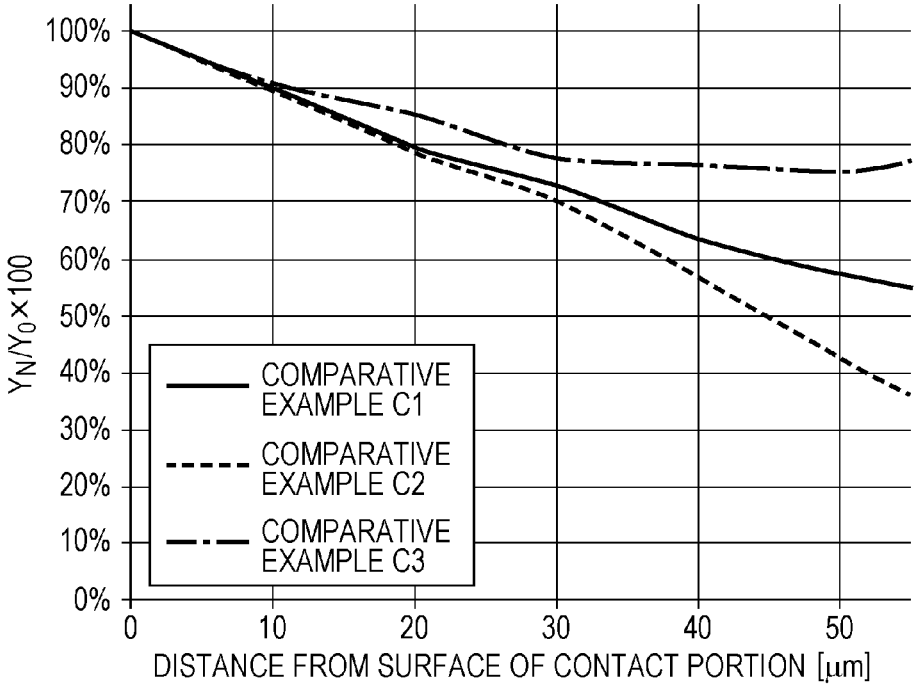
FIG. 18B is a graph illustrating changes in Young's moduli starting from the surfaces of cleaning blades in Comparative examples C1 to C3.

A cleaning blade was produced and subjected to the analytical measurement and the property evaluation as in Example C1 except that the amount of HA2000 in the Step of preparing second composition was changed from 300 parts in Example C1 to 500 parts, and the molding temperature was changed from 110° C. to 140° C. The production conditions and M(OH/NCO) are described in Tables 9 and 10, and the results of the analytical measurement and the property evaluation are described in FIG. 18B and Tables 11 and 12.

Comparative Example C2

A cleaning blade was produced and subjected to the analytical measurement and the property evaluation as in Example C1 except that the amount of 4,4'-MDI in the Step of preparing first composition was changed from 299 parts in Example C1 to 350 parts; the amount of BA2600 was changed from 767.5 parts to 860 parts; the amount of HA2000 in the Step of preparing second composition was changed from 300 parts to 150 parts; and 100 parts of ETA used for preparation of the catalyst solution applied to the inner surface of the mold was changed to 100 parts of UCAT-18X (product name). The production conditions and M(OH/NCO) are described in Tables 9 and 10, and the results of the analytical measurement and the property evaluation are described in FIG. 18B and Tables 11 and 12.

Comparative Example C3

A cleaning blade was produced as in Example C1 except that the catalyst solution was not applied to the inner surface of the mold. Subsequently, the produced cleaning blade was immersed into 4,4'-MDI heated to 80° C. for 30 minutes and withdrawn. After that, 4,4'-MDI adhering to the surface of the cleaning blade was wiped off with ethanol. After that, the cleaning blade was left in a high-humidity environment at 25° C./90% RH for 2 days, to hydrolyze 4,4'-MDI not being wiped off and having impregnated into the surface of the cleaning blade. Thus, the cleaning blade of Comparative example C3 was obtained. The production conditions and M(OH/NCO) are described in Tables 9 and 10, and the results of the analytical measurement and the property evaluation are described in FIG. 18B and Tables 11 and 12.

Comparative Examples C4 to C6

The cleaning blade of each of Comparative examples C1 to C3 was evaluated as in Examples C6 to C9 except that the positions of members of the cleaning device were adjusted such that the set angle θ of the cleaning blade was 75°.

In Examples C1 to C9, the cleaning blades of Examples C1 to C4 in which $Y_0$ is 10 mgf/μm$^2$ or more and 400 mgf/μm$^2$ or less, $Y_{50}/Y_0$ is more than 0 and 0.5 or less, and $\Delta Y_{0\text{-}20}$ is equal to or more than $\Delta Y_{20\text{-}50}$, are used in the "with contact". In these Examples C1 to C9, the photosensitive drums used are rotated at a low torque and slipping through is suppressed. In particular, the cleaning blades of Examples C1, C2, and C4 having $Y_0$ of 40 mgf/μm$^2$ or more and 400 mgf/μm$^2$ or less provide good results. By setting the angle β to 40° or more (40° or more and less than 90°), better results are provided. As described above, the larger the angle β, the more suppressed the slipping through of spherical toner. In the "with contact" in which the surface C is in contact with the photosensitive drum, from the standpoint of the accuracy of the contact position and bending of the blade, the set angle θ can be 75° or less and the angle β can be 70° or less. When the angle β is 70° or less, in FIG. 15A, it is suppressed that the cleaning blade 991 slides over the surface of the photosensitive drum 901 and rotates clockwise around the rotation center 993 in FIG. 15A to cause separation (no contact) between the cleaning blade 991 and the photosensitive drum 901.

TABLE 9

| Cleaning blade | (i) First composition: Poly isocyanate | | Polyol | | (ii) Second composition: Polyol | | Urethane-rubber synthesis catalyst | | M(OH/NCO) [mol %] in mixture of (i) and (ii) |
|---|---|---|---|---|---|---|---|---|---|
| Example C1 | 4,4'-MDI | 299 parts | BA2600 | 767.5 parts | HA2000 | 300 parts | ETA | 0.25 parts | 17 |
| Example C2 | 4,4'-MDI | 299 parts | BA2600 | 767.5 parts | HA2000 | 300 parts | ETA | 0.25 parts | 17 |
| Example C3 | 4,4'-MDI | 299 parts | BA2600 | 767.5 parts | HA2000 | 300 parts | ETA | 0.25 parts | 20 |
| Example C4 | 4,4'-MDI | 299 parts | BA2600 | 767.5 parts | HA2000 | 360 parts | ETA | 0.25 parts | 12 |
| Comparative example C1 | 4,4'-MDI | 299 parts | BA2600 | 767.5 parts | HA2000 | 500 parts | ETA | 0.25 parts | 28 |
| Comparative example C2 | 4,4'-MDI | 350 parts | BA2600 | 860 parts | HA2000 | 150 parts | ETA | 0.25 parts | 7 |
| Comparative example C3 | 4,4'-MDI | 299 parts | BA2600 | 767.5 parts | HA2000 | 300 parts | ETA | 0.25 parts | 17 |

TABLE 10

| Cleaning blade | Catalyst solution | | | Molding temperature [° C.] |
|---|---|---|---|---|
| Example C1 | Ethanol<br>ETA | 100 parts<br>100 parts | Applied to inner surface of mold | 110 |
| Example C2 | Ethanol<br>DABCO-TMR | 100 parts<br>100 parts | Applied to inner surface of mold | 80 |
| Example C3 | Ethanol<br>POLYCAT46 | 100 parts<br>100 parts | Applied to inner surface of mold | 110 |
| Example C4 | Ethanol<br>UCAT-18X | 100 parts<br>100 parts | Applied to inner surface of mold | 100 |
| Comparative example C1 | Ethanol<br>ETA | 100 parts<br>100 parts | Applied to inner surface of mold | 140 |
| Comparative example C2 | Ethanol<br>UCAT-18X | 100 parts<br>100 parts | Applied to inner surface of mold | 110 |
| Comparative example C3 | — | — | — | 110 |

TABLE 11

| | Young's modulus | | | | | | | | |
|---|---|---|---|---|---|---|---|---|---|
| | $Y_0$ [mgf/μm$^2$] | $Y_{20}$ [mgf/μm$^2$] | $Y_{50}$ [mgf/μm$^2$] | $Y_{50}/Y_0$ | $Y_{20}/Y_0$ | $\Delta Y_0$-$Y_{20}$ | $\Delta Y_{20\text{-}50}$ | $Y_N$ is below $L_{0\text{-}50}$ ? | $I_{SI}/I_{SE}$ |
| Example C1 | 42 | 20 | 8 | 0.2 | 0.5 | 0.03 | 0.01 | Below | 0.50 |
| Example C2 | 250 | 110 | 31 | 0.1 | 0.4 | 0.03 | 0.01 | Below | 1.20 |
| Example C3 | 10 | 8 | 5 | 0.5 | 0.8 | 0.01 | 0.01 | Above | 0.61 |
| Example C4 | 400 | 189 | 78 | 0.2 | 0.5 | 0.03 | 0.01 | Below | 1.55 |
| Comparative example C1 | 6 | 5 | 3 | 0.5 | 0.8 | 0.01 | 0.01 | Above | 0.49 |
| Comparative example C2 | 457 | 360 | 194 | 0.4 | 0.8 | 0.01 | 0.01 | Above | 1.90 |
| Comparative example C3 | 11 | 8.9 | 8 | 0.7 | 0.8 | 0.01 | 0.00 | Above | 0.12 |

TABLE 12

| | | | | | Recessed photosensitive drum | | Circumferentially streaked photosensitive drum | | Smooth photosensitive drum | |
|---|---|---|---|---|---|---|---|---|---|---|
| | Cleaning blade | Contact direction | Set angle [°] | Angle β [°] | Slipping through | Stick-slip motion and curling | Slipping through | Stick-slip motion and curling | Slipping through | Stick-slip motion and curling |
| Example C1 | Example C1 | With | 35 | 28 | B | AA | B | AA | B | AA |
| Example C2 | Example C2 | | 35 | 30 | B | AA | A | AA | A | AA |

TABLE 12-continued

| | | | | | Recessed photosensitive drum | | Circumferentially streaked photosensitive drum | | Smooth photosensitive drum | |
|---|---|---|---|---|---|---|---|---|---|---|
| | Cleaning blade | Contact direction | Set angle [°] | Angle β [°] | Slipping through | Stick-slip motion and curling | Slipping through | Stick-slip motion and curling | Slipping through | Stick-slip motion and curling |
| Example C3 | Example C3 | | 35 | 25 | B | A | B | A | B | A |
| Example C4 | Example C4 | | 35 | 31 | B | AA | A | AA | A | AA |
| Example C5 | Example C1 | | 50 | 43 | A | AA | A | AA | A | AA |
| Example C6 | Example C1 | | 75 | 68 | A | AA | A | AA | A | AA |
| Example C7 | Example C2 | | 75 | 70 | A | AA | A | AA | A | AA |
| Example C8 | Example C3 | | 75 | 64 | B | A | B | AA | A | AA |
| Example C9 | Example C4 | | 75 | 70 | A | AA | A | AA | A | AA |
| Example C10 | Example C1 | Counter | 22 | — | A | A | A | A | A | A |
| Example C11 | Example C2 | | 22 | — | A | A | A | A | A | A |
| Example C12 | Example C3 | | 22 | — | A | B | A | B | A | A |
| Example C13 | Example C4 | | 22 | — | A | A | A | A | A | A |
| Comparative example C1 | Comparative example C1 | With | 35 | 5 | D | B | D | B | D | B |
| Comparative example C2 | Comparative example C2 | | 35 | 32 | C | AA | B | AA | B | AA |
| Comparative example C3 | Comparative example C3 | | 35 | 15 | D | B | D | A | C | A |
| Comparative example C4 | Comparative example C1 | | 75 | 43 | D | B | C | A | C | A |
| Comparative example C5 | Comparative example C2 | | 75 | 72 | C | AA | B | AA | A | AA |
| Comparative example C6 | Comparative example C3 | | 75 | 57 | C | A | C | A | B | A |

In these Examples, cleaning devices of a constant-load mode using spring pressure application are used. Alternatively, advantages according to an embodiment of the present invention are still provided by, without using any pressure spring, employing a constant displacement mode in which the support member 992 and the photosensitive drum 901 are fixed at a relative position. The constant displacement mode is advantageous in that the installed space can be reduced, compared with the constant-load mode. In addition, the above-described no-contact phenomenon tends not to occur, so that the set angle θ and the angle β are easily increased. However, the constant-load mode is advantageous in that fluctuations of the contact load of the cleaning blade due to eccentricity of a photosensitive drum or bending of the frame member tend not to occur.

In addition, an auxiliary unit may be disposed, the auxiliary unit scraping out the toner having been scraped off by the cleaning blade from the surface of the photosensitive drum and having deposited on upstream of the contact portion between the photosensitive drum and the cleaning blade. The auxiliary unit may be, for example, a conductive fur brush or spongy roller disposed so as to be in light contact with the photosensitive drum and rotated in synchronization with the rotation of the photosensitive drum.

Example C14

The cleaning blade of Example C1 was subjected to a test of cleaning toner off from the surface of an intermediate transfer belt.

In order to evaluate the cleaning performance, two polyimide intermediate transfer belts were prepared: an intermediate transfer belt (hereafter also referred to as a "circumferentially streaked intermediate transfer belt") that had, in the surface, streaks having an Sm of 30 μm and a total height of profile of 2 μm and extending in the circumferential direction; and an intermediate transfer belt having a smooth surface (hereafter also referred to as a "smooth intermediate transfer belt"). These belts were mounted to the electrophotographic apparatus 900 and evaluations were carried out. For each of the intermediate transfer belts, an intermediate-transfer-belt cleaner 910 was attached. The configuration of the intermediate-transfer-belt cleaner 910 was the same as that of Example C1 (the configuration in FIG. 15A) except for a member (not shown) for attaching the cleaner to the intermediate transfer belt. The set angle θ was 30°. The tip of the cleaning blade was in contact with the front surface of the intermediate transfer belt at a position where the back surface (surface not carrying any toner image) of the intermediate transfer belt was in contact with a counter roller 962. An endurance test was carried out for 10000 paper sheets in a high-temperature high-humidity environment at 30° C./80% RH, without image formation, at a primary transfer current (current being passed to the transfer roller 905) of 40 μA, and at a secondary transfer current (current being passed to a secondary transfer section 907) of 80 μA. During the endurance test, the cleaning blade was evaluated in terms of unusual sound (chatter), stick-slip motion, and curling. In a case where no unusual sound (chatter) occurred, the current of a motor driving a driving roller 961 for rotating the intermediate transfer belt was monitored and, on the basis of the value of this current, the magnitude of the rotational torque of the intermediate transfer belt was estimated.

Subsequently, in a low-temperature low-humidity environment at 15° C./10% RH, a solid image having a width of 50 mm was transferred so as to longitudinally extend across the surface of the intermediate transfer belt. And the cleaning performance of the intermediate-transfer-belt cleaner 910 for the solid image was evaluated. At this time, no transfer bias was applied to the secondary transfer section, to thereby maximize the amount of the toner on the surface of the intermediate transfer belt reaching the contact portion between the intermediate transfer belt and the cleaning blade. The type of the toner, the amount of the toner deposited, and the amount of charging were the same as in Example C1. After the toner on the surface of the intermediate transfer belt reached the intermediate-transfer-belt cleaner 910, the intermediate transfer belt was rotated a half turn. After that, the rotation of the intermediate transfer belt was stopped, and the state of the surface of the intermediate transfer belt and the cleaning blade were observed to evaluate the cleaning performance. The larger the angle β and the contact pressure the cleaning blade maintains and the higher the conformability of the cleaning blade to irregularities in the surface of the intermediate transfer belt, the better the evaluation result of the cleaning performance. The evaluation results are described in Table 13. The evaluation systems are the same as in Example C1.

Examples C15 to C17

The cleaning blades of Examples C2, C3, and C4 were used and evaluations were carried out as in Example C14.

Example C18

The evaluation was carried out as in Example C14 except that the positions of members of the cleaning device were adjusted such that the set angle θ of the cleaning blade was 50°.

Examples C19 to C22

The cleaning blade of each of Examples C1 to C4 was evaluated as in Example C14 except that the positions of members of the cleaning device were adjusted such that the set angle θ of the cleaning blade was 75°.

Examples C23 to C26

The cleaning blades of Examples C1 to C4 were disposed so as to be in contact with the intermediate transfer belts in the "counter direction" and evaluated as in Example C14. The configuration of the intermediate-transfer-belt cleaner 910 during the "counter contact" was the same as that of Example C10 (the configuration illustrated in FIG. 15B).

Comparative Examples C7 to C9

The cleaning blades of Comparative examples C1 to C3 were evaluated as in Example C14.

Comparative Examples C10 to C12

The cleaning blades of Comparative examples C1 to C3 were evaluated as in Example C14 except that the set angle θ was set to 75°.

In Examples C14 to C22 in which the cleaning blades of Examples C1 to C4 are used in the "with mode", the intermediate transfer belts used are rotated at a low torque and slipping through is suppressed. In particular, the cleaning blades of Examples C1, C2, and C4 having $Y_0$ of 40 mgf/μm$^2$ or more and 400 mgf/μm$^2$ or less provide good results. By setting the angle β to 40° or more, better results are provided.

TABLE 13

| | | | | | Circumferentially streaked intermediate transfer belt | | Smooth intermediate transfer belt | |
|---|---|---|---|---|---|---|---|---|
| | Cleaning blade | Contact direction | Set angle [°] | Angle β [°] | Slipping through | Stick-slip motion and curling | Slipping through | Stick-slip motion and curling |
| Example C14 | Example C1 | With | 30 | 28 | B | AA | B | AA |
| Example C15 | Example C2 | | 30 | 30 | B | AA | A | AA |
| Example C16 | Example C3 | | 30 | 25 | B | A | B | A |
| Example C17 | Example C4 | | 30 | 31 | B | AA | B | AA |
| Example C18 | Example C1 | | 50 | 43 | A | AA | A | AA |
| Example C19 | Example C1 | | 75 | 68 | A | AA | A | AA |
| Example C20 | Example C2 | | 75 | 70 | A | AA | A | AA |
| Example C21 | Example C3 | | 75 | 64 | B | A | B | A |
| Example C22 | Example C4 | | 75 | 70 | A | AA | A | AA |
| Example C23 | Example C1 | Counter | 22 | — | A | A | A | A |
| Example C24 | Example C2 | | 22 | — | A | A | A | A |
| Example C25 | Example C3 | | 22 | — | A | B | A | A |
| Example C26 | Example C4 | | 22 | — | A | A | A | A |
| Comparative example C7 | Comparative example C1 | With | 30 | 5 | D | B | D | B |
| Comparative example C8 | Comparative example C2 | | 30 | 32 | C | AA | B | AA |
| Comparative example C9 | Comparative example C3 | | 30 | 15 | D | B | C | A |
| Comparative example C10 | Comparative example C1 | | 75 | 43 | D | B | C | A |
| Comparative example C11 | Comparative example C2 | | 75 | 72 | C | AA | A | AA |
| Comparative example C12 | Comparative example C3 | | 75 | 57 | C | A | C | A |

First Embodiment

Figure 19:
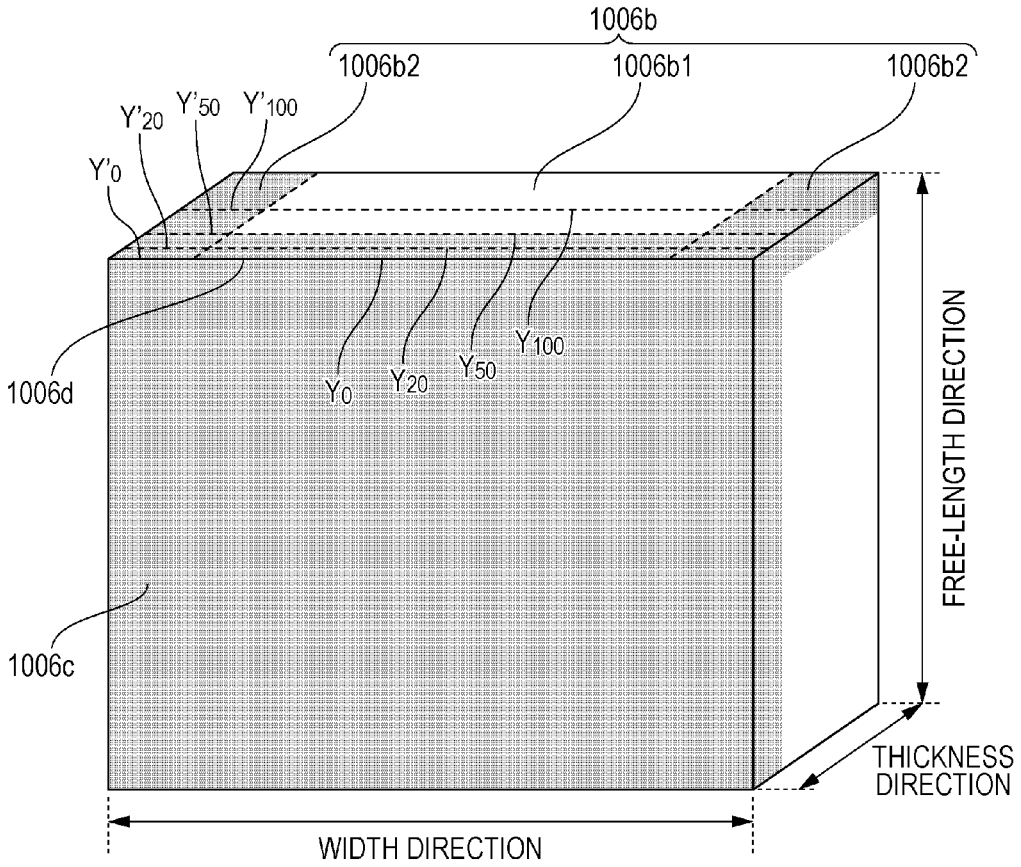
FIG. 19 illustrates a cleaning blade according to a first embodiment.
Figure 22A:
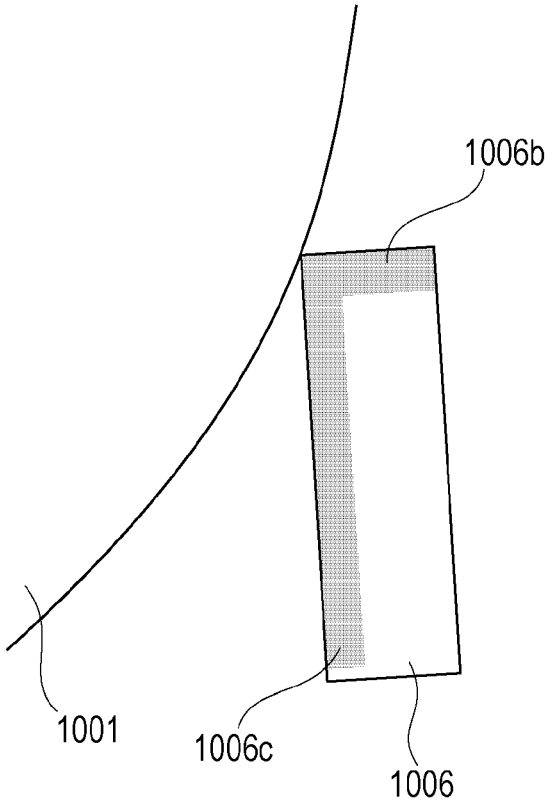
FIG. 22A illustrates the unworn contact portion of a cleaning blade according to a first embodiment.
Figure 22B:
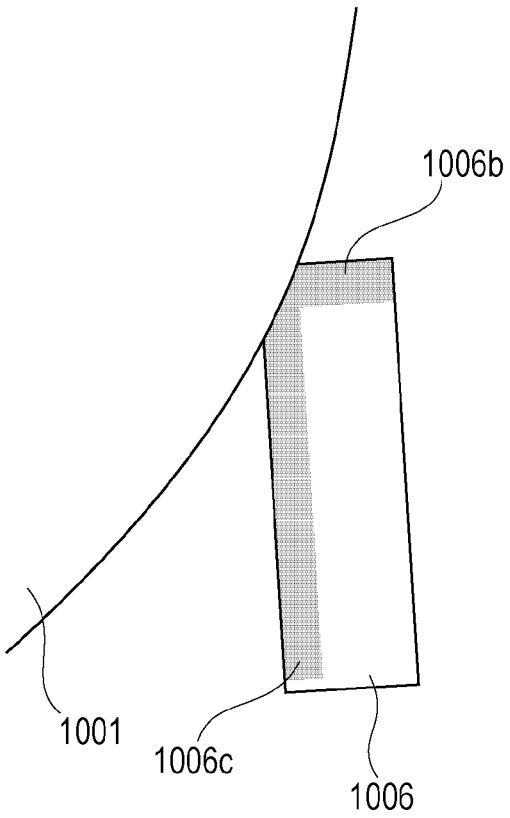
FIG. 22B illustrates the worn contact portion of the cleaning blade according to the first embodiment.

A cleaning blade 1006 according to this embodiment is illustrated in FIGS. 19, 22A, and 22B. The cleaning blade 1006 according to this embodiment is a urethane-rubber cleaning blade.

As illustrated in FIGS. 19, 22A, and 22B, the cleaning blade 1006 has a first contact surface (first surface) 1006*c* extending in the free-length direction of the cleaning blade 1006. The cleaning blade 1006 also has a second contact surface (second surface) 1006*b* extending in the thickness direction of the cleaning blade 1006. The cleaning blade 1006 also has an edge portion 1006*d* formed by the edge line between the first contact surface 1006*c* and the second contact surface 1006*b*. The cleaning blade 1006 is disposed such that a contact portion including the edge portion 1006*d* is in contact with a photosensitive drum 1001.

Curing Treatment for Image-Forming Region

In this embodiment, in the contact portion (in contact with the photosensitive drum 1001) of the first contact surface 1006*c*, both of a region corresponding to an image-forming region and a region corresponding to a non-image-forming region are subjected to the curing treatment described in Examples A to C. In this way, reduction in friction and enhancement of conformability of the cleaning blade are achieved.

First, a blade curing treatment in the image-forming region in this embodiment will be described. In the width direction of the cleaning blade 1006, in the region corresponding to the image-forming region, a Young's modulus at a position separated by a distance of L μm from the surface of the first contact surface 1006*c* is defined as $Yc_L$. In this embodiment, in the case of L=0, that is, the Young's modulus $Yc_0$ of the surface of the first contact surface 1006*c* is 15 mgf/μm$^2$ or more and 400 mgf/μm$^2$ or less. The ratio $Yc_{50}/Yc_0$ of a Young's modulus $Yc_{50}$ separated by a distance of 50 μm from the first contact surface 1006*c* to the Young's modulus $Yc_0$ is more than 0 and 0.5 or less.

In the width direction of the cleaning blade 1006, in the region corresponding to the image-forming region, the average rate of change of the Young's modulus from the first contact surface 1006*c* to a position 20 μm inside is defined as $[\{(Yc_0-Yc_{20})/Yc_0\}/(20-0)]$. In the width direction of the cleaning blade 1006, in the region corresponding to the image-forming region, the average rate of change of the Young's modulus from the position 20 μm inside to the position 50 μm inside is defined as $[\{(Yc_{20}-Yc_{50})/Yc_0\}/(50-20)]$. At this time, $[\{(Yc_0-Yc_{20})/Y_0\}/(20-0)]$ is equal to or more than $[\{(Yc_{20}-Yc_{50})/Yc_0\}/(50-20)]$.

In this embodiment, in the surface of the second contact surface 1006*b*, a Young's modulus at a position separated by a distance of L μm from the edge portion 1006*d* is defined as $Y_L$; as a result of the curing treatment, the Young's modulus $Y_0$ is 15 mgf/μm$^2$ or more and 400 mgf/μm$^2$ or less. In the image-forming region in the surface of the second contact surface 1006*b*, the ratio $Y_{50}/Y_0$ of a Young's modulus $Y_{50}$ at a position separated by a distance of 50 μm from the edge portion 1006*d* to the Young's modulus $Y_0$ of the edge portion 1006*d* is more than 0 and 0.5 or less.

In the image-forming region in the surface of the second contact surface 1006*b*, the average rate of change of the Young's modulus from the edge portion 1006*d* to a position 20 μm separated is equal to or more than the average rate of change of the Young's modulus from the position 20 μm separated to a position 50 μm separated from the edge portion 1006*d*.

As a result, while the conformability of the cleaning blade in the image-forming region is enhanced, reduction in friction can be achieved.

Curing Treatment for Non-Image-Forming Region

A curing treatment for end portions (non-image-forming region) of a cleaning blade, the curing treatment being a feature according to an embodiment of the present invention, will be described.

Before the explanation of the end-portion curing treatment, wear of the blade will be described.

Figure 20A:
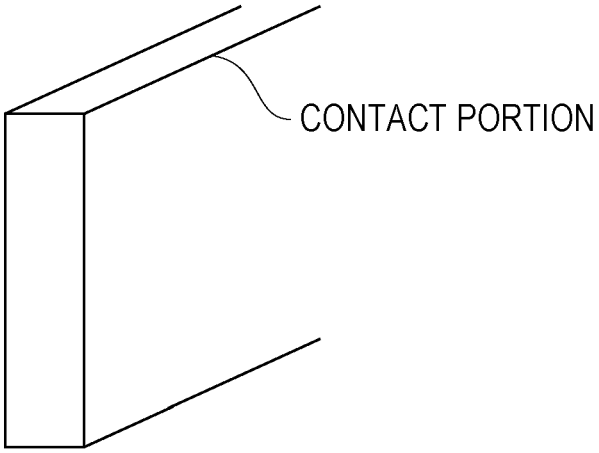
FIG. 20A is an explanatory view of the unworn contact portion of a cleaning blade.
Figure 20B:
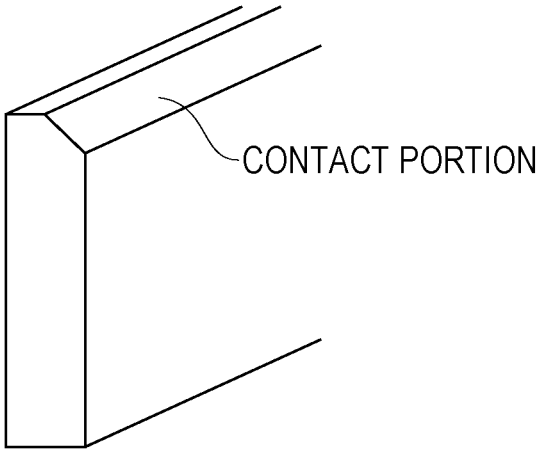
FIG. 20B is an explanatory view of the worn contact portion of the cleaning blade.

FIGS. 20A and 20B are perspective views of a cleaning blade 1006 in this embodiment. FIG. 20A illustrates the blade that is not used while FIG. 20B illustrates the blade that has been used for an arbitrary period. Studies on the blade have revealed that, as illustrated in FIG. 20B, the contact portion (edge portion) wears with usage time so as to form a flat surface.

It has been found that this wear of the blade edge is promoted in the end region where the toner serving as a lubricant between the blade and the image-carrying member is deficient. Specifically, it has been found that, while the amount of wear is about 40 μm in the image region where the toner is sufficiently supplied, the amount of wear is about 100 μm in the non-image regions in the end portions. As a result, portions having a low Young's modulus are exposed from the end portions of the blade, resulting in an increase in the frictional force in the end portions of the blade. As a result, blade curling starting from the end portions of the blade tends to occur.

For this reason, the following curing treatment is carried out in this embodiment. As described above, in the surface of the first contact surface 1006*c* provided in the free-length direction of the cleaning blade 1006, both of the image-forming region and the non-image-forming region are subjected to the same curing treatment as in Examples A to C. In addition, in order to suppress wear of the end portions of the blade, in this embodiment, portions of the second contact surface 1006*b* provided in the thickness direction of the cleaning blade 1006, the portions corresponding to the non-image-forming region, are also subjected to the curing treatment.

As a result, in the image-forming region, the curing treatment for the first contact surface 1006*c* allows enhancement of the conformability and reduction in friction of the blade. In addition, in the non-image-forming region, both of the first contact surface 1006*c* and the second contact surface 1006*b* are subjected to the curing treatment, so that, while an increase in the frictional force due to wear of the blade surface is suppressed, reduction in the friction of the blade surface and suppression of degradation of the conformability of the blade can be achieved. As a result, while a high cleaning performance is maintained over the entire region in the blade longitudinal direction, curling of the end portions of the blade can be suppressed.

Here, the advantage of subjecting, among the non-image-forming region, the second contact surface 1006*b* to the curing treatment will be described. As illustrated in FIG. 13A, in a case where the cleaning blade is brought into contact with the photosensitive drum in the "counter mode", of the contact surfaces of the cleaning blade, the second contact surface 1006*b* provided upstream in the rotation direction of the photosensitive drum more strongly contacts the photosensitive drum than the first contact surface 1006*c*. Thus, after the end portions of the blade wear, not the surface of the first contact surface but the surface of the second contact surface is the dominant cause for the occurrence of curling of the end portions of the blade. Accordingly, in this embodiment, the end portions of the second contact surface 1006*b* are subjected to the curing treatment, to thereby suppress the occurrence of curling of the end portions of the blade.

Specifically, in this embodiment, as illustrated in FIG. 19, in the cleaning blade 1006, the second contact surface 1006*b* in contact with the photosensitive drum 1001 at an upstream position in the rotation direction of the photosensitive drum is also subjected to the curing treatment. Incidentally, the second contact surface 1006*b* has, in the blade width direction, a first region 1006*b*1 corresponding to the image-forming region, and a second region 1006*b*2 corresponding to the non-image-forming region. In this embodiment, in the second contact surface 1006*b*, only the second region 1006*b*2 corresponding to the non-image-forming region is subjected to the curing treatment (the hatched region in FIG. 19).

Production Method

A specific production method will be described. In this embodiment, a catalyst solution for subjecting the cleaning blade 1006 to the curing treatment during molding of the blade is applied to the mold in advance. In this embodiment, the catalyst solution is applied to portions of the mold that correspond to both of the image-forming region and the non-image-forming region of the first contact surface 1006*c* in the blade width direction. In order to apply the solution to at least the region corresponding to the contact portion for the photosensitive drum, the region of the first contact surface to which the solution is applied is defined as a region extending 100 μm or more from the edge portion 1006*d*. In this embodiment, the catalyst solution is applied to the entire region of the first contact surface 1006*c*. Alternatively, the catalyst solution may be applied only to the contact portion in contact with the photosensitive drum 1001 and a portion near the contact portion.

Figure 23:
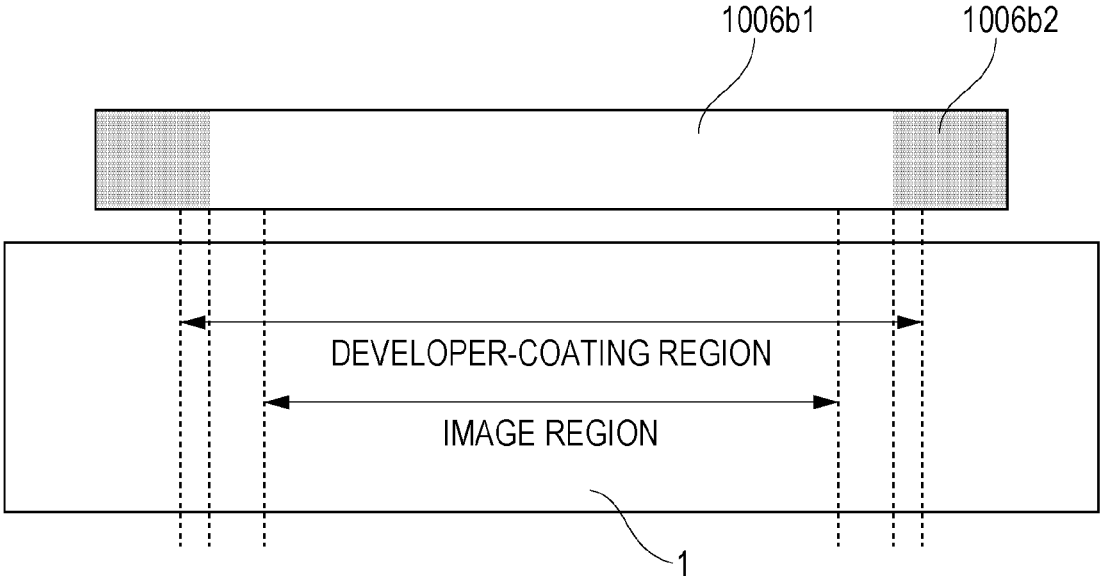
FIG. 23 illustrates the longitudinal positions of portions to be cured in the end portions (in the width direction) of a cleaning blade according to a first embodiment.

In addition, in this embodiment, the catalyst solution is applied to a portion of the mold corresponding to the second region 1006*b*2 (in the second contact surface 1006*b*) corresponding to the non-image-forming region. In this embodiment, in order to apply the catalyst solution to at least the region corresponding to the contact portion of the photosensitive drum, the region (in the blade thickness direction) of the second contact surface to which the solution is applied is defined as a region extending at least 100 μm or more from the edge portion 1006*d*. In this embodiment, the region (in the blade width direction) of the second contact surface to which the solution is applied is defined as, as illustrated in FIG. 23, a region that is outside the image-forming region but extends to the inside of the developer-carrying region (coating region) of the development sleeve. As a result, in the second contact surface 1006*b*, covering toner serving as a lubricant can be supplied even to the second region 1006*b*2 subjected to the curing treatment so that curling of the end portions of the blade can be suppressed. In this embodiment, the width of the end portions subjected to the curing treatment is 10 mm. The cleaning blade in this embodiment has a thickness of 2 mm, a length of 20 mm, and a width of 345 mm. The Young's modulus of the cleaning blade of this embodiment was determined with a nano-indentation tester ENT-1100 (product name, manufactured by ELIONIX INC.). Specifically, a loading-unloading test was carried out under the following conditions at appropriate points from the surface to the inside of the contact portion of the cleaning blade; and the tester provided the Young's modulus as the calculation result.

Test Mode: loading-unloading test
Loading Range: A
Test Load: 100 [mgf]
Number of Divisions: 1000 [times]
Step Interval: 10 [ms]
Load Holding Time: 2 [s]

The measurement under these conditions provided the following results in terms of Young's modulus of a region extending 100 μm from the edge portion 1006*d* in the image-forming region of the first contact surface 1006*c*: $Y_0$=42 mgf/μm$^2$, $Y_{20}$=20 mgf/μm$^2$, and $Y_{50}$=8 mgf/μm$^2$.

Young's Modulus Characteristics in Second Contact Surface

Hereinafter, the Young's modulus of the non-image-forming region will be described with reference to FIG. 21.

Figure 21:
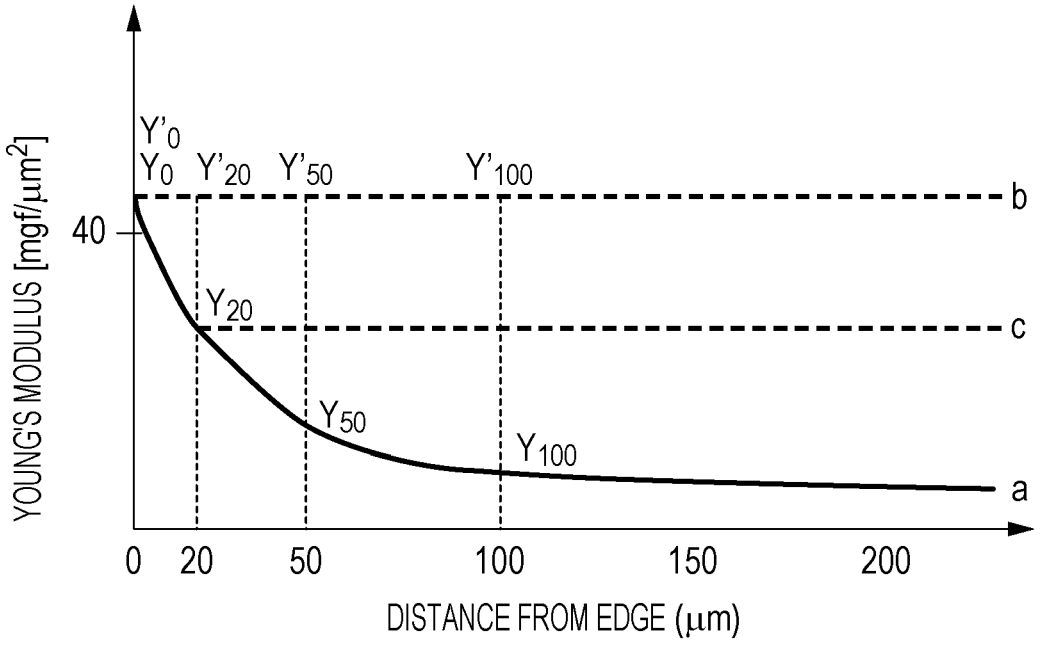
FIG. 21 is a graph illustrating Young's modulus distributions in an image region and a non-image region in the second contact surface of a cleaning blade according to a first embodiment.

FIG. 21 illustrates the Young's modulus distributions of the surface of the second contact surface 1006*b* of the cleaning blade 1006 of this embodiment, the distributions including the distribution in the image-forming region and the distribution in the non-image-forming region. In FIG. 21, the abscissa axis indicates a distance from the edge 1006*d* (the distance in the direction from the first contact surface 1006*c* to the inside of the blade).

The curve a represents the Young's modulus distribution in the first region 1006*b*1 (corresponding to the image-forming region) of the surface of the second contact surface 1006*b*, and illustrates the distribution of a Young's modulus $Y_L$ at a position separated by a distance L from the edge portion 1006*d*.

The curve b represents the Young's modulus distribution in the second region 1006*b*2 (corresponding to the outside of the image-forming region) of the surface of the second contact surface 1006*b*, and illustrates the distribution of a Young's modulus $Y'_L$ at a position separated by a distance L from the edge portion 1006*d*.

According to the curve a, in the image-forming region, in order to achieve sufficiently high wear resistance and cleaning performance, the surface has a high Young's modulus $Y_0$; and, the farther from the edge portion, the more decreased the Young's modulus to $Y_{20}$ and to $Y_{50}$. And the layer positioned more than 100 μm inside from the edge 1006*d* toward the inside of the blade has a Young's modulus close to that of uncured urethane rubber.

On the other hand, according to the curve b, at least in the region extending from the edge 1006*d* (0 μm) to 100 μm, the Young's modulus that is equivalent to the Young's modulus $Y_0$ in the image-forming region is maintained. In other words, in this embodiment, in the surface of the second contact surface 1006*b*, the Young's modulus $Y'_L$ in the non-image-forming region, in the range in which the distance L from the edge portion is $0 \leq L \leq 100$ μm, is at least higher than the Young's modulus $Y_{50}$ in the image-forming region.

As a result, in a case where, in the contact portion of the cleaning blade 1006, the second contact surface 1006*b* disposed upstream in the rotation direction of the photosensitive drum considerably wears, an increase in the frictional force of the contact portion of the blade can be suppressed. In particular, in a case where the amount of wear of the blade is larger in the non-image-forming region than in the image-forming region, the Young's modulus of the surface of the second contact surface 1006*b* does not decrease.

In this embodiment, according to the curve b, in the non-image-forming region of the surface of the second contact surface 1006*b*, at least in the range from the edge 1006*d* (0 μm) to 100 μm, the Young's modulus $Y'_L$ of the second contact surface 1006*b* is about 40 mgf/μm$^2$. In other words, in the surface of the second contact surface 1006*b*, at least in the range from the edge 1006*d* (0 μm) to 100 μm, the Young's modulus of the surface of the second contact surface 1006*b* is 10 mgf/μm$^2$ or more and 400 mgf/μm$^2$ or less. As a result, even in a case where the amount of wear in the blade end portions is larger in the non-image-forming region than in the image-forming region, reduction in the friction of the end portions of the cleaning blade can be achieved without affecting the cleaning performance of the image region.

Change in Young's Modulus of Blade End Portion

In this embodiment, as described above, in the non-image-forming region of the cleaning blade 1006, both of the first contact surface 1006*c* and the second contact surface 1006*b* are subjected to the curing treatment described in Examples A to C. In other words, both of the first contact surface 1006*c* and the second contact surface 1006*b* are subjected to the curing treatment so as to contain an isocyanurate group. As a result, in each of the first contact surface 1006*c* and the second contact surface 1006*b*, over the region from the surface to 50 μm inside, the Young's modulus gradually decreases. Thus, the non-image-forming region (subjected to the curing treatment) of the cleaning blade has a surface having a high hardness and an inner portion having a relatively low hardness, so that the blade has enhanced conformability.

In this embodiment, the curing treatment for the non-image-forming region is carried out, in the surface of the first contact surface 1006*c*, at least in the region from the edge portion 1006*d* to 100 μm and also carried out, in the surface of the second contact surface 1006*b*, at least in the region from the edge portion 1006*d* to 100 μm. In this embodiment, in the surface of the first contact surface 1006*c*, in the region from a position 20 μm separated from the edge portion 1006*d* to a position 100 μm separated from the edge portion 1006*d*, the Young's modulus satisfies $Yc'_{20}/Yc'_0<0.8$ or less. As a result, in the cleaning blade 1006, the non-image-forming region subjected to the curing treatment is formed so as to have a region in which the Young's modulus changes, so that degradation of the conformability can be suppressed.

In this embodiment, in the first contact surface 1006*c*, in the surface of the non-image-forming region subjected to the curing treatment, the region from the edge portion 1006*d* to a distance of 20 μm is influenced by the curing treatment for the surface of the neighboring second contact surface 1006*b*.

This influence will described with reference to the curve c. The curve c in FIG. 21 represents the Young's modulus Y' distribution at a position inside the second contact surface in the non-image-forming region subjected to the curing treatment according to this embodiment. Specifically, the curve c represents the Young's modulus $Y'_L$ distribution at a position 20 μm separated from the edge portion 1006*d* of the first contact surface 1006*c*, in the region from the first contact surface to a position L μm inside. In this case, in the range of $0 \le L \le 20$ μm, due to the influence of the curing treatment for the first contact surface, the Young's modulus Y' decreases from the surface to the inside of the blade. On the other hand, in the range of 20 μm≤L, due to the influence of the curing treatment for the surface of the second contact surface 1006*b*, the Young's modulus is constant at $Y'_{20}$.

Similarly, for example, in the surface of the non-image-forming region (subjected to the curing treatment) in the first contact surface 1006*c*, consider the Young's modulus $Y'_L$ at a position 10 μm separated from the edge portion 1006*d*. In the range of $0 \le L \le 10$ μm, due to the curing treatment for the surface of the first contact surface, the Young's modulus decreases from the surface to the inside of the blade. In other words, like the curve a in FIG. 21, the Young's modulus changes from $Y_0$ to $Y_{10}$. On the other hand, in the range of 10 μm or more inside of the cleaning blade, probably due to the influence of the curing treatment for the surface of the second contact surface, the Young's modulus is constant at $Y_{10}$.

Note that, in this embodiment, most of the non-image-forming region (subjected to the curing treatment) in the first contact surface 1006*c* has a Young's modulus satisfying $Yc'_{20}/Yc'_0<0.8$ or less. In other words, at least in a region separated by 20 μm or more from the edge portion, the Young's modulus satisfies $Yc'_{20}/Yc'_0<0.8$ or less. As a result, the effect of suppressing degradation of conformability of the blade in the blade end portions is provided.

In summary, according to this embodiment, even in a case where the blade considerably wears with time, while degradation of the conformability of the blade is suppressed, the surface of the non-image-forming region can be maintained so as to have a low coefficient of friction. Thus, the occurrence of curling of the end portions can be suppressed.

In summary, by using the cleaning blade of this embodiment, as illustrated in FIGS. 22A and 22B, even in a case where the blade end portions wear in an amount of 100 μm or more, without exposure of the urethane portion, the surface subjected to the curing treatment so as to have a low coefficient of friction is continuously in contact with the photosensitive drum. As a result, curling of the end portions does not occur and high cleaning performance can be maintained in the image region.

Second Embodiment

The difference between this embodiment and the first embodiment lies in the method of performing the curing treatment for the non-image-forming region of the second contact surface 1006*b*. In the first embodiment, the curing treatment for the second contact surface 1006*b* is carried out with an isocyanurate catalyst as in the first contact surface 1006*c*. On the other hand, in this embodiment, the first contact surface 1006*c* in FIG. 19 is subjected to a curing treatment with an isocyanurate catalyst to form the cleaning blade, whereas the second contact surface 1006*b* in FIG. 19 is subjected to a curing treatment with an isocyanate compound in a later treatment.

In this embodiment, a plurality of blades are formed by cutting, with a cutter, an article prepared with a mold for producing blades. In this embodiment, the edge portion 1006*d* to be in contact with the photosensitive drum is formed by cutting. The first contact surface 1006*c* in FIG. 19 corresponds to the bottom surface of the mold, and the second contact surface 1006*b* in FIG. 19 corresponds to a surface formed by cutting. Thus, since a large number of blades can be produced from a single mold, this production method is suitable for mass production and also allows reduction in the cost. In this case, unlike the first embodiment, the catalyst for subjecting the second contact surface 1006*b* to the curing treatment cannot be applied during molding. For this reason, in this embodiment, in a treatment after the cutting, the second contact surface is subjected to the curing treatment.

Curing Treatment for Blade End Portions with Isocyanate Compound

As described above, in this embodiment, as the curing treatment for the second contact surface 1006*b* of the cleaning blade, a curing treatment using an isocyanate compound is employed. Unless otherwise specified, the other features are the same as in the first embodiment and the detailed descriptions thereof are omitted.

In the second embodiment, the method for performing the curing treatment for the non-image-forming region of the second contact surface 1006*b* includes, for example, the following steps:

(1) a step of bringing an isocyanate compound into contact with both end portions (in the longitudinal direction) of the photosensitive-drum contact portion of the blade formed of a polyurethane resin, (2) a step of leaving the isocyanate compound being in contact with the surface of the blade to impregnate the isocyanate compound into the polyurethane resin, (3) a step of, after the impregnation, removing the isocyanate compound remaining on the surface of the blade, and (4) a step of causing a reaction of curing of the isocyanate compound impregnated into the blade to form a high-hardness portion.

In addition, the high-hardness portion is aged for a certain period of time until the hardness stabilizes, though this is not defined as a step.

Specifically, in the step (2), an appropriate amount of the isocyanate compound is impregnated into both end portions (in the longitudinal direction) of the photosensitive-drum contact portion of the blade formed of a polyurethane resin. In the step (3), excess of the isocyanate compound is removed from the surface of the blade. In the step (4), curing through a reaction is caused: the reaction between the isocyanate compound impregnated in the step (2) and water in the atmosphere is caused to form urea bonds, which mainly form the high-hardness portion.

In addition, polymerization reactions (such as a carbodiimide-forming reaction and an isocyanurate-forming reaction) between isocyanate compounds simultaneously occur, which probably contributes to the formation of the high-hardness portion. As a result, the hardness of the high-hardness portion is sufficiently increased and the coefficient of friction is sufficiently decreased, so that the durability of the blade can be probably improved.

Figure 24:
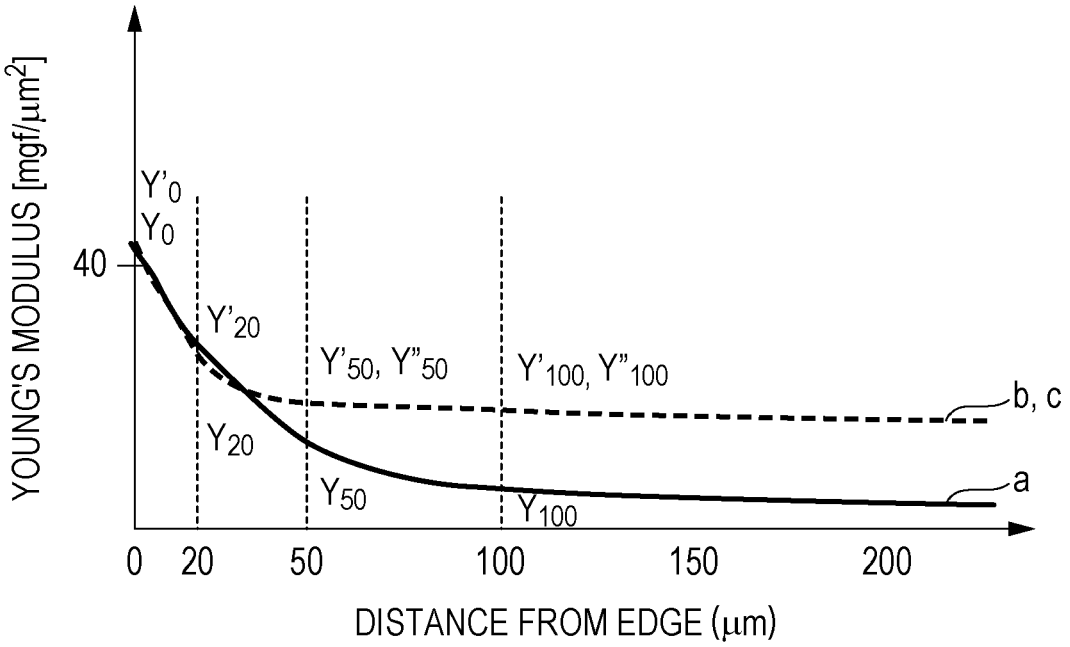
FIG. 24 illustrates Young's modulus distributions in an image region and a non-image region in the second contact surface of a cleaning blade according to a second embodiment.

The Young's modulus distribution of the cleaning blade of this embodiment is illustrated in FIG. 24. The curve a represents the Young's modulus distribution of the first region 1006*b*1 corresponding to the image-forming region of the surface of the second contact surface 1006*b*, the distribution being the distribution of the Young's modulus $Y_L$ at a distance L from the edge portion 1006*d*.

The curve b represents the Young's modulus distribution of the second region 1006*b*2 corresponding to the outside of the image-forming region in the surface of the second contact surface 1006*b*, the distribution being the distribution of the Young's modulus $Y'_L$ at a distance L from the edge portion 1006*d*.

The curve c in FIG. 24 represents the Young's modulus Y' distribution of the non-image-forming region (subjected to the curing treatment) in a position inside the second contact surface in this embodiment. Specifically, the curve c represents the distribution of the Young's modulus $Y'_L$ at a position 100 μm from the edge portion 1006*d* in the first contact surface 1006 and at a distance of L μm inside the first contact surface. Incidentally, the curve c in FIG. 24 overlaps the curve b.

The curve a is the same as in the first embodiment. In the image-forming region, in order to achieve sufficiently high wear resistance and cleaning performance, the surface has a high Young's modulus $Y_0$ and, from the surface to the inside, the Young's modulus decreases to $Y_{20}$ and to $Y_{50}$. The layer more than 100 μm inside from the edge portion 1006*d* toward the inside of the blade has a Young's modulus close to the Young's modulus of uncured urethane rubber.

On the other hand, according to the curve b, in the range where the distance L from the edge 1006*d* is about 0 μm to about 35 μm, the Young's modulus $Y'_L$ is similar to the Young's modulus $Y_L$ in the image-forming region. In the range where the distance L from the edge 1006*d* is more than about 35 μm, the Young's modulus $Y'_L$ in the non-image-forming region is constant at about 20 mgf/μm$^2$.

In this embodiment, in the surface of the second contact surface 1006*b*, the Young's modulus $Y_0$ of the edge portion 1006*d* is 15 mgf/μm$^2$ or more and 400 mgf/μm$^2$ or less. The ratio $Y_{50}/Y_0$ of the Young's modulus $Y_{50}$ at a position 50 μm from the edge portion 1006*d* to the Young's modulus $Y_0$ at the edge portion 1006*d* is more than 0 and 0.5 or less.

Similarly, in the surface of the second contact surface 1006*b*, the average rate of change of the Young's modulus from the edge portion 1006*d* to a position 20 μm separated is equal to or more than the average rate of change of the Young's modulus of the position 20 μm separated to a position 50 μm separated from the edge portion 1006*d*. As a result, in the non-image-forming region, the friction of the cleaning blade can be reduced and degradation of the conformability of the blade can be suppressed.

In this embodiment, in the surface of the second contact surface 1006*b*, the Young's modulus $Y'_L$ in the non-image-forming region in the range where the distance L from the edge portion is $0 \leq L \leq 100$ μm, is higher than the Young's modulus $Y_{50}$ at a position 50 μm inside in the image-forming region. As a result, even in a case where the second contact surface 1006*b* of the cleaning blade wears, the friction of the non-image-forming region can be decreased.

In this embodiment, the Young's modulus $Y'_L$ of the surface of the second contact surface 1006*b* in the range where the distance L from the edge portion is 50 μm L 100 μm, is lower than the Young's modulus $Y_{20}$ at a position 20 μm inside in the image-forming region. As a result, in the non-image-forming region of the cleaning blade, a region in which the Young's modulus gradually decreases can be ensured in the surface region (0 to 20 μm) in the first contact surface 1006*c*. As a result, compared with a case where the Young's modulus is constant, in the surface region (0 to 20 μm) in the first contact surface, the conformability of the cleaning blade in the non-image-forming region can be enhanced.

In summary, by using the cleaning blade of this embodiment, as illustrated in FIGS. 22A and 22B, the end portions tend not to wear. Even in a case where an amount of wear reaches 100 μm or more, exposure of the urethane portion can be suppressed or the exposure can be retarded. In this embodiment, even in a case where an amount of wear reaches 100 μm or more in the blade end portions, the surface subjected to the curing treatment so as to have a low coefficient of friction in the second contact surface 1006*b* is continuously in contact with the photosensitive drum. For this reason, curling of the end portion does not occur and a high cleaning performance in the image region can be maintained.

Young's Modulus Distribution in Second Contact Surface

The Young's modulus of the contact portion surface of the second contact surface 1006*b* in this embodiment will be described.

In this embodiment, in the non-image-forming region of the surface of the second contact surface 1006*b* in which the Young's modulus at a distance of L μm from the edge portion 1006*d* is defined as $Y'_L$, the Young's modulus $Y'_0$ is 15 mgf/μm$^2$ or more and 400 mgf/μm$^2$ or less. In the non-image-forming region in the surface of the second contact surface 1006*b*, the ratio $Y'_{50}/Y'_0$ of the Young's modulus $Y'_{50}$ at a position 50 μm from the edge portion 1006*d* and the Young's modulus $Y'_0$ at the edge portion 1006*d* is more than 0 and 0.5 or less.

In the non-image-forming region of the surface of the second contact surface 1006*b*, the average rate of change of the Young's modulus from the edge portion 1006*d* to the position 20 μm separated is equal to or more than the average rate of change of the Young's modulus from the position 20 μm separated to the position 50 μm separated from the edge portion 1006*d*.

In this embodiment, in the image-forming region in the surface of the second contact surface 1006*b* in which the Young's modulus at a distance of L μm from the edge portion 1006*d* is defined as $Y_L$, the Young's modulus $Y_0$ is 15 mgf/μm$^2$ or more and 400 mgf/μm$^2$ or less. In the image-forming region of the surface of the second contact surface 1006*b*, the ratio $Y_{50}/Y_0$ of the Young's modulus $Y_{50}$ of a position 50 μm separated from the edge portion 1006*d* to the Young's modulus $Y_0$ at the edge portion 1006*d* is more than 0 and 0.5 or less. In the non-image-forming region of the surface of the second contact surface 1006*b*, the average rate of change of the Young's modulus in the range from the edge portion 1006*d* to a position 20 μm separated is equal to or more than the average rate of change of the Young's modulus in the range from the position 20 μm separated to a position 50 μm separated from the edge portion 1006*d*.

Characteristics in Blade Thickness Direction in Young's Modulus Distribution in Second Contact Surface In this embodiment, the Young's modulus distribution in the uppermost surface of the second contact surface 1006*b* is substantially the same as the Young's modulus distribution from the uppermost surface to a position 100 μm inside of the second contact surface 1006*b*.

This is because, in a case where uncured urethane rubber is subjected to a curing treatment using an isocyanate compound, the Young's modulus of the cured surface and the Young's modulus in the range from the surface to a position 100 μm inside are constant.

Young's Modulus Distribution in First Contact Surface

Hereinafter, in the first contact surface 1006*c* of this embodiment, the Young's modulus of the photosensitive-drum contact portion will be described.

In this embodiment, in the width direction of the cleaning blade 1006, in the region corresponding to the image-forming region, the Young's modulus at a distance of L μm from the surface of the first contact surface 1006*c* is defined as $Yc_L$. In this embodiment, in the case of L=0, the Young's modulus $Yc_0$ of the surface of the first contact surface 1006*c* is 15 mgf/μm$^2$ or more and 400 mgf/μm$^2$ or less. The ratio $Yc_{50}/Yc_0$ of the Young's modulus $Yc_{50}$ at a distance 50 μm from the first contact surface 1006*c* to the Young's modulus $Yc_0$ is more than 0 and 0.5 or less.

In the width direction of the cleaning blade 1006, in the region corresponding to the image-forming region, the average rate of change of the Young's modulus from the first contact surface 1006*c* to a position 20 μm inside is defined as $[\{(Yc_0-Yc_{20})/Yc_0\}/(20-0)]$. In the width direction of the cleaning blade 1006, in the region corresponding to the image-forming region, the average rate of change of the Young's modulus from the position 20 μm inside to the position 50 μm inside is defined as $[\{(Yc_{20}-Yc_{50})/Yc_0\}/(50-20)]$. In this case, $[\{(Yc_0-Yc_{20})/Y_0\}/(20-0)]$ is equal to or more than $[\{(Yc_{20}-Yc_{50})/Yc_0\}/(50-20)]$.

Hereinafter, in this embodiment, the Young's modulus of the non-image-forming region of the photosensitive-drum contact portion of the first contact surface 1006*c* will be described.

In this embodiment, in the width direction of the cleaning blade 1006, in the region corresponding to the non-image-forming region, the Young's modulus at a distance of L μm from the surface of the first contact surface 1006*c* is defined as $Yc'_L$. In this embodiment, in the case of L=0, that is, the Young's modulus $Yc'_0$ of the surface of the first contact surface 1006*c* is 15 mgf/μm$^2$ or more and 400 mgf/μm$^2$ or less. The ratio $Yc'_{50}/Yc'_0$ of the Young's modulus $Yc'_{50}$ at a position 50 μm separated from the first contact surface 1006*c* to the Young's modulus $Yc'_0$ is more than 0 and 0.5 or less.

In the width direction of the cleaning blade 1006, in the region corresponding to the image-forming region, the average rate of change of the Young's modulus from the first contact surface 1006*c* to a position 20 μm inside is defined as $[\{(Yc'_0-Yc'_{20})/Yc'_0\}/(20-0)]$. In the width direction of the cleaning blade 1006, in the region corresponding to the image-forming region, the average rate of change of the Young's modulus from the position 20 μm inside to a position 50 μm inside is defined as $[\{(Yc'_{20}-Yc'_{50})/Yc'_0\}/(50-20)]$. In this case, $[\{(Yc'_0-Yc'_{20})/Yc'_0\}/(20-0)]$ is equal to or more than $[\{(Yc'_{20}-Yc'_{50})/Yc'_0\}/(50-20)]$.

In the photosensitive-drum contact portion of the first contact surface 1006*c* in the width direction of the cleaning blade 1006, in the region corresponding to the non-image-forming region, consider a region 50 μm to 100 μm separated from the edge portion 1006*d*. In this region, the Young's modulus at a position 100 μm separated from the first contact surface 1006*c* is defined as $Yc'_{100}$, and $Yc'_{100}$ satisfies Young's modulus $Y_{50} \leq Yc'_{100} \leq$ Young's modulus $Y_{20}$.

As described above, in this embodiment, the Young's modulus distribution of the uppermost surface of the second contact surface 1006*b* is substantially the same as the Young's modulus distribution of a portion from the uppermost surface to a position 100 μm inside of the second contact surface 1006*b*.

Thus, even in the position 100 μm inside from the surface of the second contact surface 1006*b*, the position being possibly exposed as a result of wear, the Young's modulus $Y'_{100}$ of the uppermost surface of the second region 1006*b*2 subjected to the curing treatment can be maintained. Even in the position 100 μm inside from the surface of the second contact surface 1006*b*, the position being possibly exposed as a result of wear, a higher hardness can be achieved than that at the Young's modulus $Y_{50}$, so that curling of the blade end portions can be suppressed. In the uppermost surface of the second contact surface 1006*b*, at least in the region extending from the edge portion to 100 μm, the Young's modulus $Y'_L$ of the non-image-forming region is higher than the Young's modulus $Y_{50}$ of the image-forming region. The Young's modulus $Y'_{100}$ of the non-image-forming region is higher than the Young's modulus $Y_{100}$ of the image-forming region. Accordingly, even when the surface of the second contact surface wears, a high Young's modulus can be maintained for at least 100 μm in the blade thickness direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-220745 filed Oct. 29, 2014, which is hereby incorporated by reference herein in its entirety.

What is claimed is:

1. A cleaning blade that is formed of urethane rubber and is in contact with an image-carrying member carrying a toner image to clean the image-carrying member, the cleaning blade comprising:

a first surface that faces the image-carrying member and is orthogonal to a thickness direction of the cleaning blade; and a second surface that forms, together with the first surface, an edge portion that is in contact with the image-carrying member, wherein at least a portion of the second surface is cured so as to satisfy relationships below:

$$10\ \text{mgf}/\mu\text{m}^2 \leq Y_0 \leq 400\ \text{mgf}/\mu\text{m}^2$$

$$0 < Y_{50}/Y_0 \leq 0.5$$

$$\{(Y_{20}-Y_{50})/Y_0\}/(50-20) \leq \{(Y_0-Y_{20})/Y_0\}/(20-0)$$

$$10\ \text{mgf}/\mu\text{m}^2 \leq Y'_0 \leq 400\ \text{mgf}/\mu\text{m}^2$$

$Y_{50} \leq Y'_L$ where with respect to all $Ls$ satisfying $0 \leq L \leq 100\ \mu\text{m}$ where $Y_0$: Young's modulus of the edge portion in a region of the second surface, the region corresponding to an image-forming region in which an image is formed in the image-carrying member in a direction orthogonal to a direction that the image-carrying member conveys a toner image $Y_{50}$: Young's modulus at a position 50 μm separated from the edge portion in a region of the second surface, the region corresponding to the image-forming region $Y_{20}$: Young's modulus at a position 20 μm separated from the edge portion in a region of the second surface, the region corresponding to the image-forming region $Y'_0$: Young's modulus of the edge portion in a region of the second surface, the region is in an edge portion side than the image-forming region and corresponding to a non-image-forming region in which no image is formed in the image-carrying member in a direction orthogonal to a direction that the image-carrying member conveys a toner image L: distance from the edge portion of the second surface $Y'_L$: Young's modulus at a position L μm separated from the edge portion in a region of the second surface, the region corresponding to the non-image-forming region.

2. The cleaning blade according to claim 1, wherein at least a portion of the second surface is cured so as to satisfy relationships below:

$$0 < Y'_{50}/Y'_0 \leq 0.5$$

$$\{(Y'_{20}-Y'_{50})/Y'_0\}/(50-20) \leq \{(Y'_0-Y'_{20})/Y'_0\}/(20-0)$$

where $Y'_{50}$: Young's modulus at a position 50 μm separated from the edge portion in a region of the second surface, the region corresponding to the non-image-forming region $Y'_{20}$: Young's modulus at a position 20 μm separated from the edge portion in a region of the second surface, the region corresponding to the non-image-forming region.

3. The cleaning blade according to claim 1, wherein at least a portion of the first surface is cured so as to satisfy relationships below:

$$10\ \text{mgf}/\mu\text{m}^2 \leq Yc_0 \leq 400\ \text{mgf}/\mu\text{m}^2$$

$$0 < Yc_{50}/Yc_0 \leq 0.5$$

$$\{(Yc_{20}-Yc_{50})/Yc_0\}/(50-20) < \{(Yc_0-Yc_{20})/Yc_0\}/(20-0)$$

where $Yc_0$: Young's modulus of the edge portion in a region of the first surface, the region corresponding to the image-forming region $Yc_{50}$: Young's modulus at a position 50 μm separated from the edge portion in a region of the first surface, the region corresponding to the image-forming region $Yc_{20}$: Young's modulus at a position 20 μm separated from the edge portion in a region of the first surface, the region corresponding to the image-forming region.

4. The cleaning blade according to claim 1, wherein at least a portion of the first surface is cured so as to satisfy relationships below:

$$10\ \text{mgf}/\mu\text{m}^2 \leq Yc'_0 \leq 400\ \text{mgf}/\mu\text{m}^2$$

$$0 < Yc'_{50}/Yc'_0 \leq 0.5$$

$$\{(Yc'_{20}-Yc'_{50})/Yc'_0\}/(50-20) < \{(Yc'_0-Yc'_{20})/Yc'_0\}/(20-0)$$

where $Yc'_0$: Young's modulus of the edge portion in a region of the first surface, the region corresponding to the non-image-forming region $Yc'_{20}$: Young's modulus at a position 20 μm separated from the edge portion in a region of the first surface, the region corresponding to the non-image-forming region $Yc'_{50}$: Young's modulus at a position 50 μm separated from the edge portion in a region of the first surface, the region corresponding to the non-image-forming region.

5. The cleaning blade according to claim 1, wherein the second surface is cured so as to satisfy a relationship below:

$Y_{20} \leq Y'_L \leq Y_{50}$ where $L$ satisfies $50\ \mu\text{m} \leq L \leq 100\ \mu\text{m}$.

6. The cleaning blade according to claim 1, wherein the first surface and at least a portion of the second surface are cured so as to satisfy a relationship below:

$$Y_{50} \leq Yc'_{100} \leq Y_{20}$$

where $Yc'_{100}$: Young's modulus at a position 100 μm separated from the edge portion in a region of the first surface, the region corresponding to the non-image-forming region.

7. The cleaning blade according to claim 1, wherein at least a portion of the second surface is cured so as to satisfy a relationship below:

$$10\ \text{mgf}/\mu\text{m}^2 \leq Y_0 \leq 250\ \text{mgf}/\mu\text{m}^2.$$

8. The cleaning blade according to claim 1, wherein the urethane rubber contains an isocyanurate group.

9. The cleaning blade according to claim 8, wherein at least a portion of the second surface is cured so as to satisfy a relationship below:

$$10\ \text{mgf}/\mu\text{m}^2 \leq Y_0 \leq 250\ \text{mgf}/\mu\text{m}^2.$$

10. The cleaning blade according to claim 1, wherein the urethane rubber is a polyester-based urethane rubber having an isocyanurate group, and a surface of the polyester-based urethane rubber measured by a μATR method provides an IR spectrum satisfying a ratio $I_{SI}/I_{SE}$ of 0.50 or more and 1.55 or less where $I_{SI}$ represents an intensity of a C—N peak at 1411 $\text{cm}^{-1}$ derived from the isocyanurate group in the polyester-based urethane rubber and $I_{SE}$ represents an intensity of a C=O peak at 1726 $cm^{-1}$ derived from an ester group in the polyester-based urethane rubber.

11. The cleaning blade according to claim 1, wherein, in a graph in which an abscissa axis indicates a distance from the edge portion and an ordinate axis indicates Young's modulus, a Young's modulus $Y_N$ at a position N μm separated from the edge portion in a range of $0<N<50$ is positioned below a straight line connecting $Y_0$ and the Young's modulus $Y_{50}$.

12. The cleaning blade according to claim 1, wherein at least a portion of the second surface is cured so as to satisfy a relationship below:

$$0<Y_{20}/Y_0\leq 0.5.$$

13. The cleaning blade according to claim 1, wherein at least a portion of the second surface, the portion corresponding to the non-image-forming region, is cured with an isocyanate compound.

14. The cleaning blade according to claim 1, wherein the first surface contains an isocyanurate group.

15. The cleaning blade according to claim 1, wherein the cleaning blade is in contact with the image-carrying member serving as a cleaning target member such that the cleaning blade lies in a counter direction with respect to a rotation direction of the cleaning target member.

16. A cleaning blade that is formed of urethane rubber and is in contact with an image-carrying member carrying a toner image to clean the image-carrying member, the cleaning blade comprising:

a first surface that faces the image-carrying member and is orthogonal to a thickness direction of the cleaning blade; and a second surface that forms, together with the first surface, an edge portion that is in contact with the image-carrying member, wherein at least a portion of the first surface is cured so as to satisfy relationships below:

$$10\ \text{mgf}/\mu m^2\leq Yc_0\leq 400\ \text{mgf}/\mu m^2$$

$$0<Yc_{50}/Yc_0\leq 0.5$$

$$\{(Yc_{20}-Yc_{50})/Yc_0\}/(50-20)\leq\{(Yc_0-Yc_{20})/Yc_0\}/(20-0)$$

$$Yc_{100}<Yc'_{100}$$

where $Yc_0$: Young's modulus of the edge portion in a region of the first surface, the region corresponding to an image-forming region in which an image is formed in the image-carrying member in a direction orthogonal to a direction that the image-carrying member conveys a toner image $Yc_{50}$: Young's modulus at a position 50 μm separated from the edge portion in a region of the first surface, the region corresponding to the image-forming region $Yc_{20}$: Young's modulus at a position 20 μm separated from the edge portion in a region of the first surface, the region corresponding to the image-forming region $Yc_{100}$: Young's modulus at a position 100 μm separated from the edge portion in a region of the first surface, the region corresponding to the image-forming region $Yc'_{100}$: Young's modulus at a position 100 μm separated from the edge portion in a region of the first surface, the region is in an edge portion side than the image-forming region and corresponding to a non-image-forming region in which no image is formed in the image-carrying member in a direction orthogonal to a direction that the image-carrying member conveys a toner image.

* * * * *